US006677898B2

(12) United States Patent
Cheng et al.

(10) Patent No.: US 6,677,898 B2
(45) Date of Patent: Jan. 13, 2004

(54) METHOD FOR CONTROLLING ARRAY ANTENNA EQUIPPED WITH SINGLE RADIATING ELEMENT AND A PLURALITY OF PARASITIC ELEMENTS

(75) Inventors: Jun Cheng, Kyoto (JP); Akifumi Hirata, Kyoto (JP); Takashi Ohira, Kyoto (JP); Kyouichi Iigusa, Kyoto (JP); Takuyo Nakaji, Nagoya (JP); Nobuyoshi Kikuma, Nogoya (JP); Naoki Inagaki, Nagoya (JP)

(73) Assignee: Advanced Telecommunications Research Institute International, Kyoto (JP)

( * ) Notice: Subject to any disclaimer, the term of this patent is extended or adjusted under 35 U.S.C. 154(b) by 0 days.

(21) Appl. No.: 10/230,351

(22) Filed: Aug. 29, 2002

(65) Prior Publication Data

US 2003/0137451 A1 Jul. 24, 2003

(30) Foreign Application Priority Data

| | | |
|---|---|---|
| Dec. 19, 2001 | (JP) | P2001-385391 |
| Dec. 27, 2001 | (JP) | P2001-396238 |
| Jan. 16, 2002 | (JP) | P2002-007419 |
| Feb. 27, 2002 | (JP) | P2002-051057 |
| Mar. 5, 2002 | (JP) | P2002-058884 |

(51) Int. Cl.[7] ..... H01Q 3/22; H01Q 3/24; H01Q 3/26

(52) U.S. Cl. ..... 342/372; 342/368; 343/893

(58) Field of Search ..... 342/368, 372; 343/893, 816

(56) References Cited

U.S. PATENT DOCUMENTS 6,407,719 B1 6/2002 Ohira et al.

6,492,942 B1 * 12/2002 Kezys ..... 342/368

FOREIGN PATENT DOCUMENTS

| | | |
|---|---|---|
| JP | 2001-24431 A | 1/2001 |
| JP | 2002-118414 A | 4/2002 |

OTHER PUBLICATIONS

Ohira, Takashi et al., "Electronically Steerable Passive Array Radiator Antennas for Low–Cost Analog Adaptive Beamforming," 2000 IEEE International Conference on Phased Array System & Technology, pp. 101–104, Dana Point, California May 21–25, 2000.

(List continued on next page.)

*Primary Examiner*—Theodore M. Blum
(74) *Attorney, Agent, or Firm*—Birch, Stewart, Kolasch & Birch, LLP

(57) ABSTRACT

An adaptive controller for an ESPAR antenna randomly perturbs a bias voltage vector V(n) composed of elements of bias voltage values Vm by a random vector R(n) generated by a random number generator, compares an objective function value J(n) of a cross correlation coefficient for a bias voltage vector V(n) before the perturbation with an objective function value J(n+1) of a cross correlation coefficient for a bias voltage vector V(n+1) after the perturbation, and selects and sets the bias voltage Vm corresponding to that when the cross correlation coefficient increases before and after the perturbation. Then the adaptive controller repeats the random perturbation and setting from the bias voltage of respective varactor diodes. This leads to that it is not necessary to provide a long training sequence signal, and the control process can be executed with learning so that a performance can be improved every iteration for search.

20 Claims, 58 Drawing Sheets

OTHER PUBLICATIONS

Kamiya, Yukihiro et al., "Performance Considerations for the ESPAR Antenna—Statistical Considerations of SINR Characteristics Based on the Random Weight Search," Technical Report of IEICE, The Institute of Electronics, Information, and Communication Engineers in Japan, A–P2000–175, SANE2000–156, pp. 17–24, Jan. 2001 (English language abstract on p. 17).

Ohira, Takashi, et al., "Equivalent Weight Vector and Array Factor Formulation for Espar Antennas," Technical Report of IEICE, The Institute of Electronics, Information, and Communication Engineers in Japan, A–P2000–44, SAT2000–41, MW2000–44, pp. 7–14, Jul. 2000 (English language abstract on p. 7).

Ohira, Takashi, "Basic Theory on ESPAR Antenna Equivalent Weight Vector and Its Gradient," Technical Report of IEICE, The Institute of Electronics, Information, and Communication Engineers in Japan, A–P2001–16, SAT2001–3, pp. 15–20, May 2001 (English language abstract on p. 15).

Ohira, Takashi, "ESPAR Antenna Blind Adaptive Beamforming Based on a Moment Criterion," Technical Report of IEICE, The Institute of Electronics, Information, and Communication Engineers in Japan, ED2001–155, MW2001–115, pp. 23–28, Nov. 2001 (English language abstract on p. 23).

* cited by examiner

FIRST PREFERRED EMBODIMENT

ARRAY ANTENNA CONTROL APPARATUS

INPUT SNR : 30 dB
INPUT SIR : -4.77 dB
P=100, N=100

INPUT SNR : 30dB
INPUT SIR : -4.77dB
P=100, N=100
$b_0$=1500, $\sigma_0$=1500

INPUT SNR : 30dB
INPUT SIR : -4.77dB
P=100, N=100

SECOND PREFERRED EMBODIMENT

THIRD PREFERRED EMBODIMENT

ARRAY ANTENNA CONTROL APPARATUS

*Fig.28*

ELEMENTS OF ADMITTANCE MATRIX Y

| ELEMENT | $Y_{00}$ | $Y_{01}$ | $Y_{11}$ | $Y_{12}$ | $Y_{13}$ | $Y_{14}$ |
|---|---|---|---|---|---|---|
| REAL PART | 0.00086 | −0.00070 | 0.00442 | 0.00097 | −0.00054 | 0.00017 |
| IMAGINARY PART | −0.01208 | 0.00365 | −0.00716 | 0.00479 | −0.00113 | −0.00030 |

*Fig.45*

COMPARISON AMONG RESPECTIVE ADAPTIVE CONTROL METHODS

| | NUMBER OF NEW DATA POINTS REQUIRED FOR COMPARISON | NUMBER OF DATA REQUIRED FOR ONE ITERATION | CONVERGENCE OF CHANGING WIDTH | SELECTION OF CHANGING DIRECTION |
|---|---|---|---|---|
| STEEPEST GRADIENT METHOD | 1 | 7 | DECREASE WITH DIFFERENTIAL COEFFICIENT | DIRECTION OF MAXIMUM IMPROVEMENT |
| HIGHER-DIMENSIONAL DICHOTOMIZING SEARCH METHOD | 2 | 13 | DECREASE BY HALF AT EVERY ITERATION | COMPARISON OF NEW TWO STATES |
| SEQUENTIAL RANDOM METHOD | 1 | 1 | CAN BE SET BY PARAMETERS | RANDOM |
| VARIABLE-STEP SEARCH METHOD | 1 | 1 | TO ONE Q-TH WITHOUT IMPROVEMENT | PREDICTED FROM PRECEDING ITERATION |

FOURTH PREFERRED EMBODIMENT

FIFTH PREFERRED EMBODIMENT

METHOD FOR CONTROLLING ARRAY ANTENNA EQUIPPED WITH SINGLE RADIATING ELEMENT AND A PLURALITY OF PARASITIC ELEMENTS

BACKGROUND OF THE INVENTION

1. Field of the Invention

The present invention relates to a method for controlling an array antenna capable of changing a directivity characteristic of an array antenna apparatus including a plurality of antenna elements. In particular, the invention relates to a method for controlling an array antenna capable of adaptively changing an directivity characteristic of an electronically steerable passive array radiator (ESPAR) antenna (hereinafter, referred to as an ESPAR antenna) equipped with a single radiating element and a plurality of parasitic elements.

2. Description of the Related Art

An ESPAR antennas of related art is proposed in, for example, U.S. Pat. No. 6,407,719, the Related art document 1 of T. Ohira et al., "Electronically steerable passive array radiator antennas for low-cost analog adaptive beamforming", 2000 IEEE International Conference on Phased Array System &, Technology pp. 101–104, Dana point, Calif., May 21–25, 2000, and the Japanese Patent Laid-Open Publication No. 2001-24431. This ESPAR antenna is equipped with an array antenna which includes a radiating element to which a radio signal is fed, at least one parasitic element which is provided apart by a predetermined distance from the radiating element and to which no radio signal is fed, and a variable-reactance element connected to the parasitic element, where the directivity characteristics of the array antenna can be changed, by changing the reactance value of the variable-reactance element.

A beamforming method using spatial power combining, such as that in the ESPAR antenna, is capable of achieving a variable directivity, and this leads to obtaining a high gain, with a simple hardware configuration and low power consumption. Therefore, an antenna of this method can be expected as a practical terminal-mounted adaptive antenna (in particular, one mounted on a mobile user terminal).

However, in the case of the ESPAR antennas, it is impossible to observe any signal on a passive element. Therefore, it is necessary to observe only an output signal from a single port and process the output signal as a feedback signal for adjusting the reactance value. In other words, most methods prepared for conventional adaptive arrays cannot be directly applied to the ESPAR antenna.

In order to solve this problem, there has been proposed, for example, in the Japanese Patent Laid-Open Publication No. 2002-118414, a control method (hereinafter, referred to as first related art method) for, by using the so-called "steepest gradient method", perturbing the reactance values of respective variable-reactance elements sequentially by a predetermined shift amount, calculating a gradient vector for a predetermined estimation function value versus respective reactance values, and calculating and setting, based on the calculated gradient vector, reactance values of the respective variable-reactance elements, thereby directing the main beam of the array antenna toward a desired wave and directing the null(s) thereof toward the direction(s) of the interference wave(s) so that the estimation function value becomes the maximum or the minimum thereof.

However, this first related art method involves successive perturbations in order to determine respective components of the gradient vector, which in turn involves (M+1) times of calculations of an objective function in each iteration of perturbation. In the case of the ESPAR antenna, it is necessary to provide a training sequence at least (M+1) times longer than that of conventional adaptive arrays, and this leads to such a problem as increase in calculation quantity.

Also, with the use of the first related art method, since a relatively large amount of trials is required for pursuing an optimum solution, and this leads to such a problem as longer convergence time.

On the other hand, in the Related art document 2 of Yukihiro Kamiya et al., "Performance consideration for the ESPAR antenna—Statistical considerations of SINR characteristics based on the random weight search—", Technical Report of IEICE, A-P 2000-175, SANE2000-156, pp. 17–24, published in January, 2001 by the Institute of Electronics, Information and Communication Engineers in Japan (IEICE), the following procedure of "Random Search Method" (hereinafter, referred to as second related art method) is used:

(1) Given a column vector x whose elements are reactance values of respective variable-reactance elements, the column vector x is formed as a reactance matrix. Such a matrix is generated by uniform random numbers within a predetermined range, thereby generating a population of reactance matrices;

(2) Reactance matrices contained in the generated population are loaded to the ESPAR antenna one by one, where samples of received signals are observed in the respective cases, and a predetermined cross correlation coefficient between the received signals and a training sequence signal is calculated;

(3) A reactance matrix that gives the largest cross correlation coefficient among the obtained plurality of cross correlation coefficients is adopted as a weight coefficient.

This second related art method involves only one-time calculation of the cross correlation coefficient for each iteration. However, this method has such a problem that since the succeeding trial is independent of the preceding trial, nothing has been trained when a trial is completed.

SUMMARY OF THE INVENTION

A first object of the present invention is to provide a method for controlling an ESPAR antenna, capable of solving the above problems, that is, a method for controlling an array antenna which does not require any long training sequence signal and which allows the performance to be improved every iteration of search, as compared with the related art methods, for directing the main beam toward a desired wave and directing the null(s) thereof toward an interference wave(s).

Also, a second object of the invention is to provide a method for controlling an ESPAR antenna which has solved the above problems, that is, a method for controlling an array antenna, capable of remarkably reducing the convergence time as compared with that of the related art methods, and capable of achieving adaptive control so as to direct the main beam toward a desired wave and to direct the null(s) thereof toward an interference wave(s), with less calculation amount.

Further, a third object of the invention is to provide a method for controlling an ESPAR antenna capable of solving the above problems, that is, a method for controlling an array antenna, capable of obtaining a successful estimation function value and obtaining a successful convergence value at a higher speed with less iterations, as compared with those of the related art methods, for directing the main beam toward a desired wave and directing the null(s) thereof toward an interference wave(s).

According to the first aspect of the present invention, there is provided a method for controlling an array antenna, the array antenna including:

a radiating element for receiving a radio signal;

a plurality of parasitic elements provided apart from the radiating element by a predetermined distance;

a plurality of variable-reactance elements connected to the plurality of parasitic elements, respectively; and controlling means for changing a directivity characteristic of the array antenna by changing each reactance value set to each of the variable-reactance elements so that each of the parasitic elements operates as either one of a director and a reflector, wherein the method includes a step of iterating the following steps of:

upon setting the reactance values of the respective variable-reactance elements by randomly perturbing the reactance values from predetermined initial values, calculating predetermined cross correlation coefficients between a received signal and a training sequence signal before and after the perturbation, the received signal being obtained by receiving by the array antenna a training sequence signal contained in a radio signal transmitted from a remote transmitter, and the training sequence signal being generated so as to have a signal pattern identical to that of the transmitted training sequence signal;

selecting and setting reactance values when the cross correlation coefficient increases between those before and after the perturbation; and setting reactance values obtained by randomly perturbing the selected reactance values, to the variable-reactance elements, respectively.

Also, according to the second aspect of the present invention, there is provided a method for controlling an array antenna, the array antenna including:

a radiating element for receiving a radio signal;

a plurality of parasitic elements provided apart from the radiating element by a predetermined distance;

a plurality of variable-reactance elements connected to the plurality of parasitic elements, respectively; and controlling means for changing a directivity characteristic of the array antenna by changing each reactance value set to each of the variable-reactance elements so that each of the parasitic elements operates as either one of a director and a reflector, wherein the method includes:

upon dividing a range of each reactance value available for each of the variable-reactance elements, into two ranges thereof and setting representative values of respective divided two ranges to the variable-reactance elements, respectively, a first step of calculating predetermined cross correlation coefficients between a received signal and a training sequence signal before and after the perturbation, the received signal being obtained by receiving by the array antenna a training sequence signal contained in a radio signal transmitted from a remote transmitter, and the training sequence signal being generated so as to have a signal pattern identical to that of the transmitted training sequence signal, and selecting and setting, as initial values, reactance values of the respective variable-reactance elements corresponding to a larger cross correlation coefficient out of the two cross correlation coefficients corresponding to the representative values of the respective divided two ranges; and a second step of dividing a range belonging to the selected reactance values into two ranges thereof, calculating the cross correlation coefficients upon setting of the representative values of the respective divided two ranges to the variable-reactance elements, respectively, and selecting and setting reactance values of the variable-reactance elements corresponding to a larger cross correlation-coefficient out of the two cross correlation coefficients corresponding to the representative values of the respective divided two ranges, thereby controlling a main beam and a null(s) of the array antenna so that the main beam is directed toward a desired wave and the null(s) is directed toward an interference wave(s).

Further, according to the third aspect of the present invention, there is provided a method for controlling an array antenna, the array antenna including:

a radiating element for receiving a radio signal;

a plurality of parasitic elements provided apart from the radiating element by a predetermined distance;

a plurality of variable-reactance elements connected to the plurality of parasitic elements, respectively; and controlling means for changing a directivity characteristic of the array antenna by changing each reactance value set to each of the variable-reactance elements so that each of the parasitic elements operates as either one of a director and a reflector, wherein the method includes a control step of:

perturbing the reactance values of the variable-reactance elements, respectively, by a predetermined step width, sequentially, calculating a predetermined estimation function value for each of the reactance values, setting post-perturbation values to the reactance values when the estimation function values calculated for each of the variable-reactance elements before and after, the perturbation are improved whereas setting pre-perturbation values to the reactance values when the estimation function values calculated before and after the perturbation are not improved, decreasing the step width for a succeeding-iteration process with respect to a reactance value of a variable-reactance element for which the estimation function value is not improved, and further iteratively executing a process of inverting a sign of the step width, thereby calculating and setting reactance values of the variable-reactance elements, respectively, for directing a main beam of the array antenna toward a desired wave and directing a null(s) thereof toward an interference wave(s).

Still further, according to the fourth aspect of the present invention, there is provided a method for controlling an array antenna, the array antenna including:

a radiating element for receiving a radio signal;

a plurality of parasitic elements provided apart from the radiating element by a predetermined distance;

a plurality of variable-reactance elements connected to the plurality of parasitic elements, respectively; and controlling means for changing a directivity characteristic of the array antenna by changing each reactance value set to each of the variable-reactance elements so that each of the parasitic elements operates as either one of a director and a reflector, wherein the method includes the following steps of:

perturbing the reactance values of the variable-reactance elements, respectively, by a predetermined difference width ΔX sequentially, calculating a predetermined estimation function value for each of the reactance values, and based on the calculated estimation function value and by using a steepest gradient method having a step width $\mu$, iteratively calculating reactance values of the variable-reactance elements, respectively, so that the estimation function value becomes either one of the maximum and the minimum; and upon calculating and setting each of the reactance values of the variable-reactance elements for directing a main beam of the array antenna apparatus toward a desired wave and directing a null(s) thereof toward an interference wave(s), decreasing the difference width ΔX and the step width $\mu$ by using a predetermined decreasing function depending either one of on the estimation function value f and on a signal to interference noise ratio SINR calculated from the estimation function f.

Still further, according to the fifth aspect of the present invention, there is provided a method for controlling an array antenna, the array antenna including:

a radiating element for receiving a radio signal;

a plurality of parasitic elements provided apart from the radiating element by a predetermined distance;

a plurality of variable-reactance elements connected to the plurality of parasitic elements, respectively; and controlling means for changing a directivity characteristic of the array antenna by changing each reactance value set to each of the variable-reactance elements so that each of the parasitic elements operates as either one of a director and a reflector, wherein the method includes the following steps of:

calculating a predetermined estimation function value based on the received radio signal, calculating difference reactance values of the variable-reactance elements, respectively, based on the calculated estimation function value by using a Marquardt method having a predetermined Marquardt number, perturbing the reactance values of the respective variable-reactance elements by a predetermined difference reactance value sequentially, and iterating the above steps, thereby calculating and setting optimum solutions of reactance values of the variable-reactance elements for directing a main beam of the array antenna toward a desired wave and directing a null(s) thereof toward an interference wave(s), so that the estimation function value becomes either one of the maximum and the minimum.

BRIEF DESCRIPTION OF THE DRAWINGS

Various objects, features and advantages of the present invention will be apparent from of preferred embodiments thereof as described hereinbelow with reference to the accompanying drawings:

FIG. 28 is a view showing respective elements of an admittance matrix Y in an implemental example of the array antenna apparatus 100 of FIG. 27;

FIG. 45 is a view showing results of comparison among the various adaptive control methods of the steepest gradient method, which is a related art, the higher-dimensional dichotomizing search method according to the second preferred embodiment and the sequential random search method according to the first preferred embodiment, and the variable-step search method according to the third preferred embodiment;

DETAILED DESCRIPTION OF THE PREFERRED EMBODIMENTS

Figure 1:
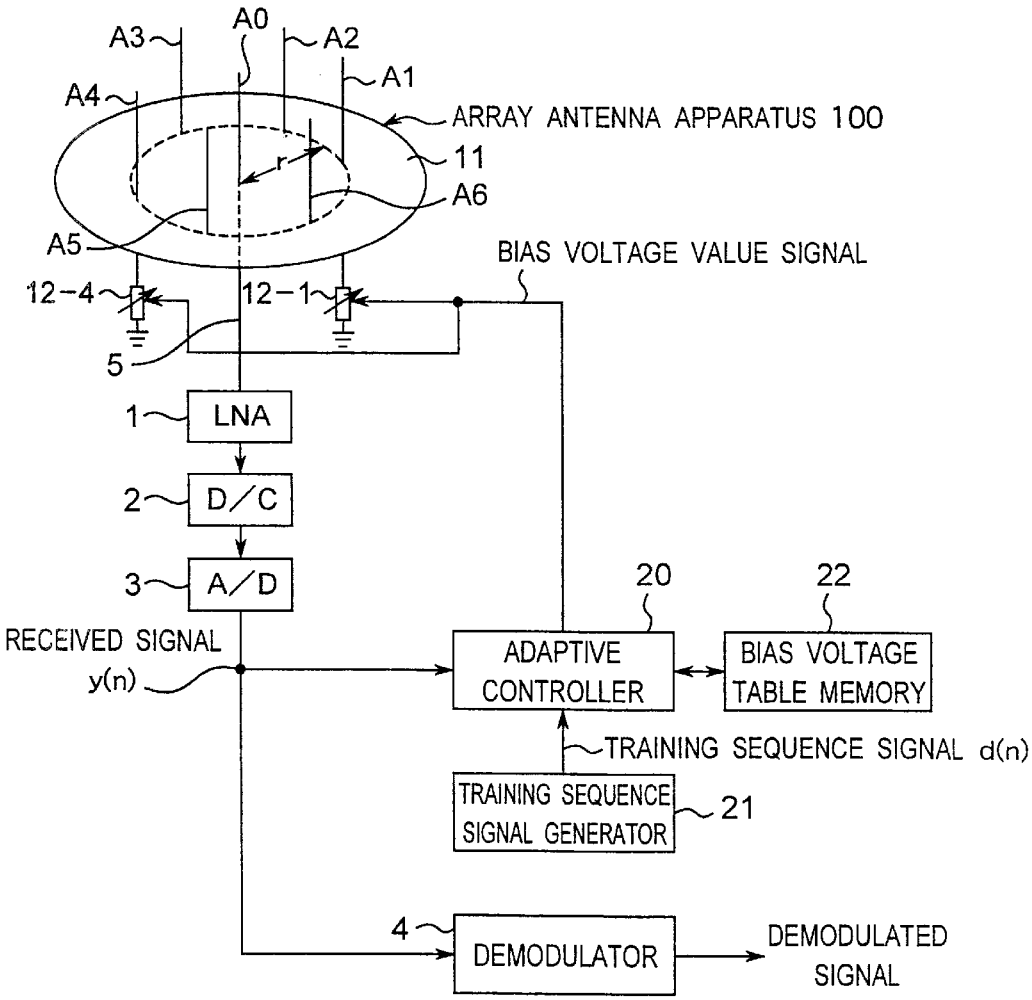
FIG. 1 is a block diagram showing a configuration of an array antenna control apparatus according to a first preferred embodiment of the present invention.

Hereinbelow, preferred embodiments according to the present invention will be described below with reference to the accompanying drawings. It is noted that throughout the drawings, the same or similar constituent components are designated by the same reference numerals, respectively.

FIRST PREFERRED EMBODIMENT

FIG. 1 is a block diagram showing a configuration of an array antenna apparatus according to a first preferred embodiment of the present invention. The array antenna control apparatus of the present preferred embodiment, as shown in FIG. 1, includes: an array antenna apparatus 100, which is an ESPAR antenna and which is equipped with one radiating element A0, six parasitic elements A1 to A6, on which variable-reactance elements 12-1 to 12-6 implemented by, for example, variable-capacitance diodes, are loaded, respectively, and a grounding conductor 11; an adaptive controller 20; a training sequence signal generator 21; and a bias voltage table memory 22 connected to the adaptive controller 20.

In this case, the adaptive controller 20, which is implemented by a computer or the other digital computing machine as an example, is characterized in that, before starting radio communication by a demodulator 4, the adaptive controller 20 performs a later-described adaptive control process based on a received signal y(n), which is obtained by receiving a training sequence signal contained in a radio signal transmitted from a remote transmitter by the radiating element A0 of the array antenna apparatus 100, as well as on a training sequence signal d(n) having a signal pattern identical to that of the above-mentioned training sequence signal and generated by the training sequence signal generator 21, and this leads to search for and set bias voltage values $V_m$(m=1, 2, . . . , 6) which are to be applied to the variable-reactance elements 12-1 to 12-6, respectively, for directing the main beam of the array antenna apparatus 100 toward a desired wave and further directing the null(s) thereof toward an interference wave(s). More specifically, the adaptive controller 20, having a random number generator, iterates the process of randomly perturbing the bias voltage vector V(n) composed of the bias voltage values $V_m$ from predetermined initial values by means of the random vector R(n) generated by the random number generator, then comparing an objective function value J(n) of a cross correlation coefficient corresponding to the bias voltage vector V(n) before the perturbation with an objective function value J(n+1) of a cross correlation coefficient corresponding to the bias voltage vector V(n+1) after the perturbation, selecting and setting the bias voltages $V_m$ corresponding to those when the cross correlation coefficient increases between those before and after the perturbation, and thereafter, randomly perturbing and setting the bias voltages from among the selected bias voltages of the variable-reactance elements 12-1 to 12-6.

Accordingly, by iterating the above-mentioned process of, starting with initial values of bias voltage, generating and perturbing the random vector R(n), selecting and setting the bias voltages $V_m$ corresponding to those when the cross correlation coefficients increases between those before and after the perturbation, and thereafter further generating and perturbing the random vector R(n) from the selected bias voltages, the adaptive controller 20, while sequentially generating the random vector R(n), updates the selected bias voltages to thereby search for the bias voltage vector V(n) of the variable-reactance elements 12-1 to 12-6 for directing the main beam of the array antenna apparatus 100 toward a desired wave and directing the null(s) thereof toward an interference wave(s) so that the objective function value J(n) becomes the maximum, and outputs and sets bias voltage value signals having bias voltage values $V_m$ (m=1, 2, . . . , 6) found out as results of the search to the variable-reactance elements 12-1 to 12-6, respectively.

Referring to FIG. 1, the array antenna apparatus 100 is made up of a radiating element A0 and parasitic elements A1 to A6 provided on a grounding conductor 11, where the radiating element A0 is arranged so as to be surrounded by the six parasitic elements A1 to A6 provided on the circumference of a radius r. Preferably, the parasitic elements A1 to A6 are equidistantly spaced from one another on the circumference of the radius r. Each of the radiating element A0 and the parasitic elements A1 to A6 is so formed as to be a monopole element having a length of, for example, about $\lambda/4$ as compared with the wavelength $\lambda$ of a desired wave, and the radius r is set to be $\lambda/4$. A feeding point of the radiating element A0 is connected to a low-noise amplifier (LNA) 1 via a coaxial cable 5, and the parasitic elements A1 to A6 are connected to the variable-reactance elements 12-1 to 12-6, respectively, where the reactance values of these variable-reactance elements 12-1 to 12-6 are changed by the setting of bias voltage value signals derived from the adaptive controller 20.

Figure 2:
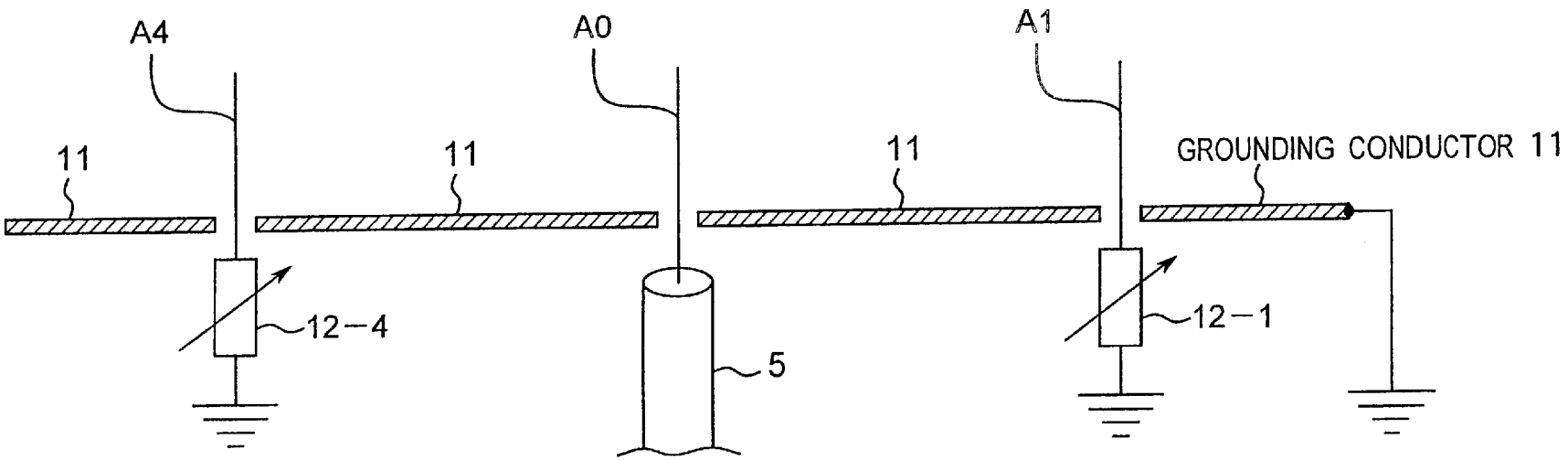
FIG. 2 is a sectional view showing a detailed configuration of an array antenna apparatus 100 of FIG. 1.

FIG. 2 is a longitudinal cross-sectional view of the array antenna apparatus 100. The radiating element A0 is electrically insulated from the grounding conductor 11, and the parasitic elements A1 to A6 are grounded in high frequency bands to the grounding conductor 11 through the variable-reactance elements 12-1 to 12-6. Referring to the operation of the variable-reactance elements 12-1 to 12-6, for example, under such an assumption that the longitudinal length of the radiating element A0 is substantially equal to that of the parasitic elements A1 to A6, for instance when the variable-reactance element 12-1 is inductive (L characteristic), the variable-reactance element 12-1 changes into an extension coil, thus the electric lengths of the parasitic elements A1 to A6 are longer than the electric length of the radiating element A0, and therefore, the variable-reactance element 12-1 operates as a reflector. On the other hand, for instance, when the variable-reactance element 12-1 is capacitive (C characteristic), the variable-reactance element 12-1 changes into a loading capacitor, thus the electric length of the parasitic element A1 is shorter than the electric length of the radiating element A0, and therefore, the parasitic element A1 operates as a wave director. Also, the parasitic element A2 to A6 connected to the other variable-reactance elements 12-2 to 12-6 operates in a manner similar to that of above.

Accordingly, in the array antenna apparatus 100 of FIG. 1, the bias voltage values to be applied to the variable-reactance elements 12-1 to 12-6 connected to the parasitic elements A1 to A6, respectively, are changed so that their junction capacitance values, i.e. reactance values, are changed, thus allowing the directivity on horizontal plane of the array antenna apparatus 100 to be changed.

In the array antenna control apparatus of FIG. 1, the array antenna apparatus 100 receives a radio signal, and the received signal is inputted to the low-noise amplifier (LNA) 1 through the coaxial cable 5. and is thereby amplified, and then, a down converter (D/C) 2 converts the amplified signal into a signal of a predetermined intermediate frequency (IF signal) in a lower band. Further, an A/D converter 3 performs an analog-to-digital conversion to convert the low-band-converted analog signal into a digital signal, and outputs the resulting digital signal to the adaptive controller 20 and the demodulator 4. Next, the adaptive controller 20, as will be detailed later, iterates the process of randomly perturbing the bias voltage vector V(n) composed of the bias voltage values $V_m$ from predetermined initial values by means of the random vector R(n) generated by the random number generator, and then, compares an objective function value J(n) of a cross correlation coefficient corresponding to the bias voltage vector V(n) before the perturbation with an objective function value J(n+1) of a cross correlation coefficient corresponding to the bias voltage vector V(n+1) after the perturbation, selecting and setting the bias voltages $V_m$ corresponding to those when the cross correlation increases between those before and after the perturbation, and thereafter randomly perturbing and setting the bias voltages from among the selected bias voltages of the variable-reactance elements 12-1 to 12-6. Accordingly, by iterating the above-mentioned process of, starting with initial values of bias voltage, generating and perturbing the random vector R(n), selecting and setting the bias voltages $V_m$ corresponding to those when the cross correlation coefficient increases between those before and after the perturbation, and thereafter further generating and perturbing the random vector R(n) from the selected bias voltages, the adaptive controller 20, while sequentially generating the random vector R(n), updates the selected bias voltages, and this leads to search for the bias voltage vector V(n) of the variable-reactance elements 12-1 to 12-6 for directing the main beam of the array antenna apparatus 100 toward a desired wave and directing the null(s) thereof toward an interference wave(s) so that the objective function value J(n) becomes the maximum, and outputs and sets the bias voltage value signals having bias voltage values $V_m$ (m=1, 2, . . . , 6) found out as results of the search to the variable-reactance elements 12-1 to 12-6, respectively. On the other hand, the demodulator 4 performs a demodulation process on an inputted received signal y(n), and outputs a demodulated signal, which is a data signal.

A transmitting station, which transmits a radio signal to be received by the array antenna 100, modulates a carrier signal of radio frequency by using a digital modulation method, such as BPSK, QPSK or the like according to a digital data signal of a predetermined symbol rate containing a training sequence signal identical to a predetermined training sequence signal generated by the training sequence signal generator 21, then amplifies the power of the modulated signal, and transmits the resulting modulated signal toward the array antenna apparatus 100 of a receiving station. In the present preferred embodiment, before data communication is performed, the radio signal containing the training sequence signal is transmitted from the transmitting station toward the receiving station, and the receiving station performs an adaptive control process by the adaptive controller 20.

The phased array antenna of the related art directly controls weight vectors (amplitude and phase) of its respective elements. In contrast to this, in the array antenna apparatus 100 of the ESPAR antenna, there is no weighting circuit, and alternatively, the reactance values of the variable-reactance elements 12-1 to 12-6 loaded on the parasitic elements A1 to A6 are controlled. Therefore, a concept of "equivalent weight vector", which is equivalent to the weight vector of the related art, is introduced, and it is associated with reactance values. The array antenna apparatus 100 is essentially different from the phased array antenna of the related art at the following points:

(1) an output circuit of a received signal is constituted by one system;

(2) inter-element couplings are utilized more aggressively; and (3) the radiating element and the variable-reactance elements are integrated.

These are the essence of operation for the array antenna apparatus 100, and have to be considered at the stage of antenna design and the stage of control theory construction.

Now a received signal y(t) outputted from the array antenna apparatus 100, which is implemented by the ESPAR antenna, is formulated as a function of respective reactance values ($x_1$, . . . , $x_6$) of the parasitic elements A1 to A6. Whereas a time variable t will be used in the description of formulation, an iteration function parameter n corresponding to the time or timing for executing digital processing using recurrence formulae will be used in the description of a later-described control process of the adaptive controller 20. The formation of a variable beam in the array antenna apparatus 100 is executed by controlling the bias voltage values $V_m$ (m=1, 2, . . . , 6) for the variable-reactance elements 12-1 to 12-6, respectively, and this leads to control of their reactance values.

It is assumed that there are present totally Q+1 signal sources that transmit signals $u_q(t)$ each having a DOA (Direction Of Arrival) of an angle $\theta_q$ (q=0, 1, . . . , Q), where the direction along which the parasitic element A1 is positioned with respect to the radiating element A0 is taken as a reference axis. It is also assumed that $s_m(t)$ (m=0, 1, . . . , 6) represents an RF signal which is incoming on the m-th element Am (i.e., radiating element or parasitic element) of the antenna, and that a signal vector s(t) is a column vector having the RF signal $s_m(t)$ as its m-th component. In this case, the signal vector s(t) can be represented by the following equation:

$$s(t) = \sum_{q=0}^{Q} a(\theta_q)u_q(t) \quad (1),$$

where $a(\theta_q)$ is a steering vector defined by the following equation:

$$a(\theta_q) = \begin{bmatrix} 1 \\ e^{j\frac{2\pi}{\lambda}r\cos(\theta_q-\phi_1)} \\ e^{j\frac{2\pi}{\lambda}r\cos(\theta_q-\phi_2)} \\ \vdots \\ e^{j\frac{2\pi}{\lambda}r\cos(\theta_q-\phi_6)} \end{bmatrix} \quad (2),$$

where r is the element array radius of the array antenna apparatus 100, and $\phi_m$ represents an angle at which each parasitic element Am is positioned with respect to the radiating element A0, it being that $\phi_m=2\Pi(m-1)/6$ (m=1, . . . , 6). The received signal y(t) that is an RF output signal of a single port of the array antenna apparatus 100 (in the following description of principle, the received signal y(t) is referred to as an RF signal at the preceding stage of LNA 1 for explanation's sake) is given by the following equation:

$$y(t)=i^T s(t)+n(t) \quad (3),$$

where $i=[i_0, i_1, i_2, \ldots, i_M]^T$ is an RF current vector having, as components, RF currents $i_m$ (m=0, . . . , 6) that appear on the radiating element A0 and the parasitic elements A1 to A6, respectively, and n(t) represents additional white Gaussian random noise in the array antenna apparatus 100.

According to an analysis of the ESPAR antenna disclosed in the first related art method, the RF current vector "i" is formulated as follows:

$$i=v_s(I+YX)^{-1}y_y^{\,0} \quad (4),$$

where I is a (6+1)-th order unit matrix and $v_s$ is a constant gain coefficient. Also, in the Equation (4), a diagonal matrix X=diag[50, $jx_1$, $jx_2$, . . . , $jx_6$] containing, as its components, reactance values $x_m$ (m=1, . . . , 6) for the variable-reactance elements 12-1 to 12-6 is called a reactance matrix. The reactance values $x_m$ are of a function of the bias voltages $V_m$ for the variable-reactance elements 12-1 to 12-6. Further, in the Equation (4), $Y=[y_{k1}]_{(6+1)\times(6+1)}$ is called admittance matrix, where $y_{k1}$ represents a mutual admittance between an antenna element Ak and an antenna element A1 (0<k, 1<6). Also, the vector $y_0$ is the first column of the admittance matrix Y. For the value of the mutual admittance $y_{k1}$, an equation of $y_{k1}=y_{1k}$ holds by a known reciprocal theorem, in a manner similar to that of the case with array antenna apparatus of ordinary type. Also, the values of the mutual admittance $y_{k1}$ is a constant depending on the physical structure of the antenna such as the radius, the spatial distance and the length of the elements, and moreover satisfy the following relationships from the rotational symmetry of the array antenna apparatus 100:

$$y_{11}=y_{22}=y_{33}=y_{44}=y_{55}=y_{66} \quad (5),$$

$$y_{01}=y_{02}=y_{03}=y_{04}=y_{05}=y_{06} \quad (6),$$

$$y_{12}=y_{23}=y_{34}=y_{45}=y_{56}=y_{61} \quad (7),$$

$$y_{13}=y_{24}=y_{35}=y_{46}=y_{51}=y_{62} \quad (8), \text{ and}$$

$$y_{14}=y_{25}=y_{36} \quad (9).$$

Therefore, it can be understood that the admittance matrix Y is determined only by six components of the mutual admittances, $y_{00}$, $y_{10}$ $y_{11}$, $y_{21}$, $y_{31}$ and $y_{41}$, and that the vector $y_0$ is determined only by two components of the mutual admittances, $y_{00}$ and $y_{10}$.

From the Equations (3) and (4), each of the RF current vector i and the received signal y(t) is of function of the reactance values ($x_1$, . . . , $x_6$), and therefore, it can be understood that the received signal y(t) is of a function of the bias voltage values to be applied to the variable-reactance elements 12-1 to 12-6, respectively. Accordingly, in the method for controlling an array antenna according to the present preferred embodiment, a directivity pattern of the array antenna apparatus 100 is formed by changing the respective bias voltage values.

According to an experiment which the present inventors performed, the applied bias voltages for the variable-reactance elements 12-1 to 12-6 are set within a range from −0.5 V to 20 V. Actually, a D/A (digital-to-analog) converter is used to set the bias voltages. The D/A converter can handle digital data encoded in 12 bits and digital values of −2048 to 2047. In order to simplify the notation, the present inventors is referred to as an encoded value of bias voltage as a digital voltage. It is noted that as described before, the reactance values $x_m$ are a function of the bias voltages $V_m$. In the present inventors' experiment, it is assumed that $$x_m=-0.0217V_m-49.21 \quad (10),$$

where $V_m$ is a value of digital voltage.

Next, consideration is given about the method for controlling the array antenna apparatus formulated as shown above. As can be seen from the above discussions, it is difficult to apply conventional control methods such as LMS algorithm to ESPAR antennas. The principal reason of this lies in a simple structure of the ESPAR that the antenna has a single output signal y(t) alone. Although a received signal y(t) received by the single port is observed, no signals in the surrounding parasitic elements A1 to A6 can be observed. Accordingly, it is necessary to develop a special adaptive controlling method for the ESPAR antenna.

In the second related art method, the random search method for directivity patterns of the ESPAR antenna has been proposed. Let us assume that $V=[V_1, V_2, \ldots, V_M]$ are the M-th order bias voltage vector whose components are bias voltages for the reactance values $x_m$ (m=1, 2, . . . , M), respectively. It is noted that the reactance values $x_m$ in the Equation (4) are of a function of the bias voltage values $V_m$. This function depends on an implemental circuit associated with the reactance values. Given that the number of iterations of search is "n", a series of bias voltage vector $V(n)=[V_1(n), \ldots, V_M(n)]$ is generated according to the following equation:

$$V(n)=R(n);\ (n=1, 2, \ldots, N) \quad (11).$$

In this case, $R(n)=[R_1(n), \ldots, R_M(n)]$ represents the random vector composed of voltage values which are selected by the random number generator so as to be distributed uniformly in a range of bias voltages for the respective variable-reactance elements 12-1 to 12-6. The index "n" denotes the number of iterations. The values of the bias voltage vector V(n) were fed to a loaded terminal, and the received signal y(n) (a sample by the n-th iteration for the received signals y(t)), which is an output signal from the receiver, was measured, and then the objective function value J(n)=J(V(n)) was calculated. At the end of the random search phase, the present inventors found out values for the bias voltage vector V(n) at which the objective function value J(n) becomes the maximum.

This method called "(pure) random search method" has such a drawback that nothing is learned at the timing when the trial is terminated at a step n. The next trial at the next step n+1 is independent of the above-mentioned trial. In this case, no considerations are given to the property of local continuity of a curved surface of an objective function such as the "steepest gradient method" according to the first related art method. Due to this, the more efficient "successive" random search method is employed in the present preferred embodiment.

Also in the sequential random search method proposed in the present preferred embodiment, the bias voltage vector V(n) is randomly changed. Before and after the change, the objective function value J(n) (e.g., the cross correlation coefficient between received signal y(n) and training sequence signal d(n)) is calculated, and two calculated values are compared with each other. If the change makes the objective function value J(n) increase, this change is accepted. If not, the change is rejected, and another random change is attempted. This procedure can algebraically be described as follows:

$$V(n+1)=V(n)+(1/2)\times\{1+sgn[J(V(n)+R(n))-J(V(n))]\}R(n);\ \text{for } n=1, 2, \ldots, N-1 \quad (12),$$

where R(n) denotes random M-th order vectors (M=6 in the present preferred embodiment), and J(V(n)) denotes an estimation value for the objective function value based on P samples of y(t) of the Equation (3) (i.e., a cross correlation coefficient between a sample y(n) of the received signal y(t) and the training sequence signal d(n)) under the condition that the bias voltage vector is set to V(n), and J(V(n)+R(n)) is an estimation value of the objective function value based on P samples of y(t) under the condition that the bias voltage vector is set to V(n)+R(n). Also, the sign operator sgn[z] is +1 when $z \geqq 0$, and is −1 when $z<0$.

Figure 3:
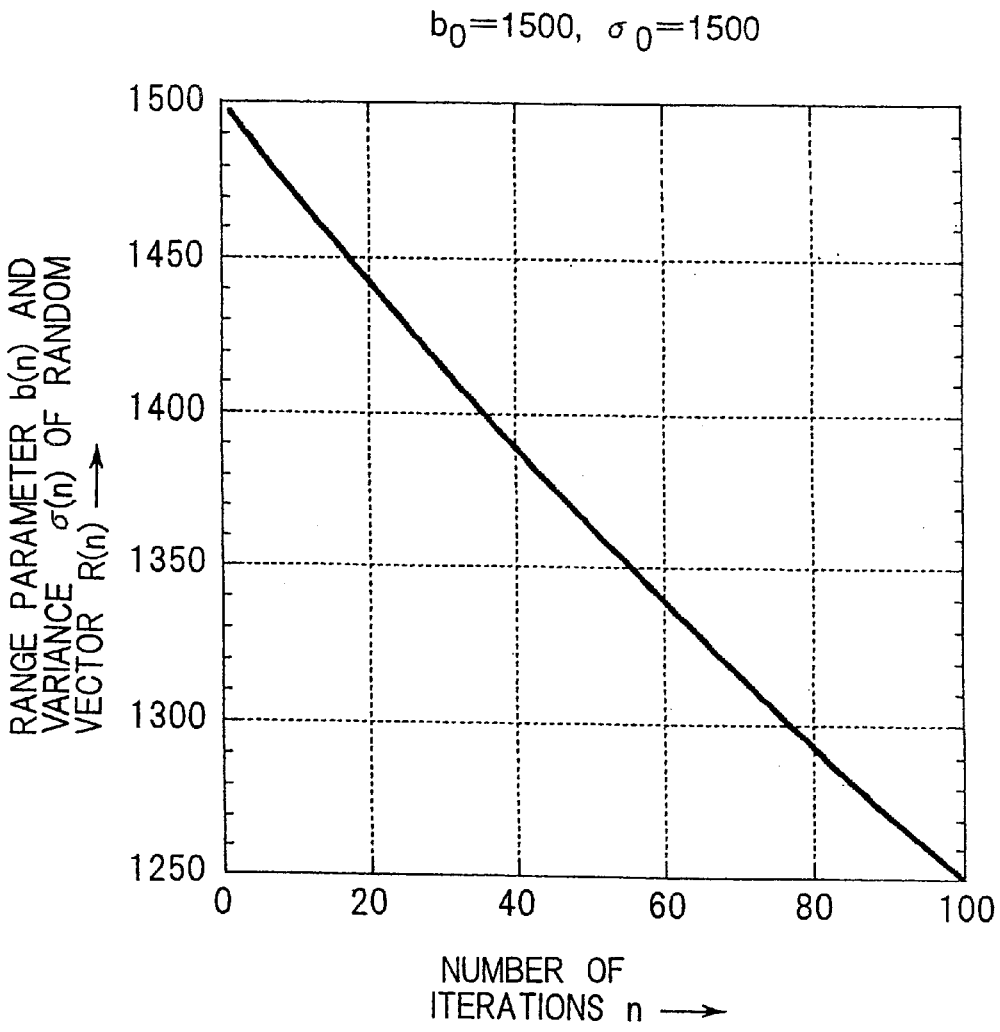
FIG. 3 is a graph showing a range parameter b(n) and a variance σ(n) of a random vector R(n) generated by an adaptive controller 20 of FIG. 1.

Respective components of the random vector R(n) in the Equation (12) can be selected from (i) random variables uniformly distributed in a range from "−b" to "b", and (ii) a Gaussian sequence having a zero mean and a variance "σ". It is noted here that "b" and "σ" are each positive. The values of "b" and "σ" may be constant. However, it is considered more proper that the range of uniform distribution and the variance of the Gaussian distribution are decreased during the iteration procedure of the Equation (12). Accordingly, as an alternative example, the following equations are used as a range parameter b(n) and a variance σ(n), both of which change according to the number of iterations parameter "n":

$$b(n)=\frac{b_0}{(1+n/(\tau N))} \text{ and} \quad (13),$$

$$\sigma(n)=\frac{\sigma_0}{(1+n/(\tau N))} \quad (14),$$

where the range-parameter coefficient $b_0$, the variance coefficient $\sigma_0$, the step parameter τ, and the number of iterations parameter n are each positive constant values. With the use of the Equations (13) and (14), values of the range parameter b(n) and the variance σ(n) decrease with increasing number of iterations, as shown in FIG. 3. It is noted that the value of 1500 set as the range-parameter coefficient $b_0$ and the variance coefficient $\sigma_0$ is expressed in a form of the digital voltage.

Figures 4A, 4B:
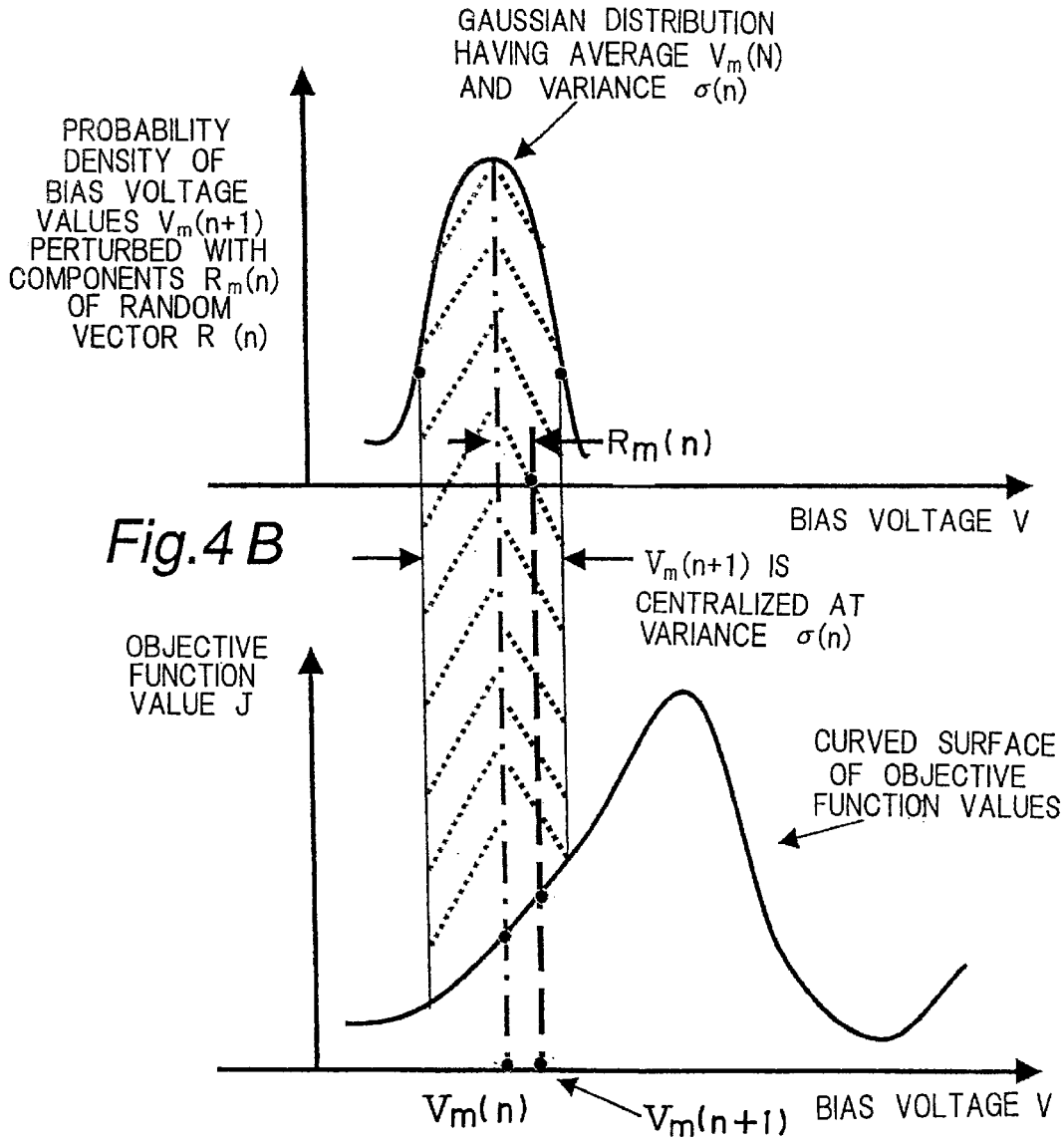
FIG. 4A is a graph showing a probability density of a random vector R(n) with which a bias voltage vector V(n) of FIG. 1 is perturbed.
FIG. 4B is a graph showing a change in an objective function value J caused by the perturbation.

FIGS. 4A and 4B show graphs showing perturbation of the bias voltage vector V(n) by the random vector R(n) generated by the adaptive controller 20. In FIGS. 4A and 4B and in their description, the bias voltage of the horizontal axis in FIGS. 4A and 4B is expressed not in a form of vector but in a form of first-order component element. FIG. 4A is a graph showing a probability density of the random vector R(n) with which the bias voltage vector V(n) is perturbed. FIG. 4B is a graph showing a change in the objective function value J due to the perturbation. When a bias voltage value $V_m(n)$ of a component of the bias voltage vector V(n) is applied to a variable-reactance element 12-m, the adaptive controller 20 randomly selects a bias voltage value $V_m(n+1)$ from the bias voltage values which are Gaussian distributed with an average $V_m(n)$ and a variance σ(n) (FIG. 4A). In other words, it is the bias voltage value $V_m(n+1)$ which is obtained by perturbing the bias voltage value $V_m(n)$ by only a component $R_m(n)$ of the random vector randomly selected from among the bias voltages Gaussian distributed with the average "zero" and the variance σ(n). Bias voltage values that are candidates for selection as the perturbed bias voltage value $V_m(n+1)$ are centralized with the variance σ(n) around the pre-perturbation bias voltage value $V_m(n)$.

As shown in FIG. 4B, if the objective function value $J(n)=J(V_m(n))$ based on the bias voltage value $V_m(n)$ (i.e., the objective function value J(n) resulting from outputting and setting the bias voltage vector V(n) containing the bias voltage value $V_m(n)$ to the variable-reactance elements 12-1 to 12-6) is larger than the objective function value $J(R_m(n)+V_m(n))$ based on the bias voltage value $R_m(n)+V_m(n)$, then $V_m(n+1)=R_m(n)+V_m(n)$ is accepted as a new bias voltage value. Unlike the case of FIG. 4B, if the objective function value $J(R_m(n)+V_m(n))$ is smaller than the objective function value J(n), perturbation by the random-vector component $R_m(n)$ is rejected, and a trial is made for selecting another bias voltage value again randomly from among the bias voltage values Gaussian distributed with the average $V_m(n)$ and the variance $\sigma(n)$.

For the iteration of the Equation (12), in the present preferred embodiment, the cross correlation coefficient between received signal y(n) and training sequence signal d(n) is adopted as the objective function J(n). Hereinbelow, it is assumed that d(n) denotes a P-th order column vector of the training sequence signal, and that y(n) denotes a P-th order column vector composed of discrete time samples of the received signal y(t) in the Equation (3). The cross correlation coefficient $J(n)=\rho(n)$ between received signal y(n) and training sequence signal d(n) at the timing (i.e., number of iterations) n is defined as follows:

$$\rho(n) = \frac{|y^H(n)d(n)|}{\sqrt{y^H(n)y(n)}\sqrt{d^H(n)d(n)}} \quad (15),$$

where the superscript "H" denotes complex conjugate transposition. It is to be noted that the received signal y(n), which is outputted from the radiating element A0 that is the single port of the array antenna apparatus 100, is a higher-order nonlinear function of the adjustable reactance value $x_m$.

Next, an application control process for the ESPAR antenna, which is executed by the adaptive controller 20 and which is by the above-described sequential random search method, will be described with reference to FIGS. 5 and 6.

Figure 5:
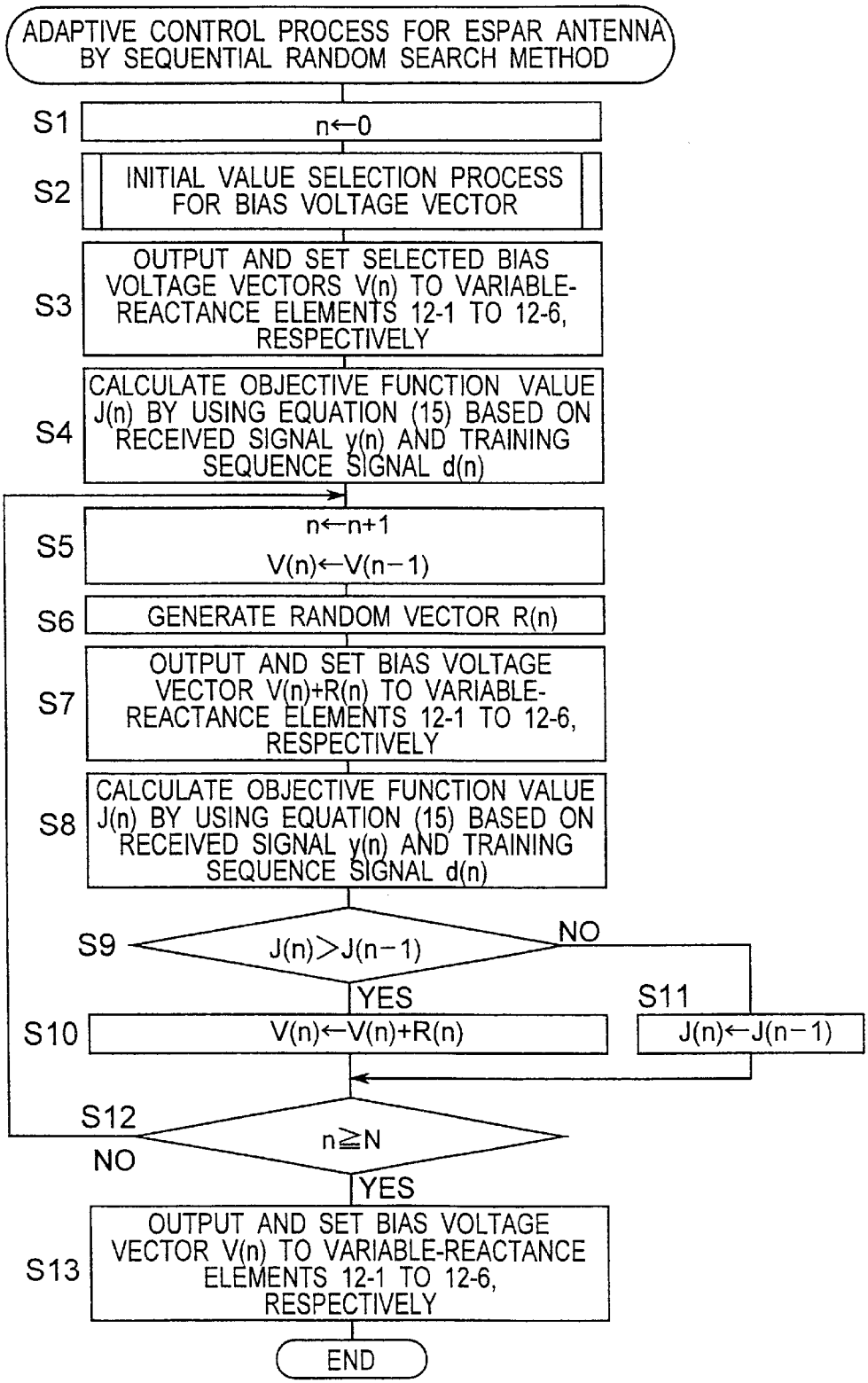
FIG. 5 is a flowchart showing an adaptive control process for an ESPAR antenna by a sequential random search method, which is be executed by an adaptive controller 20 of FIG. 1.

At step S1 of FIG. 5, the number of iterations parameter n for search is initialized to zero. Next, at step S2, an initial value of the bias voltage vector to be applied to the variable-reactance elements 12-1 to 12-6 is selected. At step S3, the selected initial value V(0) for the bias voltage vector V(n) is outputted and set to the variable-reactance elements 12-1 to 12-6. In such a state that the bias voltage vector V(0) is set, at step S4, a received signal y(n) outputted from the array antenna apparatus 100 is measured, and based on this signal and a training sequence signal d(n) generated from the training sequence signal generator 21, the objective function value J(n), which is a cross correlation coefficient, is calculated by using the Equation (15).

At step S5, the number of iterations parameter n is incremented by one, and further the bias voltage vector V(n) is updated by a value of V(n−1). At step S6, the random vector R(n) is generated by using the random number generator provided in the adaptive controller 20. In this case, generation of the random vector R(n) may be limited to the range of the uniform distribution or Gaussian distribution rendered by using the Equation (13) or the Equation (14) as described before. Next, a bias voltage vector V(n)+R(n) is outputted and set to the variable-reactance elements 12-1 to 12-6. In such a state that the bias voltage vector V(n)+R(n) has been set, at step S8, the received signal y(n) is measured, and based on this signal and the training sequence signal d(n), the objective function value J(n), which is a cross correlation coefficient, is calculated by using the Equation (15).

Next, at step S9, if the objective function value J(n) calculated at step S8 is larger than the objective function value J(n−1) calculated before, then the bias voltage vector V(n) is updated at step S10 by the value of the bias voltage vector V(n)+R(n) perturbed with the random vector R(n), then the control flow goes to step S12. If the answer at step S9 is NO (i.e., $J(n) \leqq J(n-1)$), then the bias voltage vector V(n) is not updated and the objective function value J(n) is updated with the value of the objective function value J(n−1) at step S11, then the control flow goes to step S12. Accordingly, if the bias voltage vector V(n) is not updated in the n-th search, then results of the (n+1)-th search (i.e., the bias voltage vector V(n+1) and their objective function values J(n+1)) can be estimated in the (n+1)-th search based on the bias voltage vector V(n−1) and their objective function values J(n−1).

At step S12, if the number of iterations parameter n is below a predetermined threshold (upper-limit value of the number of iterations) N, then the control flow returns to step S5. On the other hand, if the number of iterations parameter n is not less than the threshold N, the bias voltage vector V(n) are outputted and set to the variable-reactance elements 12-1 to 12-6 at step S13, then the adaptive control process is ended.

As described above, with the method for controlling an array antenna by the sequential random search method according to the present preferred embodiment, the control process can be fulfilled by using the property of local continuity of the curved surface of the objective function J(n) so that the objective function values J(n) are increased by referencing (training) preceding results at every step of iteration, thus making it possible, at least, to prevent the objective function value J(n) from decreasing, unlike the "pure" random search method.

Figure 6:
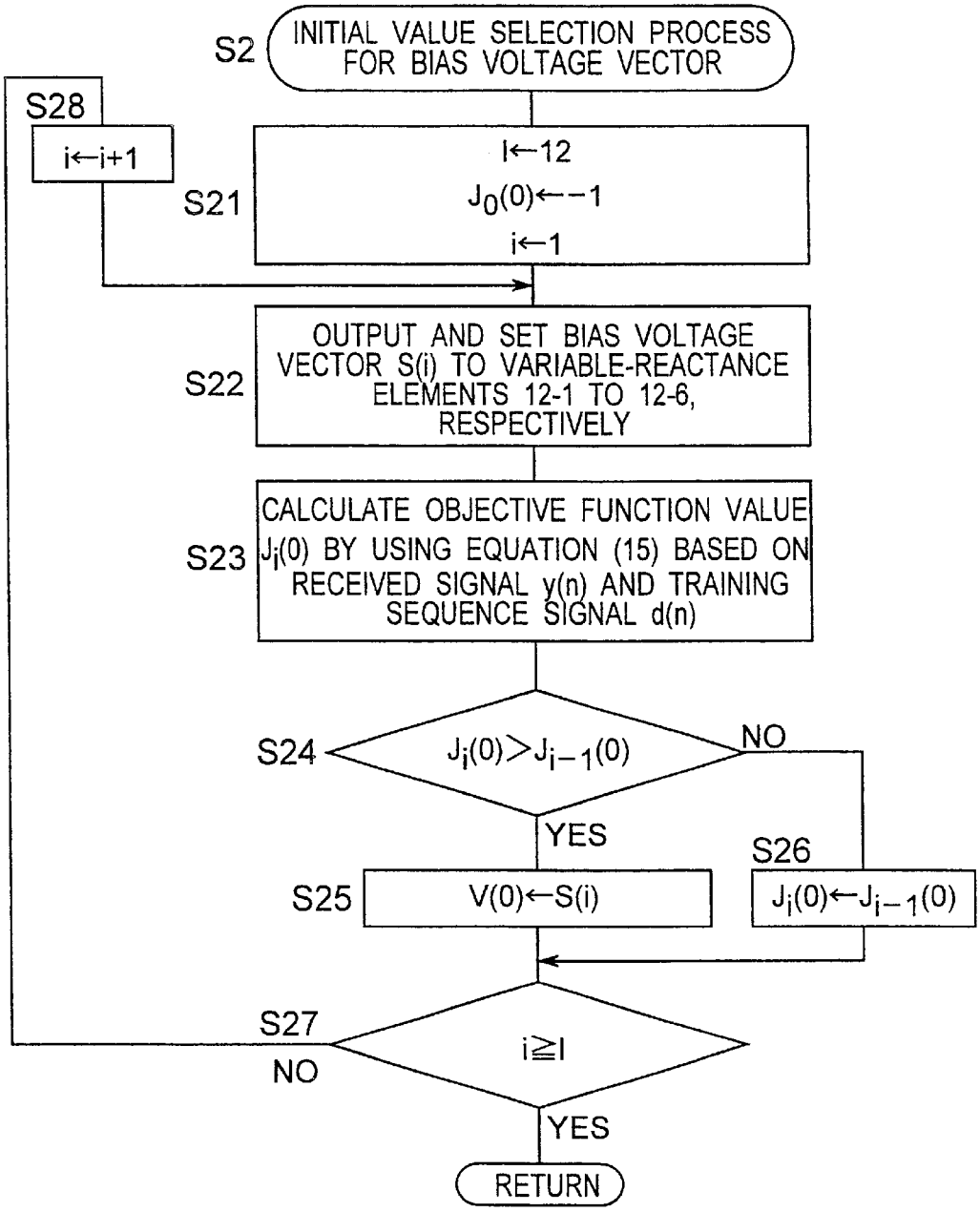
FIG. 6 is a flowchart showing an initial value selection process (step S2) for a bias voltage vector, which is a subroutine of FIG. 5.

A subroutine of the bias-voltage initial value selection process of the step S2 of FIG. 5 is shown in FIG. 6.

Referring to FIG. 6, first of all, at step S21, the number I of bias voltage vector that is a candidate for selection is set to 12, an initial value $J_0$(0) of the objective function value is set to −1, and the number of iterations parameter i ($1 \leqq i \leqq I$) is initialized to one. In the present preferred embodiment, 12 bias voltage vectors S(i) (i=1, 2, . . . , 12) shown in the following table preliminarily stored in the bias voltage table memory 22 are used as the candidates for the initial value to be selected, where these bias voltage values are expressed in a form of digital voltage as mentioned before.

TABLE 1

| Initial-value voltage vectors S(i) |
|---|
| S(1) = {1800, −1800, −1800, −1800, −1800, −1800} |
| S(2) = {1800, 1800, −1800, −1800, −1800, −1800} |
| S(3) = {−1800, 1800, −1800, −1800, −1800, −1800} |
| S(4) = {−1800, 1800, 1800, −1800, −1800, −1800} |
| S(5) = {−1800, −1800, 1800, −1800, −1800, −1800} |
| S(6) = {−1800, −1800, 1800, 1800, −1800, −1800} |
| S(7) = {−1800, −1800, −1800, 1800, −1800, −1800} |
| S(8) = {−1800, −1800, −1800, 1800, 1800, −1800} |
| S(9) = {−1800, −1800, −1800, −1800, 1800, −1800} |
| S(10) = {−1800, −1800, −1800, −1800, 1800, 1800} |
| S(11) = {−1800, −1800, −1800, −1800, −1800, 1800} |
| S(12) = {1800, −1800, −1800, −1800, −1800, 1800} |

In this case, when the bias voltage vector S(1) is set to the variable-reactance elements 12-1 to 12-6 corresponding to the parasitic elements A1 to A6, the main beam of the array antenna apparatus 100 is set so as to be directed toward an azimuth of 0° (a direction directed from radiating element A0 to parasitic element A1). Similarly, when the respective bias voltage vectors S(2) to S(12) are set to the variable-reactance elements 12-1 to 12-6 corresponding to the parasitic elements A1 to A6, the main beam of the array antenna apparatus 100 is set so as to be directed toward azimuths of 30°, 60°, 90°, 120°, 150°, 180°, 210°, 240°, 270°, 300° and 330°, respectively. That is, applying the bias voltage vectors S(1), S(3), S(5), S(7), S(9) and S(11) results in formation of six sector beam patterns having their maximum gains in directions directed from the radiating element A0 toward the parasitic elements A1 to A6, respectively. Moreover, applying the bias voltage vectors S(2), S(4), S(6), S(8), S(10) and S(12) results in formation of six sector beam patterns having their maximum gains in directions directed from the radiating element A0 toward respective intermediate positions between mutually adjacent parasitic elements (A1 and A2, A2 and A3, A3 and A4, A4 and A5, A5 and A6, A6 and A1), respectively.

At step S22, the bias voltage vector S(i) is outputted and set to the variable-reactance elements 12-1 to 12-6. In such a state that the bias voltage vectors S(i) is set, at step S23, the received signal y(n) is measured, and based on this signal and the training sequence signal d(n), an objective function value $J_i(\mathbf{0})$ of a cross correlation coefficient is calculated by using the Equation (15). At step S24, if the objective function value $J_i(\mathbf{0})$ calculated at step S23 is larger than the objective function value $J_{i-1}(\mathbf{0})$ calculated before, then the bias voltage vector V(0) is updated at step S25 with the values of the bias voltage vectors S(i), then the control flow goes to step S27. If the answer at step S24 is NO (i.e., $J_i(\mathbf{0}) \leqq J_{i-1}(\mathbf{0})$), then the bias voltage vector V(0) is not updated and the objective function value $J_i(\mathbf{0})$ is updated with the value of the objective function value $J_{i-1}(\mathbf{0})$ at step S26, then the control flow goes to step S27. Accordingly, if the bias voltage vector V(0) is not updated at the i-th selection, then results of the (i+1)-th selection can be estimated at the next (i+1)-th selection based on the bias voltage vector V(0) and their objective function values $J_i(i-1)$ at the (i−1)-th timing. At step S27, when the initial value selection has been executed with respect to all the candidates S(i) for the bias voltage vector (i.e., when the number of iterations i has reached 12), the final bias voltage vector V(0) is selected as the initial value, the control flow returns to step S3 of FIG. 5. Otherwise, the number of iterations i is incremented by one, then the control flow returns to step S22.

For implementation of the initial-value selection process for the bias voltage vector, in addition to the selection from a plurality of preliminarily stored bias voltage vectors in a manner similar to that of the above case, there are the other cases such as using omnidirectional vectors (e.g., V(0)={0, 0,0,0,0,0}) or using the random vector or by the other means. In the experiment the present inventors performed, the random vector was used as the initial values. However, in the case where the initial-value selection process for bias voltage vector described with reference to FIG. 6, since the beam directivity can be set so as to be generally coincident with the direction of arrival of a desired wave, subsequently executing the sequential random search makes it expectable to obtain more successful results to be obtained, as compared with the case where the omnidirectional vector or the random vector are used as the initial values.

The present inventors performed a simulation of the array antenna control apparatus of FIG. 1. Results of that are described below. With reference to the experiment results, an SINR gain (dB0) of the ESPAR antenna controlled based on the sequential random search method described hereinabove is estimated. In this case, the SINR (Signal to Interference Noise Ratio) gain is expressed as a difference between output SINR and input SIR (Signal to Interference Ratio), and dBo means an SINR gain which is obtained by an adaptive antenna, as compared with an omnidirectional antenna. The present inventors' experiment was performed with respect to a signal model of the Equation (3), then the gain coefficient $v_s$ of the Equation (4) was selected as $v_s$=100. (Q+1) source signals are generated in a BPSK (binary phase-shift keying) mode. As the size of a data block for calculating respective objective function values J, which are cross correlation coefficients as defined by the Equation (15), P=100 is adopted. The number of iterations of blocks is N=100.

In most part of the experiment performed by the present inventors, applied bias voltages of the variable-reactance elements 12-1 to 12-6 are set in a range from −0.5 V to 20 V, and bias voltages are subjected to digital-to-analog conversion in 12 bits and expressed as digital values (digital voltages) $V_m$(m=1, . . . , 6) from −2048 to 2047 as described before. In the present inventors' experiment, the reactance values $x_m$ range from −93.6Ω to −4.8Ω in correspondence to the Equation (10).

The statistical analysis performed by the present inventors adopts the complements of values of a cumulative distribution function (CDF) of SINR gain. A complement of a CDF value shows a probability when the SINR gain Z exceeds a given real number z:

$$Pr(Z \geqq z) = 1 - Pr(Z < z) \quad (16).$$

In these calculations of complements of CDF values, a desired wave signal is fixed so as to be incoming at an angle of 15°, and the DOAs (Directions Of Arrival) of Q=3 interference signals are set so as to be uniformly at random in a range from 0° to 359°. The input SIR is assumed to be −4.77 dB (i.e., the power of each signal is one). For these statistics, the total of 1000 sets of DOAs are used. Random vectors are used as the initial value of bias voltage vector to be applied to the variable-reactance elements 12-1 to 12-6.

Figure 7:
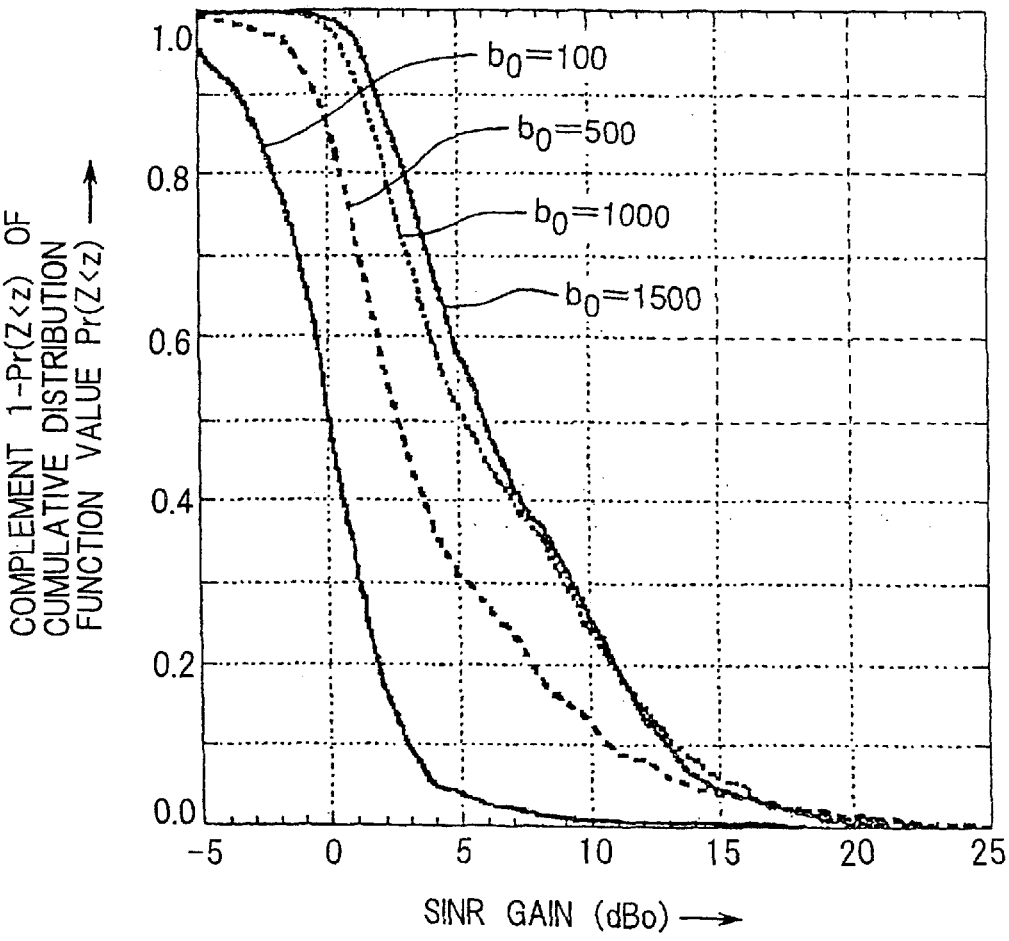
FIG. 7 is a graph showing simulation results of the array antenna apparatus 100 of FIG. 1 and showing a complement 1−Pr(Z<z) of a cumulative distribution function value Pr(Z<z) versus an SINR gain with the use of a uniformly distributed random vector R(n)
Figure 8:
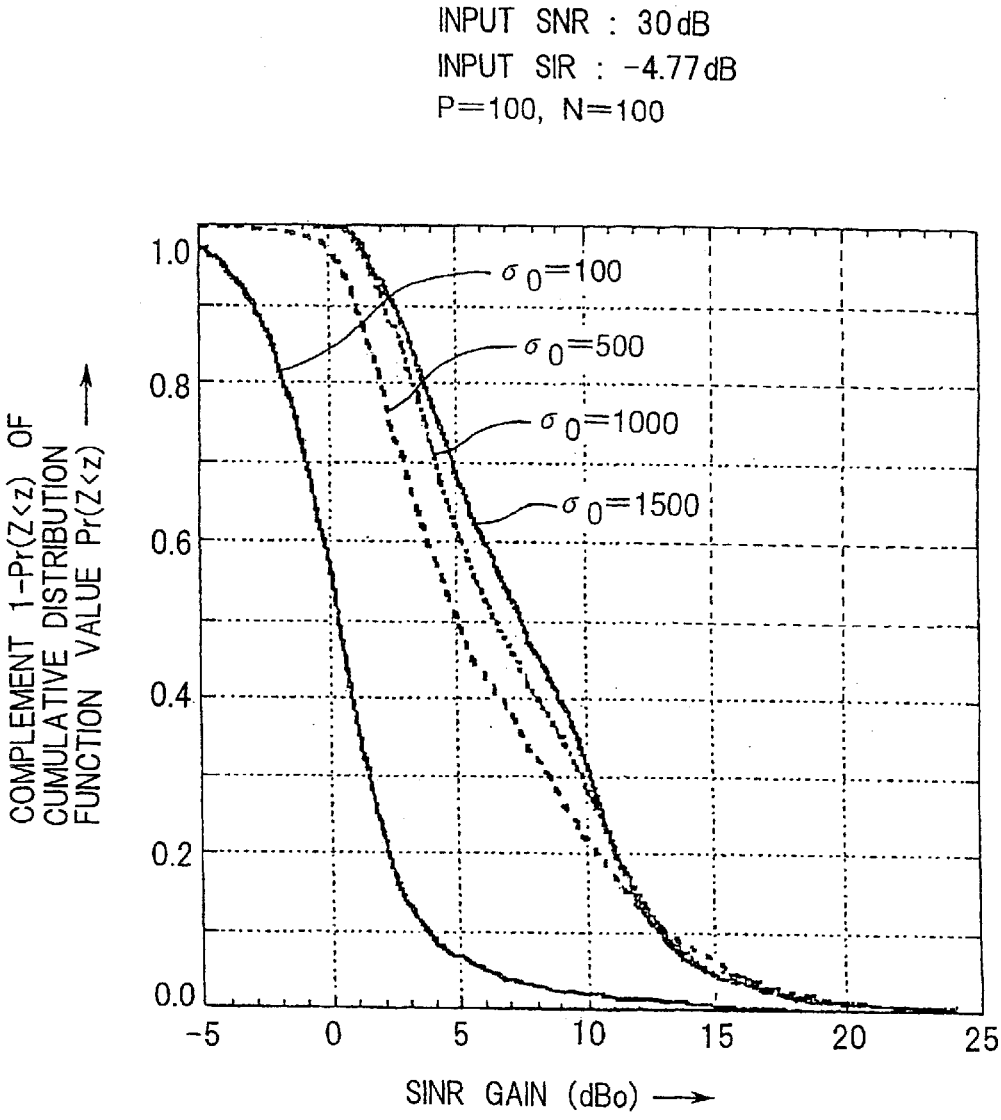
FIG. 8 is a graph showing simulation results of the array antenna apparatus 100 of FIG. 1 and showing a complement 1−Pr(Z<z) of a cumulative distribution function value Pr(Z<z) versus an SINR gain with the use of a Gaussian distributed random vector R(n)

As described above, the random vector R(n) in the Equation (12) belongs to a "uniform" random distribution or "Gaussian" distribution. FIG. 7 is a graph showing a statistical performance of SINR gain of the ESPAR antenna when the random vector R(n) is a uniform random vector having a distribution range of [−b(n), b(n)] based on different coefficients $b_0$. Hereinbelow, the value of the step parameter τ of the Equation (12) is normally set to 5 except for the experiment of FIG. 11. When the set value of the range-parameter coefficient $b_0$ is increased from 100 to 1500, the statistical performance is improved and the tendency of improvement moves toward a saturation state. Referring to the graph of FIG. 8, even if a "Gaussian" random vector R(n) having a variance σ(n) based on a different coefficient $\sigma_0$ are used, a phenomenon similar to that of FIG. 7 in terms of the statistical performance of SINR gain of the ESPAR antenna can be observed. The curve with a variance coefficient $\sigma_0$=1500 means that the ESPAR antenna can provide an SINR gain of at least 5 dB0 with a possibility of 70%.

Figure 9:
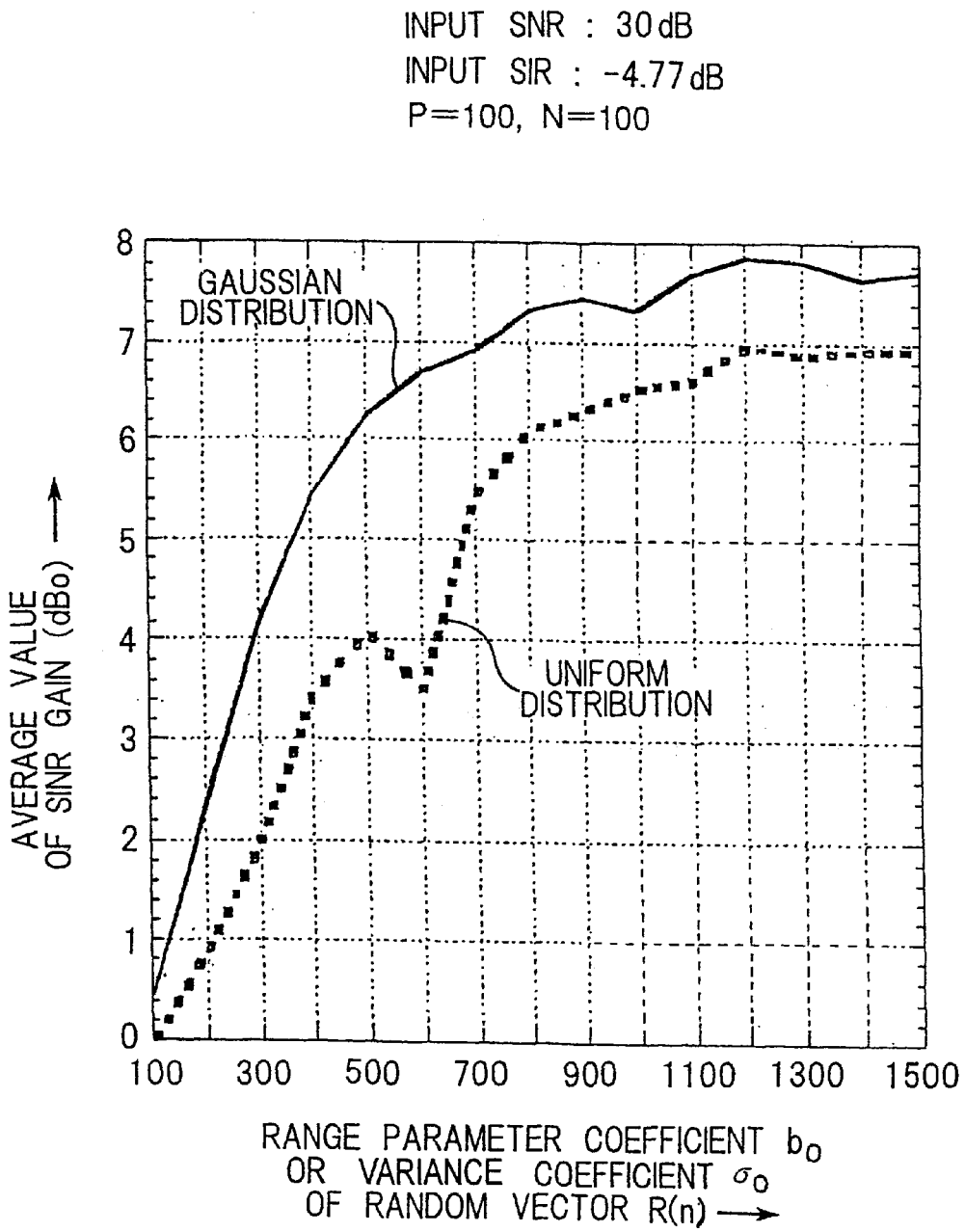
FIG. 9 is a graph showing simulation results of the array antenna apparatus 100 of FIG. 1 and showing a comparison of the average value of SINR gains between the case with the use of the uniformly distributed random vector R(n) and the case with the use of the Gaussian distributed random vector R(n)
Figure 10:
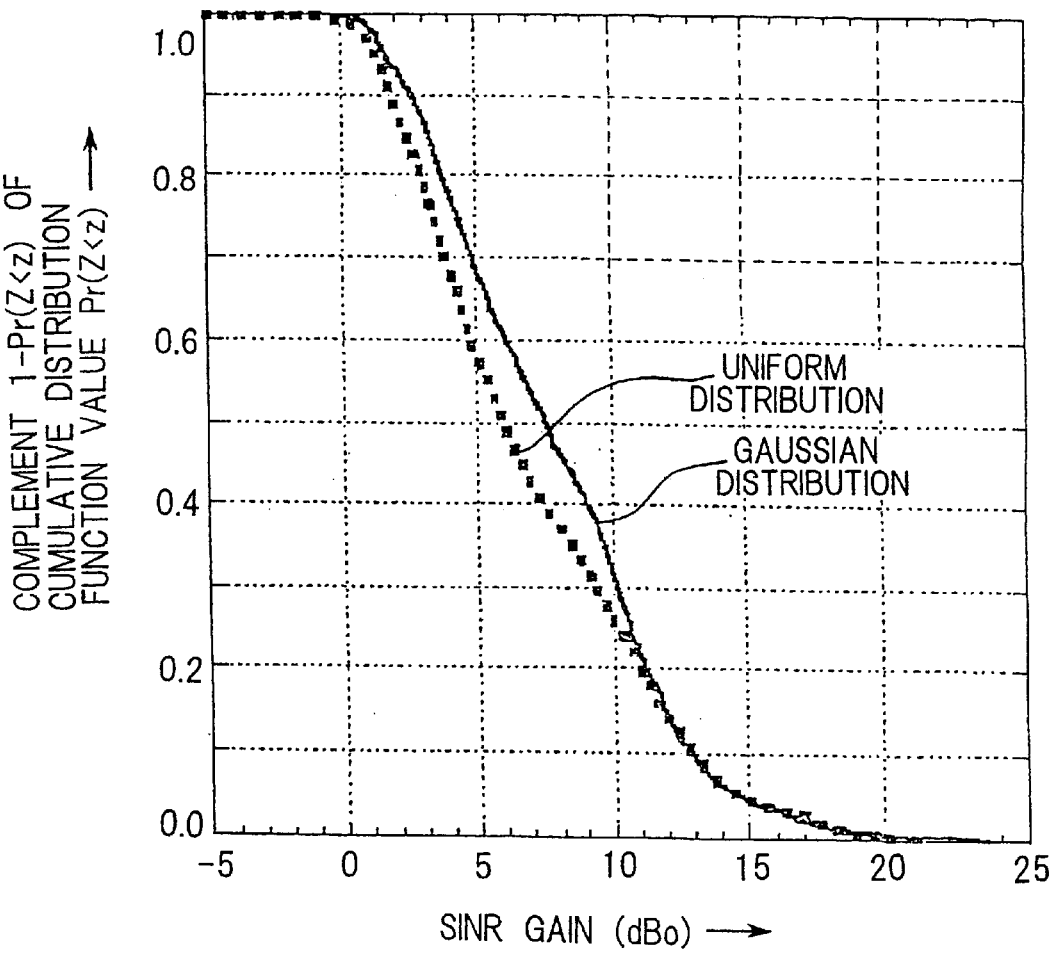
FIG. 10 is a graph showing simulation results of the array antenna apparatus 100 of FIG. 1 and showing a comparison of a complement 1−Pr(Z<z) of a cumulative distribution function value Pr(Z<z) between the case with the use of the uniformly distributed random vector R(n) and the case with the use of the Gaussian distributed random vector R(n)

In FIG. 9, the present inventors plotted two curves of the average value of SINR gains versus the range-parameter coefficient $b_0$ or the variance coefficient $\sigma_0$ of the random vector R(n). The averaging is performed based on sets of DOAs. Given that $\sigma_0$=1500 and $b_0$=1500, the average value of SINR gains with the use of the Gaussian distributed random vector R(n) is larger than that with the use of the uniformly distributed random vector R(n) by 0.8 dB. In FIG. 10, the present inventors make a comparison between two curves of the complement of CDF value in the cases of the uniformly distributed random vector R(n) and the Gaussian distributed random vector R(n). Here is shown a comparison between the graph with $b_0$=1500 of FIG. 7 and the graph with the $\sigma_0$=1500 of FIG. 8. As apparent from this, the operation can be done more successfully in the case of Gaussian distribution than in the case of uniform distribution.

Figure 11:
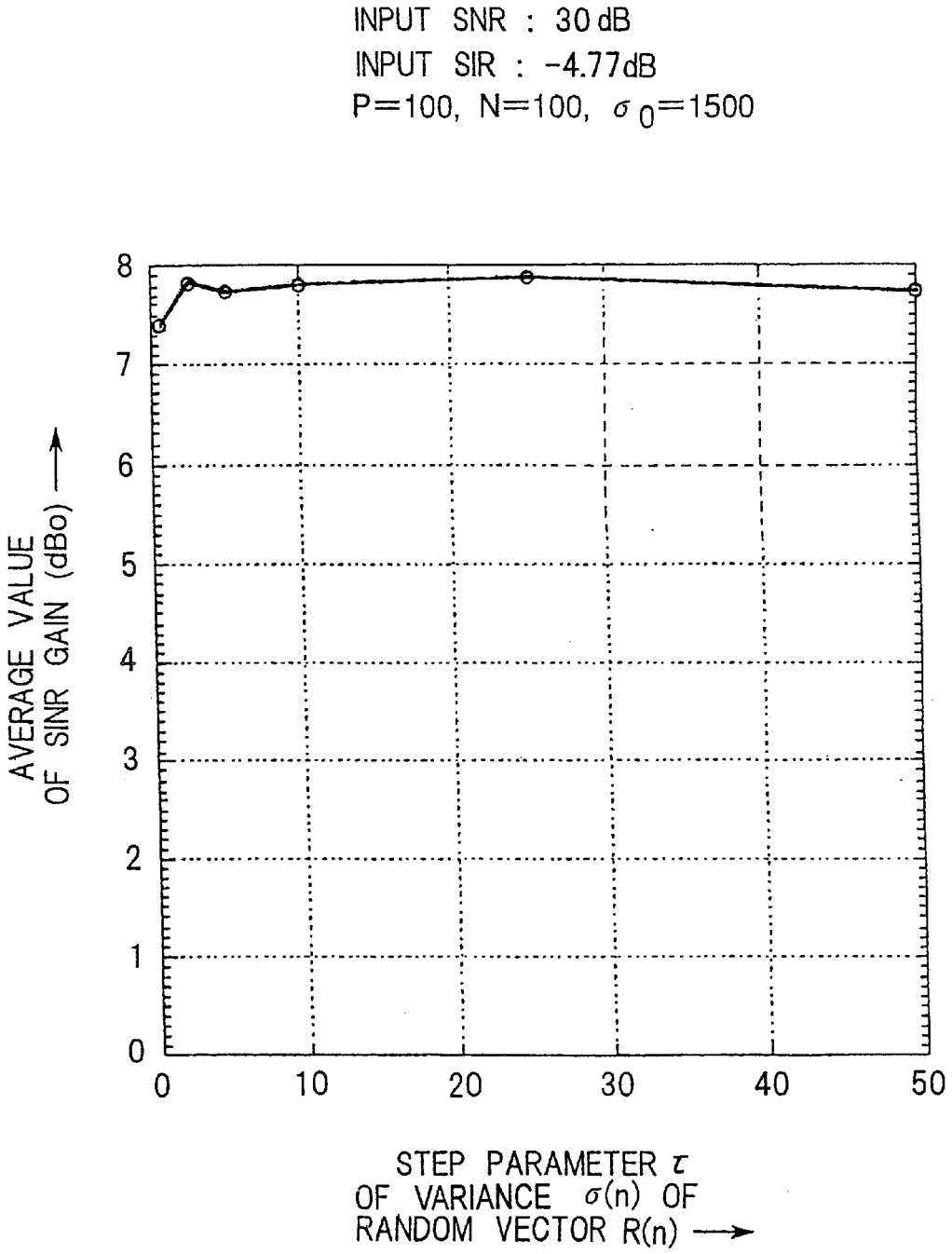
FIG. 11 is a graph showing simulation results of the array antenna apparatus 100 of FIG. 1 and showing a comparison of the average value of SINR gains versus a step parameter τ of the variance of the Gaussian distributed random vector R(n)

Next, the present inventors discuss the advantageous effect of the step parameter $\tau$ in the Equation (14) with the use of the Gaussian distributed random vector R(n). In FIG. 11, the present inventors show a curve of the average value of SINR gains versus the step parameter $\tau$ with $\sigma_0$=1500. It is considered that, when the step parameter $\tau$ is larger than five, the step parameter $\tau$ has almost no advantageous effect on the SINR gain.

Figure 12:
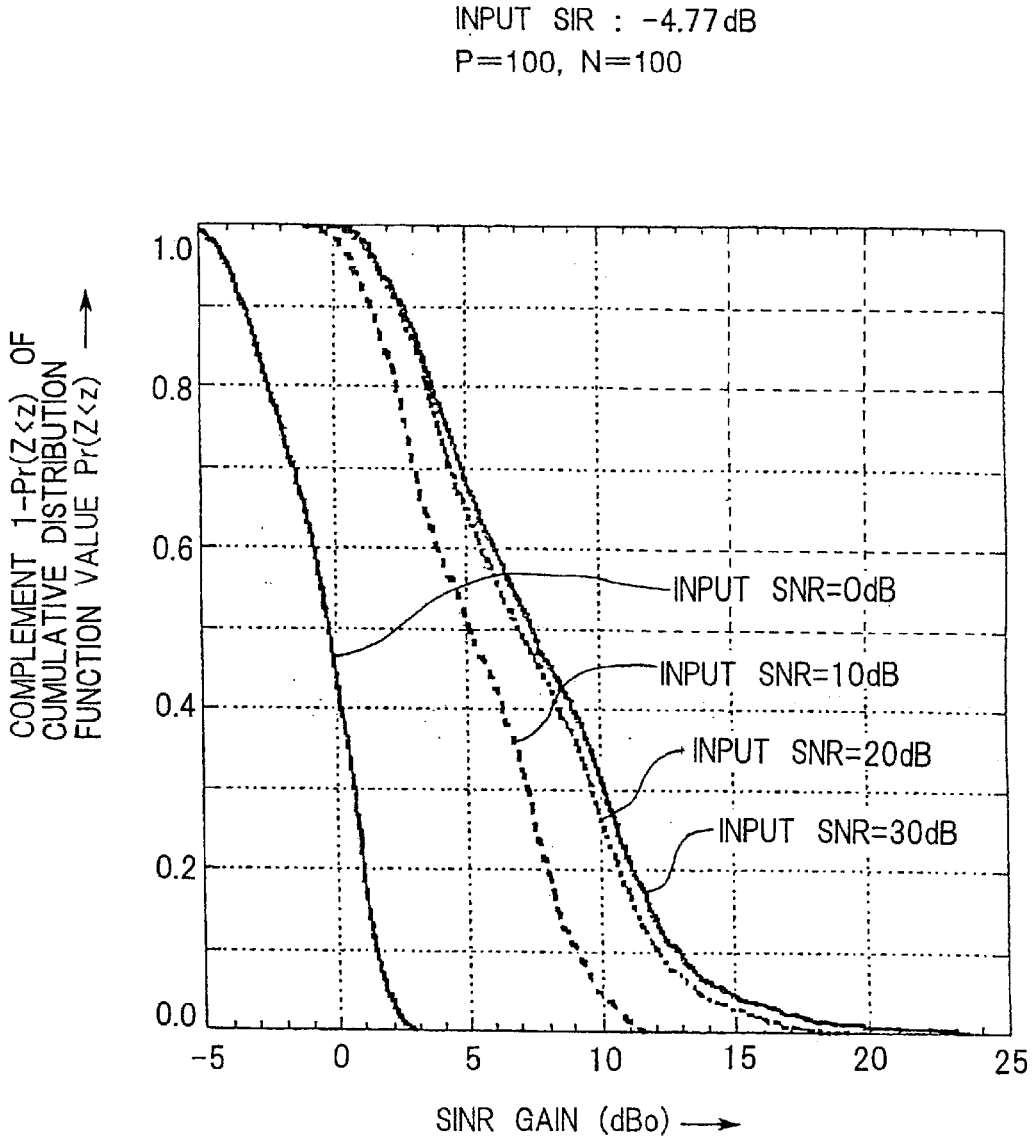
FIG. 12 is a graph showing simulation results of the array antenna apparatus 100 of FIG. 1 and showing a complement 1−Pr(Z<z) of a cumulative distribution function value Pr(Z<z) versus different input SNRs with the use of the Gaussian distributed random vector R(n)

In FIG. 12, the present inventors make a comparison of the complement of the CDF curve against different input-signal-to-noise ratios (SNRs), when the Gaussian distributed random vector R(n) is used. The present inventors observed that when the SNR is changed from 30 dB to 20 dB, the corresponding curve shifts slightly leftward. However, when the input SNR is decreased to 10 dB and 0 dB, the performance remarkably decreases to a large extent.

Figure 13:
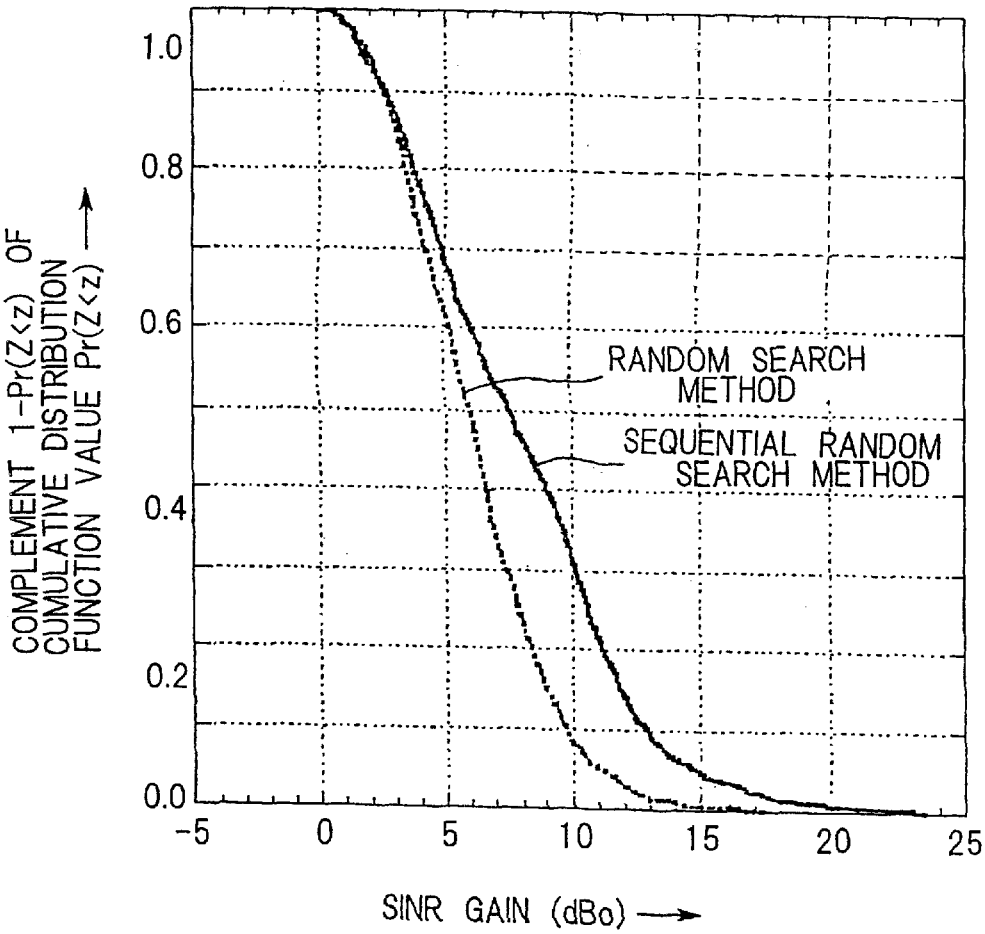
FIG. 13 is a graph showing a comparison of a complement 1−Pr(Z<z) of a cumulative distribution function value Pr(Z<z) between the random search method according to the second related art method and a sequential random search method according to the first preferred embodiment.

Finally, the present inventors compares the sequential random search method proposed by the preferred embodiment according to the present invention (with the use of the Gaussian distributed random vector R(n)) to the pure random search method according to the second related art method, when the input SNR is 30 dB. FIG. 13 shows the complement of the CDF curve by two different search methods. As apparent from this, the operation by using the proposed sequential random search method can be done more successfully than that by using the pure random search method. By averaging signal to interference noise ratio (SINR) based on 1000 DOAs, the present inventors found out that the average SINR gain of the sequential random search method is higher than that of the pure random search method by 1.7 dB. This is principally because the present inventors took into consideration the property of local continuity of the curved surface of the objective function in the sequential random search method.

In the above-mentioned preferred embodiment, the six parasitic elements A1 to A6 are used. However, at least a plural number of parasitic elements are enough to electronically control the directivity characteristics of the array antenna apparatus. Instead of this, more than six parasitic elements may be provided. Besides, the arrangement configuration of the parasitic elements A1 to A6 is not limited to the above preferred embodiment, and they have only to be apart from the radiating element A0 by a predetermined distance. That is, the distances between the radiating element A0 and each of the parasitic elements A1 to A6 may not be constant.

In the above-mentioned preferred embodiment, the variable-reactance elements 12-1 to 12-6 are connected to the parasitic elements A1 to A6. However, the present invention is not limited to this, and those may be the variable-reactance elements which allow their reactance values to be controlled. Since the variable-reactance elements 12-1 to 12-6 are generally capacitive circuit elements, their reactance values are normally of negative values. The reactance values of the variable-reactance elements 12-1 to 12-6 take values in a range of positive to negative values, and for this purpose, it is implementable, for example, to insert a fixed inductor in series to each of the variable-reactance elements 12-1 to 12-6, or to increase the length of the parasitic elements A1 to A6, thus allowing the reactance values to be changed in a range of positive to negative values.

In the present preferred embodiment, the cross correlation coefficient between the received signal y(n) and the training sequence signal d(n) is used as the objective function value J(n). However, the other objective functions may be also used. For example, using the square of the cross correlation coefficient J(n), by virtue of its not being such a function including any square root as the Equation (15), allow the calculation to be simplified.

Also, as the range distribution for perturbation of bias voltage vector V(n), not only uniform distribution and Gaussian distribution but also the other distributions (e.g., a gamma distribution) may be employed.

Although the random vector is used as the initial value of bias voltage vector in the experiment by the present inventors, it is also possible to select the most desirable initial value from a set of predetermined bias voltage vectors as described by referring to FIG. 6. The present inventors have ascertained that such an initial value selection process as shown in FIG. 6 allows the directivity pattern of the array antenna to be converged fastest when a training sequence signal having a length within 1000 symbols on the basis of SINR gain is used, as compared with the case where the random vector or the omnidirectional vector is selected as the initial values of the bias voltage vector. It is not intended that the set of predetermined bias voltage vectors are limited to those as exemplified in the Table 1.

In the above-mentioned preferred embodiment, the adaptive control process using the training sequence signal is executed before the start of actual communication. However, the present invention is not limited to this, and the adaptive control process may be also done either at the beginning of the communication or every some time interval.

As described above, according to the array antenna controlling method of the preferred embodiment according to the present invention, there can be provided a more efficient "sequential" random search method for ESPAR antennas. In this method, a plurality of reactance values to be loaded are randomly changed concurrently. Before and after the change, the objective function value (e.g., the cross correlation coefficient) is calculated, and then releasing calculated values are compared with each other. If the change results in an increase in the objective function value, the change is accepted. Otherwise, the change is rejected and another new random change is attempted. The experiment shows that the sequential random search method allows the performance of the adaptive ESPAR antenna to be improved, as compared with the case of the pure random search method according to the second related art method.

The present inventors have proposed a sequential random search method for adaptively controlling the ESPAR antenna. The proposed method is one in which the property of local continuity of the curved surface of the objective function is taken into consideration. The above-mentioned experiment result shows that the proposed sequential random search method provides an average SINR gain improved by 1.7 dB by using the pure random search method. Moreover, the operation by using the proposed sequential random search method can be done more successfully with the Gaussian distributed random vector R(n) than with the uniformly distributed random vector R(n). The average SINR gain with Gaussian distribution is about 0.8 dB larger than that with uniform distribution.

This array antenna control apparatus can be easily installed as an antenna for mobile communication terminals onto such electronic equipment as notebook type personal computers or PDAs. Further, even when the main beam is scanned in any direction of a horizontal plane, all the parasitic elements effectively function as wave directors or reflectors, so that the control of directivity characteristics with respect to an incoming wave and a plurality of interference waves is quite preferable.

SECOND PREFERRED EMBODIMENT

Figure 14:
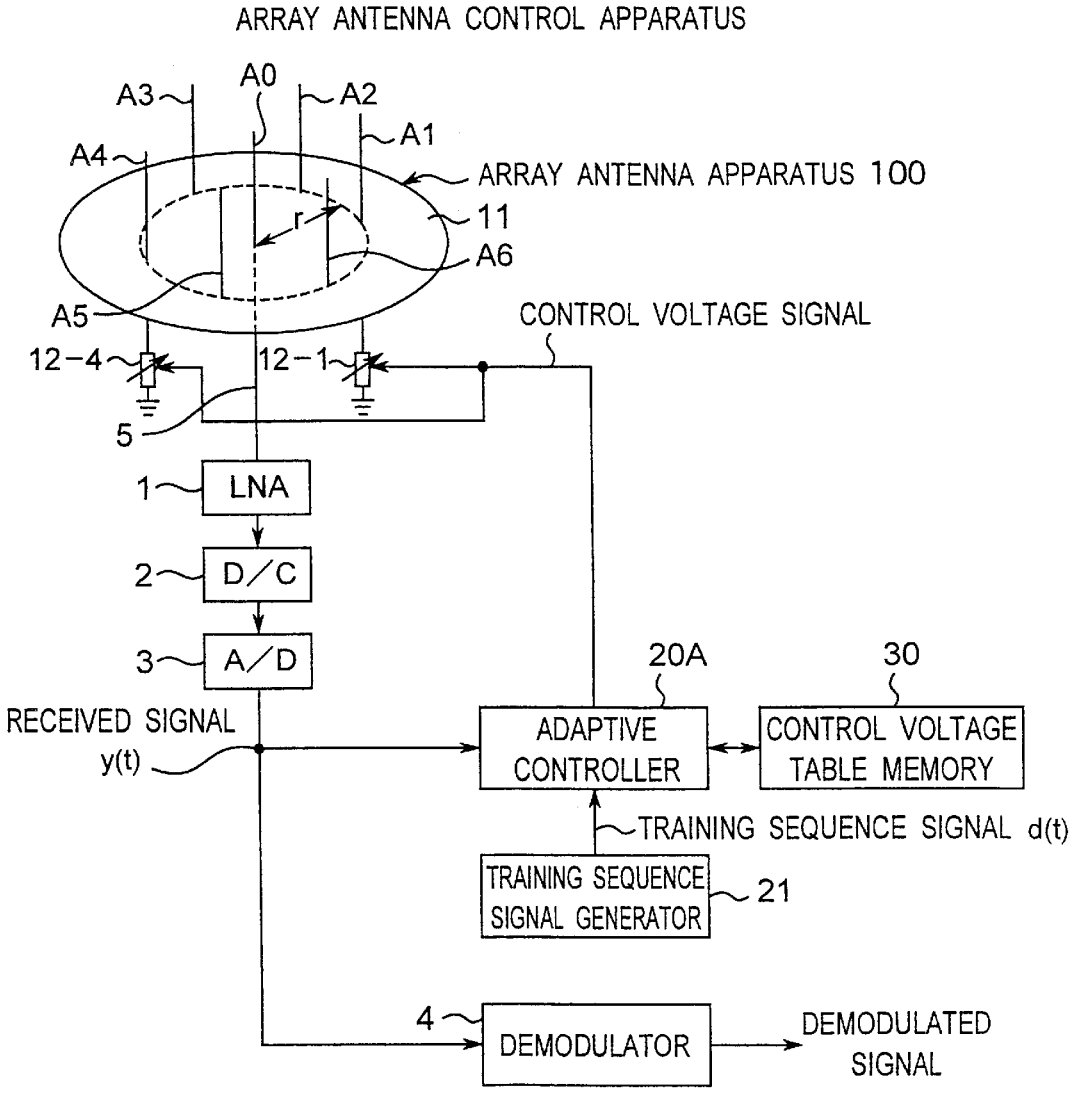
FIG. 14 is a block diagram showing a configuration of an array antenna control apparatus according to a second preferred embodiment of the present invention.

FIG. 14 is a block diagram showing a configuration of an array antenna control apparatus which is a second preferred embodiment according to the present invention. The array antenna control apparatus of the present preferred embodiment, as shown in FIG. 14, includes: an array antenna apparatus 100 which is the ESPAR antenna and which is equipped with one radiating element A0 and six parasitic elements A1 to A6; an adaptive controller 20A; a training sequence signal generator 21; and a control voltage table memory 30 connected to the adaptive controller 20A. The adaptive controller of the second preferred embodiment is characterized in that the adaptive controller 20A is provided instead of the adaptive controller 20, as compared with the array antenna control apparatus of the first preferred embodiment shown in FIG. 1. The following description will be focused mainly on this difference point.

In this case, the adaptive controller 20A, which is implemented by a computer or the other digital computing machine as an example, is characterized in that, before starting radio communication by a demodulator 4, the adaptive controller 20 performs a later-described adaptive control process using a "higher-dimensional dichotomizing search method" based on a received signal y(n), which is obtained by receiving a training sequence signal contained in a radio signal transmitted from a remote transmitter by the radiating element A0 of the array antenna apparatus 100, as well as on a training sequence signal d(t) having the same signal pattern as that of the above-mentioned training sequence signal and generated by the training sequence signal generator 21, and this leads to calculation and setting of reactance values of the variable-reactance elements 12-1 to 12-6 (hereinafter, referred to generically by reference numeral 12), respectively, for directing the main beam of the array antenna apparatus 100 toward a desired wave and further directing the null(s) thereof toward an interference wave(s). It is noted here that the variable-reactance elements 12 are, for example, variable-capacitance diodes, and their respective reactance values are changed and controlled by application of control voltage signals showing control voltages, which are reverse bias voltages, to be applied from the adaptive controller 20A to the variable-reactance elements 12, respectively.

More specifically, the adaptive controller 20A dichotomizes a range of reactance values that can be taken by the respective variable-reactance elements 12, and sets medians of the respective dichotomized ranges to the variable-reactance elements 12, respectively. The adaptive controller 20A performs the step of: calculating a predetermined cross correlation coefficient between the received signal y(t) and the training sequence signal d(t), where the received signal y(t) is obtained when the training sequence signal d(t) contained in a radio signal transmitted from the remote transmitter is received by the array antenna apparatus 100, and the training sequence signal d(t) is generated by the training sequence signal generator 21. Then the adaptive controller 20A performs the step of selecting and setting, as initial values, reactance values of the respective variable-reactance elements 12 corresponding to the larger cross correlation coefficient out of two cross correlation coefficients corresponding to the medians of the respective dichotomized ranges. Thereafter, the adaptive controller 20A dichotomizes the range belonging to the selected reactance values, and sets medians of the respective dichotomized ranges to the variable-reactance elements 12, respectively, where the adaptive controller 20A performs the steps of calculating cross correlation coefficients. Further, the adaptive controller 20A performs the step of selecting and setting, as initial values, reactance values of the respective variable-reactance elements 12 corresponding to the larger cross correlation coefficient out of two cross correlation coefficients corresponding to the medians of the respective dichotomized ranges. The adaptive controller 20A iterates the latter process to a predetermined number of times of iterations, thus achieving control for directing the main beam of the array antenna apparatus 100 toward a desired wave and directing the null(s) thereof toward an interference wave(s).

Further, more preferably, for selection of a reactance value of each variable-reactance element as an initial value, cross correlation coefficients are calculated when reactance values (control voltages) of the respective variable-reactance elements 12 corresponding to a later-described plurality of radiation patterns stored in a control voltage table memory 30 are set to the variable-reactance elements 12, respectively, and reactance values of the respective variable-reactance elements corresponding to one radiation pattern having the maximum cross correlation coefficient are selected and set as the initial values.

It is noted here that the reactance values of the variable-reactance elements 12-1 to 12-6, which are, for example, variable-capacitance diodes as described above, can be changed by changing the reverse bias voltage to be applied thereto. Therefore, in the array antenna apparatus 100 of FIG. 14, planar directivity characteristics of the array antenna apparatus 100 can be changed by changing the reactance values of the variable-reactance elements 12-1 to 12-6 connected to the parasitic elements A1 to A6, respectively.

In the array antenna control apparatus of FIG. 14, the array antenna apparatus 100 receives a radio signal, and the received signal is inputted to the low-noise amplifier (LNA) 1 through the coaxial cable 5, and is thereby amplified, and then a down converter (D/C) 2 converts the amplified signal into a signal of a predetermined intermediate frequency (IF signal) in a lower band. Further, an A/D converter 3 performs an analog-to-digital conversion to convert the lower-band-converted analog signal to a digital signal, and outputs the resulting digital signal to the adaptive controller 20A and the demodulator 4.

Next, the adaptive controller 20A, as will be detailed later, performs the process including the steps of: dichotomizing a range of reactance values that can be taken by the respective variable-reactance elements 12; and setting medians of the respective dichotomized ranges to the variable-reactance elements 12, respectively. Then the adaptive controller 20A calculates the cross correlation coefficient, and selects and sets, as initial values, reactance values of the respective variable-reactance elements 12 corresponding to the larger cross correlation coefficient out of two cross correlation coefficients corresponding to the medians of the respective dichotomized ranges. Thereafter, the adaptive controller 20A dichotomizes the range belonging to the selected reactance values, and sets medians of the respective dichotomized ranges to the variable-reactance elements 12, respectively. Then the adaptive controller 20A performs the steps of: calculating cross correlation coefficients, and selecting and setting, as initial values, reactance values of the respective variable-reactance elements 12 corresponding to the larger cross correlation coefficient out of two cross correlation coefficients corresponding to the medians of the respective dichotomized ranges. The adaptive controller 20A iterates the latter process to a predetermined number of times of iterations, thus achieving control for directing the main beam of the array antenna apparatus 100 toward a desired wave and directing the null(s) thereof toward an interference wave(s). On the other hand, the demodulator 4 performs demodulation process on the inputted received signal y(t), and outputs a demodulated signal which is a data signal. It is noted that a cross correlation coefficient R which is used in the adaptive controller 20A is defined by the following equation:

$$R = \frac{|y^H(t)d(t)|}{\sqrt{y^H(t)y(t)}\sqrt{d^H(t)d(t)}} \quad (17),$$

where the superscript "H" denotes complex conjugate transposition. This cross correlation coefficient R is a coefficient showing a degree of cross correlation between the received signal y(t) and the training sequence signal d(t). If R=1, those signals are of complete coincidence. On the other hand, if R=0, those are of complete non-coincidence. It is to be noted here that the received signal y(n), which is an output signal from the single port of the radiating element A0 of the array antenna apparatus 100, is a higher-order nonlinear function of the adjustable reactance value.

More preferably, for selection of a reactance value of each variable-reactance element as an initial value, cross correlation coefficients are calculated when reactance values (control voltages) of the respective variable-reactance elements 12 corresponding to a later-described plurality of radiation patterns stored in a control voltage table memory 30 are set to the variable-reactance elements 12, respectively, and reactance values of the respective variable-reactance elements corresponding to one radiation pattern having the maximum cross correlation coefficient are selected and set as the initial values.

A transmitting station that transmits a radio signal to be received by the array antenna 100 modulates a carrier signal of radio frequency by using a digital modulation method such as BPSK or QPSK according to a digital data signal of a predetermined symbol rate containing a training sequence signal having a signal pattern identical to that of a predetermined training sequence signal generated by the training sequence signal generator 21, then amplifies the power of the modulated signal, and transmits the resulting signal toward the array antenna apparatus 100 of a receiving station. In the present preferred embodiment, before data communication is performed, a radio signal containing a training sequence signal is transmitted from the transmitting station toward the receiving station, and the receiving station performs an adaptive control process by the adaptive controller 20A.

Next, formulation of various types of signals according to the array antenna apparatus 100 will be explained in detail. The received signal y(t) of the array antenna apparatus 100 of the ESPAR antenna is expressed by the following equation:

$$y(t)=i^T S(t) \quad (18),$$

where i is a current vector whose elements are current distributions induced to the radiating element A0 and the parasitic elements A1 to A6, and S(t) is a received signal vector of the array antenna apparatus 100. It is noted that the subscript T denotes transposition.

As can be understood from the above Equation (18), the current vector i serves the role of a weight vector in the related art array antenna. However, the array antenna apparatus 100 of the ESPAR antenna, cannot manage the current distribution directly and controls the current distribution indirectly by handling the reactance value. Thus, the current vector i is expressed as a function of reactance value by the following equation:

$$i=v_s(Z+X)^{-1}u_0 \quad (19),$$

where X is a matrix having diagonal components of output impedances $z_s$ of the transmitter and reactance values of the respective elements as follows:

$$X=\mathrm{diag}[z_s, jx_1, jx_2, jx_3, jx_4, jx_5, jx_6] \quad (20),$$

and Z is an impedance matrix including inter-element coupling. Also, $u_0$ is a unit vector of:

$$u_0=[1, 0, 0, 0, 0, 0, 0] \quad (21),$$

and $x_s$ is an internal voltage (open-circuit voltage) of the transmitter.

In the above Equation (16), a vector having reactance values of the variable-reactance elements 12 as its elements is called reactance vector and expressed as follows:

$$x=[x_1, x_2, x_3, x_4, x_5, x_6] \quad (22).$$

Now a higher-dimensional dichotomizing search method, which will be described below in detail, is proposed as a method for controlling this reactance vector. The higher-dimensional dichotomizing search method includes the steps of dichotomizing a range of values that can be taken by the respective variable-reactance elements 12, calculating the cross correlation coefficient R with their medians, and deciding that an optimum solution is present on one side where a higher correlation is obtained. As a result of applying the dichotomizing method to the six elements, respectively, domains that are $1/2^6$ domains before the application are obtained. This operation is iterated until the reactance values can no longer be dichotomized, and a finally obtained set of reactance values is taken as a final solution. The terms, "higher-dimensional", in this higher-dimensional dichotomizing search method is referred to as six dimensions corresponding to the six variable-reactance elements 12. An optimum solution of the reactance values with respect to these six dimensions is determined by the higher-dimensional dichotomizing search method.

In the array antenna apparatus 100 that the present inventors manufactured by way of trial, there is a relationship shown by the following table among reactance values $x_m$ of variable-capacitance diodes of the variable-reactance elements 12, the control voltages v, and the digital control voltage values $k_{vm}$ for operating the voltage. The relational expression between $x_m$ and $k_{vm}$ determined from this table is expressed by the following equation:

$$x_m=-0.0217\,k_{vm}-49.21 \quad (m=1, 2, \ldots, 6) \quad (23).$$

TABLE 2

Relationship between $x_m$ and $k_{v\,m}$ in variable-capacitance diodes of variable-reactance elements 12

| | | | | | |
|---|---|---|---|---|---|
| $x_m$\|Ω\| | −4.77 | −27.0 | −49.2 | 71.4 | −93.6 |
| v\|V\| | −0.5 | *4.63 | *9.75 | *14.9 | 20 |
| $k_{v\,m}$ | −2048 | −1024 | 0 | 1023 | 2047 |

Note:
* denotes a value obtained by calculation.

Since the digital control voltage takes only integral values ranging from −2048 to 2047, $k_{vm}$ is within a range of $4096=2^{12}$, and the dichotomizing method is effected (12-1) times for one parasitic element (one of A1 to A6). If the number of samples with which the cross correlation coefficient R is calculated is P symbols, then it is necessary to provide P×2×6 symbols for one cycle of application of the dichotomizing method for the six elements. Also, for the first cycle, it is necessary to provide 14 symbols as described later. Accordingly, a final solution under an upper limit of 14P+12P×10 symbols can be obtained. A set of digital control voltage values $k_{vm}$ is defined as follows:

$$k_v=[k_{v1}, k_{v2}, k_{v3}, k_{v4}, k_{v5}, k_{v6}] \quad (24).$$

The final solution obtained by the higher-dimensional dichotomizing search method is not necessarily coincident with the optimum solution. However, with considerations focused on the convergence speed from the viewpoint that a solution that satisfies output SINR requirements for the system would not necessarily require an optimum solution, the higher-dimensional dichotomizing search method can be effective for systems that are relative short in convergence time.

Further, the selection of the initial value will be explained.

It has been found out that although the final solution can be obtained by the above-described procedure in the higher-dimensional dichotomizing search method, and there are some angles where the null point(s) is less easily formed by simply iterating the dichotomizing method. This is because to set a succeeding domain by selecting ranges of higher correlation for the parasitic elements A1 to A6, respectively, and then by combining those ranges together could not necessarily mean to form the null point(s) in a direction along which an interference wave(s) comes in. Since mistaking from the beginning the direction in which the optimum solution is present would result in the formation of an absolutely nonsense radiation pattern, a countermeasure is taken by attempting a method of selecting initial values of reactance values at the first step. For this purpose, 14 radiation patterns of initial values shown below are used.

Figure 18:
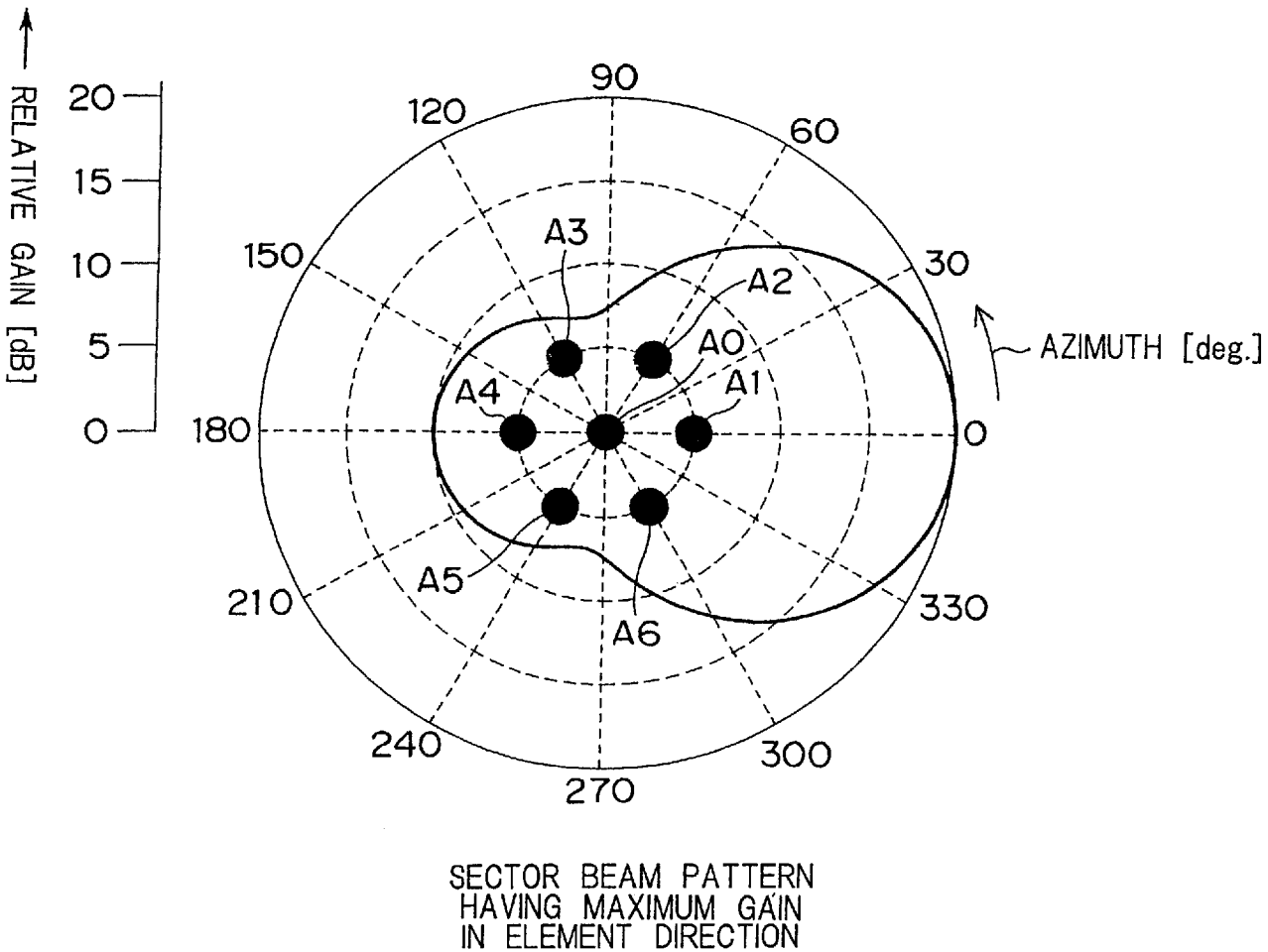
FIG. 18 is a directivity characteristic diagram showing a "sector beam pattern having the maximum gain in an element direction", which is a first example of directional pattern for initial value selection, which is used in the array antenna control apparatus of FIG. 14.

First of all, a sector beam pattern of FIG. 18 having the maximum gain in a direction directed from the radiating element A0 toward the parasitic element A1 is expressed in digital control voltage value by the following equation:

$$k_v=[2047, 2047, -2048, -2048, -2048, 2047] \quad (25).$$

Therefore, there are six sector beam patterns each of which have the maximum gain in a direction directed from the radiating element A0 toward the parasitic element A1 to A6, and these patterns are used.

Figure 19:
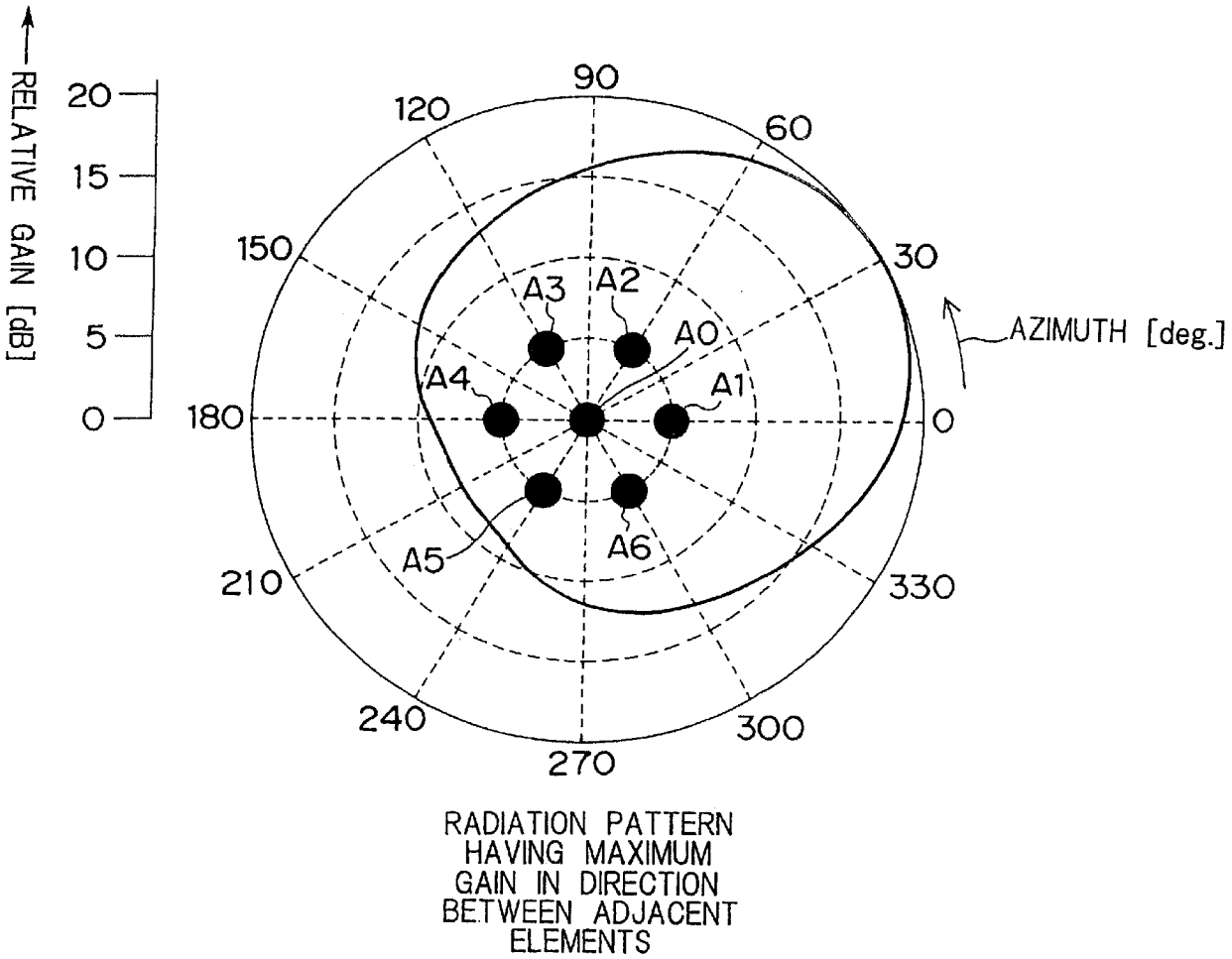
FIG. 19 is a directivity characteristic diagram showing a "sector beam pattern having the maximum gain in the element direction", which is a second example of directional pattern for initial value selection, which is used in the array antenna control apparatus of FIG. 14.

Next, a sector beam pattern having the maximum gain in a direction directed from the radiating element A0 toward an intermediate position between the parasitic elements A1 and A2 is as shown in FIG. 19, and this sector beam pattern is expressed by the following equation in digital control voltage value:

$$k_v=[2047, 2047, -2048, -2048, -2048, -2048] \quad (26).$$

Therefore, there are six sector beam patterns each of which has the maximum gain in a direction directed from the radiating element A0 toward an intermediate position between mutually adjacent parasitic elements (A1 and A2, A2 and A3, A3 and A4, A4 and A5, A5 and A6, A6 and A1), respectively, and these patterns are used in this case.

Figure 20:
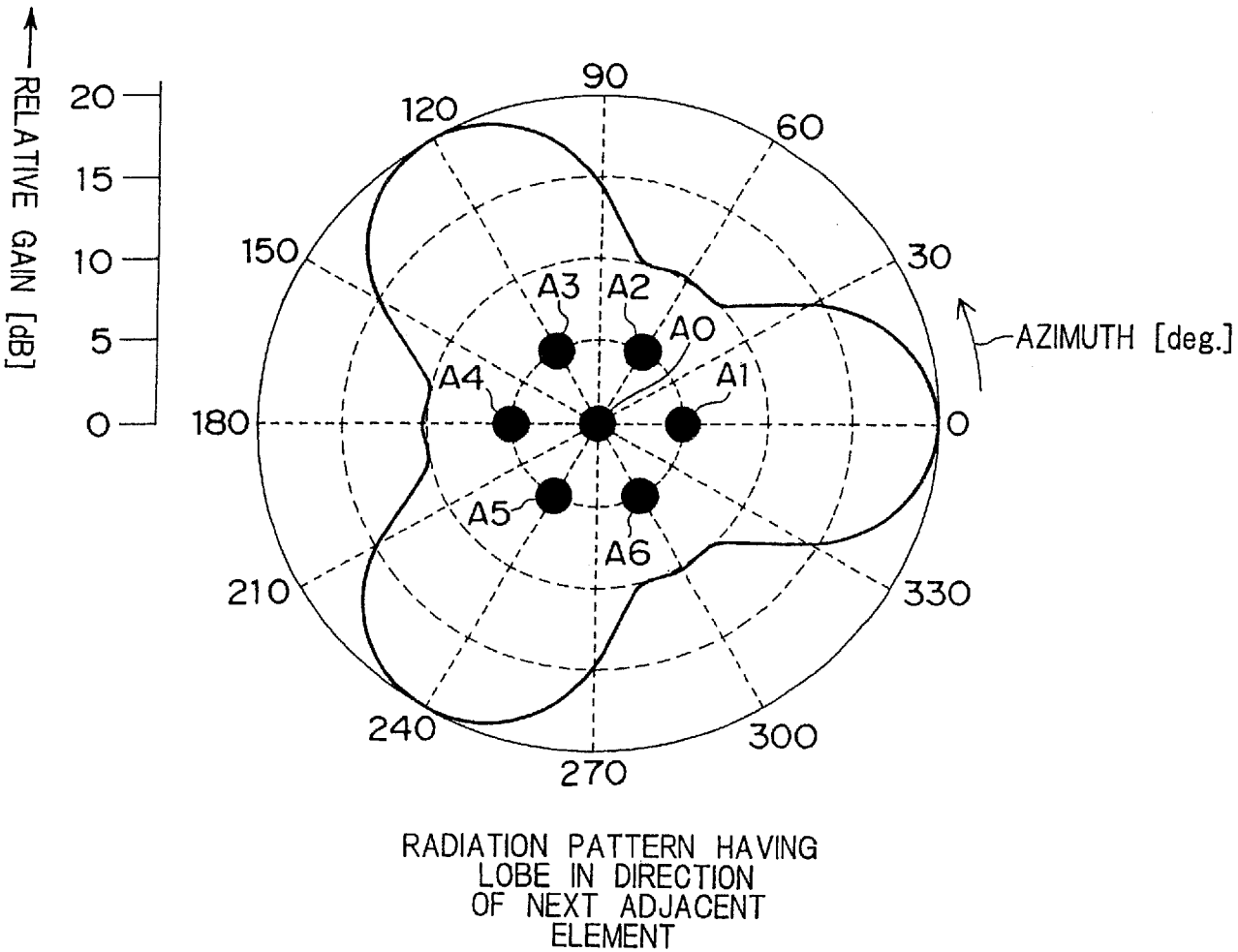
FIG. 20 is a directivity characteristic diagram showing a "radiation pattern having a lobe in the direction of the next adjacent element", which is a third example of directional pattern for initial value selection, which is used in the array antenna control apparatus of FIG. 14.

Furthermore, as shown in FIG. 20, there are used two radiation patterns, one being a radiation pattern having lobes in directions directed from the radiating element A0 toward mutually non-adjacent, alternate three parasitic elements A1, A3 and A5, and the other being a radiation pattern which results from rotating the above-mentioned radiation pattern by 60°. With these 14 radiation patterns taken as initial values, 14 sets of digital control voltage values are prepared as shown in the following table and preliminarily stored in the control voltage table memory 30. From among these 14 sets, a set that allows the highest correlation to be obtained is selected as an initial value, and the process by using the higher-dimensional dichotomizing search method is started.

TABLE 3

Digital control voltage values of 14 radiation patterns (Initial values)

| Pattern | A1 | A2 | A3 | A4 | A5 | A6 |
|---|---|---|---|---|---|---|
| 1 | 1023 | 1023 | −1024 | −1024 | −1024 | 1023 |
| 2 | 1023 | 1023 | 1023 | −1024 | −1024 | −1024 |
| 3 | −1024 | 1023 | 1023 | 1023 | −1024 | −1024 |
| 4 | −1024 | −1024 | 1023 | 1023 | 1023 | −1024 |
| 5 | −1024 | −1024 | −1024 | 1023 | 1023 | 1023 |
| 6 | 1023 | −1024 | −1024 | −1024 | 1023 | 1023 |
| 7 | 1023 | 1023 | −1024 | −1024 | −1024 | −1024 |
| 8 | −1024 | 1023 | 1023 | −1024 | −1024 | −1024 |
| 9 | −1024 | −1024 | 1023 | 1023 | −1024 | −1024 |
| 10 | −1024 | −1024 | −1024 | 1023 | 1023 | −1024 |
| 11 | −1024 | −1024 | −1024 | −1024 | 1023 | 1023 |
| 12 | 1023 | −1024 | −1024 | −1024 | −1024 | 1023 |
| 13 | −1024 | 1023 | −1024 | 1023 | −1024 | 1023 |
| 14 | 1023 | −1024 | 1023 | −1024 | 1023 | −1024 |

In the Table 3, the radiation patterns 1 to 6 are sector beam patterns each having the maximum gain in a direction directed from the radiating element A0 toward each of the parasitic element A1 to A6, the radiation patterns 7 to 12 are sector beam patterns each having the maximum gain in a direction directed from the radiating element A0 toward an intermediate position between mutually adjacent parasitic elements (A1 and A2, A2 and A3, A3 and A4, A4 and A5, A5 and A6, A6 and A1), and the patterns 13 and 14 includes not only a radiation pattern having lobes in directions directed from the radiating element A0 toward mutually non-adjacent, alternate three parasitic elements A1, A3 and A5, but also a radiation pattern which results from rotating the above-mentioned radiation pattern by 60°.

Figure 15:
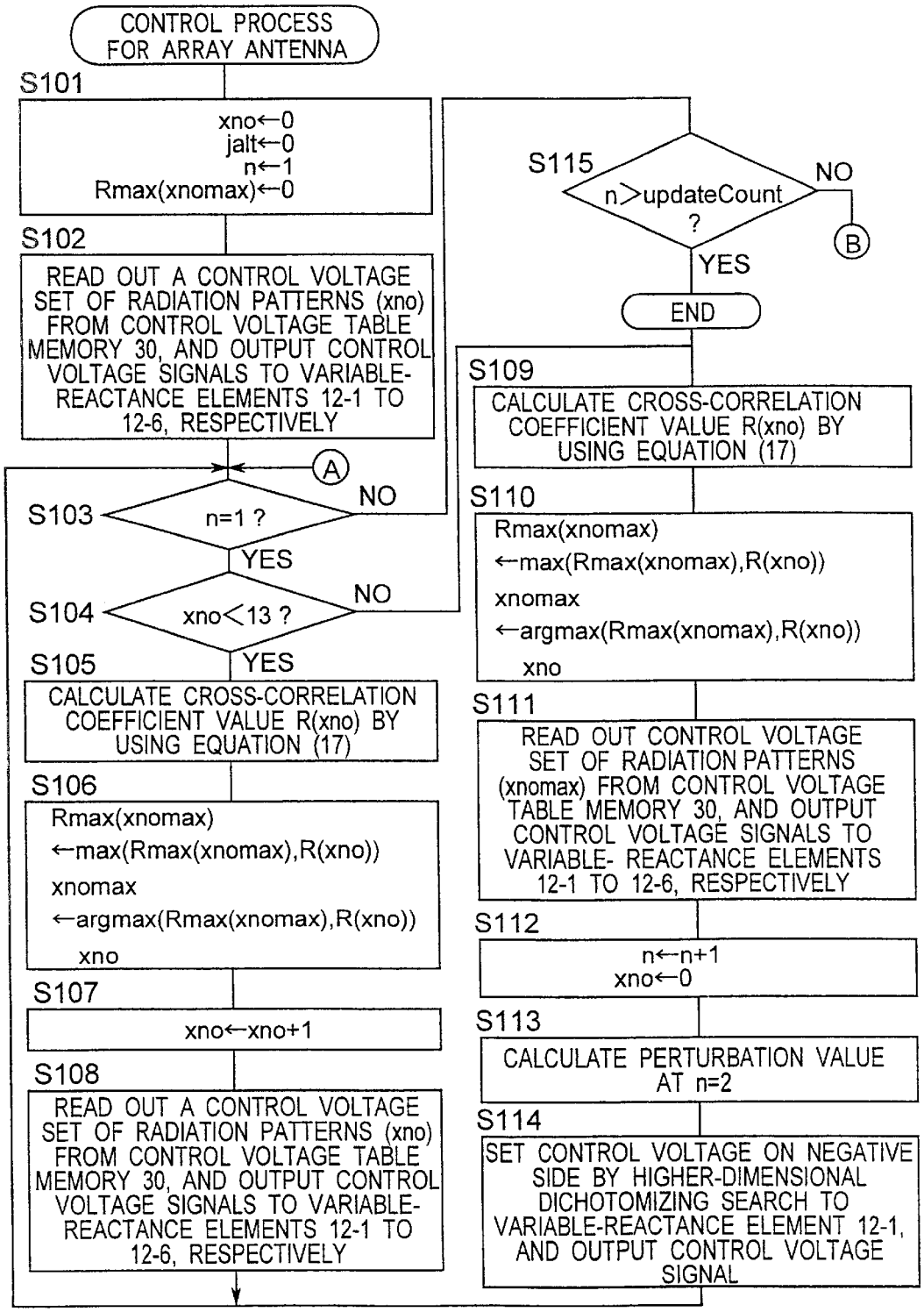
FIG. 15 is a flowchart showing a first part of a array antenna control process which is executed by the adaptive controller 20A of FIG. 14.
Figure 16:
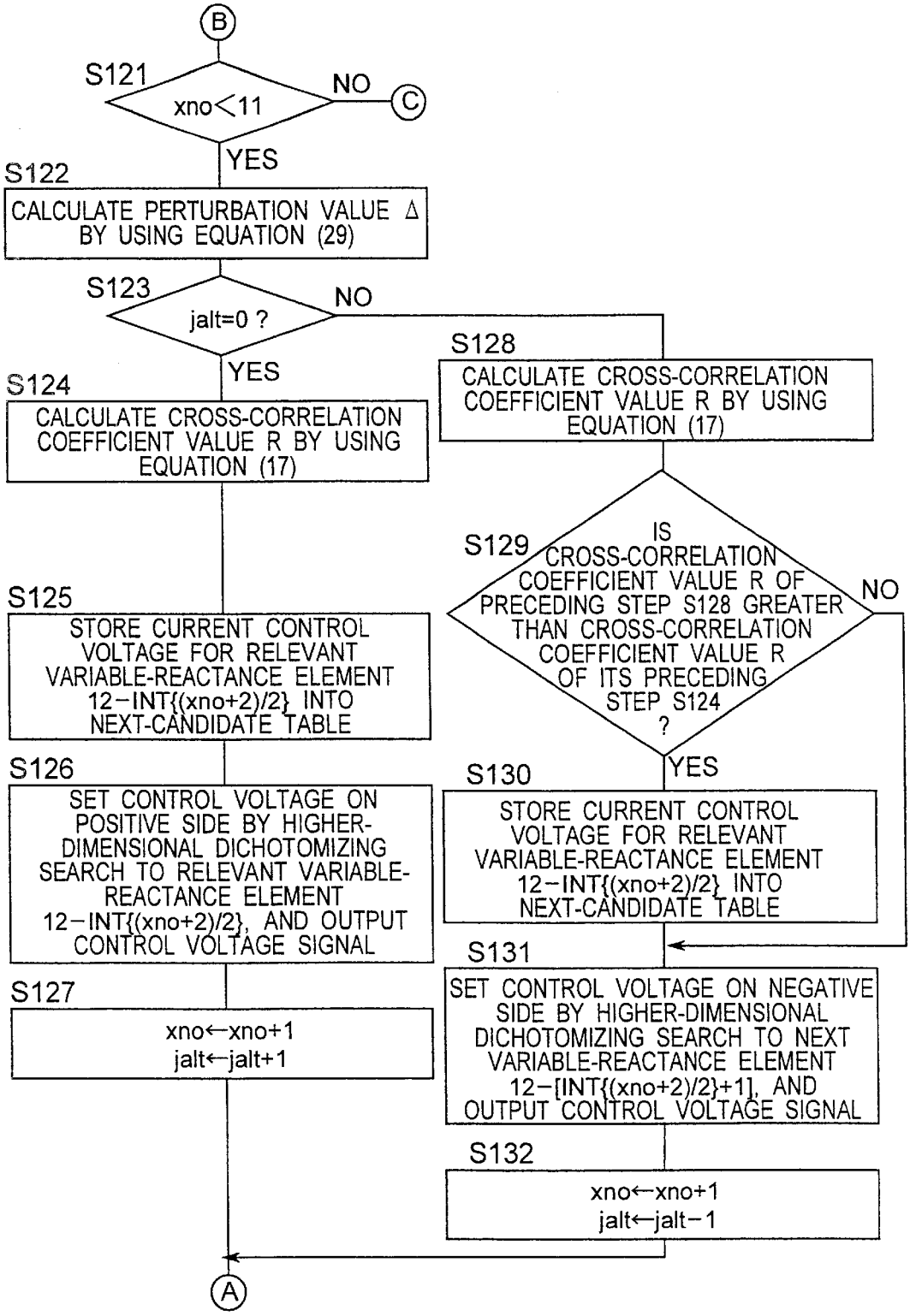
FIG. 16 is a flowchart showing a second part of the array antenna control process which is executed by the adaptive controller 20A of FIG. 14.
Figure 17:
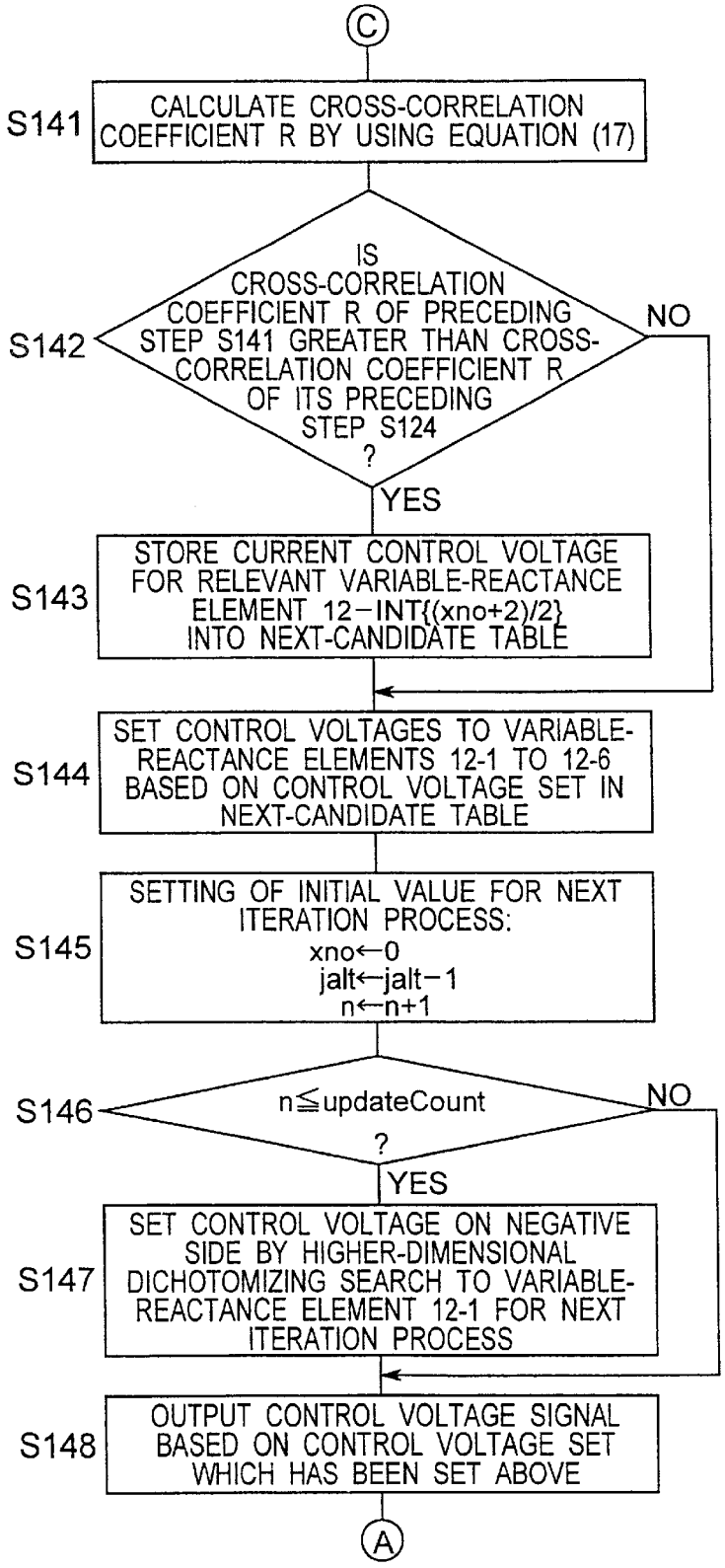
FIG. 17 is a flowchart showing a third part of the array antenna control process which is executed by the adaptive controller 20A of FIG. 14.

Next, FIGS. 15 to 17 are flowcharts showing an array antenna control process which is executed by the adaptive controller 20A of FIG. 14.

Referring to FIGS. 15 to 17, the array antenna control process which is executed by the adaptive controller 20A by using the above-described higher-dimensional dichotomizing search method will be explained. This array antenna control process is executed before the demodulator 4 of FIG. 14 starts radio communication and while a radio signal containing a training sequence signal derived from a remote transmitting station is being received. A parameter xno for executing processing on the 14 radiation patterns of initial values is used (which, however, is limited to the processing of FIG. 15). Further, this higher-dimensional dichotomizing search method includes the steps of, after a dichotomization with one initial value or selected value taken as a median, performing a perturbation from the median toward the positive side and a perturbation toward the negative side, calculating cross correlation coefficients R for the respective perturbations, and selecting a reactance value having a larger cross correlation coefficient R. Therefore, the higher-dimensional dichotomizing search method involves the total of 12 times of calculation processes, resulting from 2 processes×6 elements, for one iteration. The parameter for this calculation process is given by the use of xno (which, however, is limited to the processes in FIGS. 16 and 17). Also, parameters corresponding to the above two processes are assumed that alt=0 and alt=1. Further, the number of iterations parameter is assumed as "n", and its upper limit value is assumed as "updateCount". Furthermore, the parameter for storing the maximum cross correlation coefficient value is assumed as "Rmax(xnomax)", and the calculation process parameter therefor is assumed as "xnomax".

Referring to FIG. 15, first of all, an initialization process is executed at step S101, namely, more specifically, the parameters xno, jalt and Rmax (xnomax) are reset to zero, and the parameter n is reset to one. Then, at step S102, a control voltage set of radiation patterns (xno) is read out from the control voltage table memory 30, and a control voltage signal is outputted to each of the variable-reactance elements 12-1 to 12-6. At step S103, it is judged whether or not n=1. If the answer is YES, then the control flow goes to step S104. On other hand, if the answer is NO, then the control flow goes to step S115. At step S104, it is judged whether or not xno<13. If the answer is YES, then the control flow goes to step S105. On the other hand, if the answer is NO, then the control flow goes to step S109. At step S105, upon reception of a received signal y(t), a cross correlation coefficient value R(xno) is calculated by using the above Equation (17). At step S106, calculation and update of the following equations are performed:

$$R\max(xno\max) \leftarrow \max(R\max(xno\max), R(xno)) \quad (27), \text{ and}$$

$$xno\max \leftarrow \underset{xno}{arg\max}(R\max(xno\max), R(xno)) \quad (28),$$

where max(') is a function showing an argument having the maximum value among a plurality of arguments, and argmax(') is a function showing a parameter xno which is an argument of the argument showing the maximum value among a plurality of arguments. Accordingly, the largest value of the cross correlation coefficient that has ever been calculated is inputted to the Rmax(xnomax), and the value of parameter xno at that time is inputted to the parameter xnomax.

Subsequently, at step S107, the parameter xno is incremented by one. At step S108, a control voltage set of radiation patterns (xno) is read out from the control voltage table memory 30, and a control voltage signal is outputted to each of the variable-reactance elements 12-1 to 12-6, then the control flow returns to step S103.

On the other hand, at step S109, upon reception of the received signal y(t), a cross correlation coefficient value R is calculated by using the above Equation (17). At step S100, a calculation and update process similar to that of step S106 is executed. Subsequently, at step S111, a control voltage set of radiation patterns (xnomax) is read out from the control voltage table memory 30, and a control voltage signal is outputted to each of the variable-reactance elements 12-1 to 12-6. At this stage of the step S111, a radiation pattern having the maximum cross correlation coefficient among 14 radiation patterns stored in the control voltage table memory 30 is selected, and a control voltage set corresponding thereto is read out and set thereto.

Subsequently, for the next iteration, the parameter n is incremented by one, and the parameter xno is reset to zero. Then, at step S113, a perturbation value when n=2 is calculated, namely, more specifically, under the condition that the digital control voltage values of the radiation patterns selected as the initial values are taken as medians, digital control voltage values are dichotomized, and medians of the respective dichotomized ranges are calculated as perturbation first values for the digital control voltage values (two in number for positive and negative sides). Further, at step S114, the negative-side control voltage of the higher-dimensional dichotomizing search method is set to the variable-reactance element 12-1, and a control voltage signal is outputted, then the control flow returns to step S103.

At step S103, if the answer is NO, then the control flow goes to step S115, then it is judged whether or not n>updateCount (process ending condition). If the answer is YES, then the control process is ended. On the other hand, if the answer is NO, then the control flow goes to step S121 of FIG. 16.

At step S121 of FIG. 16, it is judged whether or not xno<11. At step S122, the perturbation value Δ from the selected value is calculated by using the following equation:

$$\Delta = 2^{11-n} \quad (29).$$

At step S123, it is judged whether or not jalt=0. If the answer is YES, then the control flow goes to step S124. On the other hand, if the answer is NO, then the control flow goes to step S128. At step S124, upon reception of a received signal y(t), a cross correlation coefficient value R is calculated by using the above Equation (17). At step S125, the present control voltage for the variable-reactance element 12-INT{(xno+2)/2} (where INT is a function showing integers of arguments alone) that is currently being processed is stored into a next-candidate table that is a temporary memory provided within the adaptive controller 20A. It is noted here that the next-candidate table is given by a vector of six digital control voltage values, and is a table for storing therein a selected value of an optimum control voltage that is being processed. At step S126, a positive-side control voltage (=selected value+Δ) of the higher-dimensional dichotomizing search method is set to the variable-reactance element 12-INT{(xno+2)/2} that is being processed, and a control voltage signal is outputted. At step S127, the parameter xno is incremented by one, and the parameter jalt is incremented by one, and thereafter, the control flow returns to step S103 of FIG. 15.

On the other hand, at step S128, upon reception of the received signal y(t), a cross correlation coefficient value R is calculated by using the above Equation (17). At step S129, it is judged whether or not the cross correlation coefficient R of the preceding step S128 is larger than the cross correlation coefficient value R of its preceding step S124. If the answer is YES, then the control flow goes to step S130. On the other hand, if the answer is NO, then the control flow goes to step S131. At step S130, a present control voltage for the variable-reactance element 12-INT{(xno+2)/2} that is currently being processed is stored into the next-candidate table. At step S131, a negative-side control voltage (=selected value−Δ) of the higher-dimensional dichotomizing search method is set to the next variable-reactance element 12-[INT{(xno+2)/2}+1], and a control voltage signal is outputted. Further, at step S132, the parameter xno is incremented by one, and the parameter jalt is incremented by one, and thereafter, the control flow returns to step S103 of FIG. 15.

FIG. 17 shows a final process during one iteration. At step S141 of FIG. 17, upon reception of a received signal y(t), a cross correlation coefficient value R is calculated by using the above Equation (17). At step S142, it is judged whether or not the cross correlation coefficient R of the preceding step S141 is larger than the cross correlation coefficient value R of its preceding step S124. If the answer is YES, then the control flow goes to step S143. On the other hand, if the answer is NO, then the control flow goes to step S144. At step S143, the present control voltage for the variable-reactance element 12-INT{(xno+2)/2} that is currently being processed is stored into the next-candidate table. At step S144, the control voltages are set to the variable-reactance elements 12-1 to 12-6, respectively, based on the control voltage set in the next-candidate table. Subsequently, at step S145, the initial value setting process for the next iteration process is executed, namely, more specifically, the parameter xno is reset to zero, the parameter jalt is decremented by one, and the iteration parameter n is incremented by one. Thereafter, at step S146, it is judged whether or not n≦updateCount (denial of process end condition). If the answer is YES, then the control flow goes to step S147. On the other hand, if the answer is NO, then the control flow goes to step S148. At step S147, a negative-side control voltage of the higher-dimensional dichotomizing search method is set to the variable-reactance element 12-1 for the next iteration process. At step S148, a control voltage signal is outputted based on the above-set control voltage set. Thereafter, the control flow returns to step S103 of FIG. 15.

The present inventors performed a simulation by manufacturing by way of trial a control apparatus for the array antenna apparatus 100 of FIG. 14 according to the present preferred embodiment. Details and results of the simulation are shown below.

Figure 21:
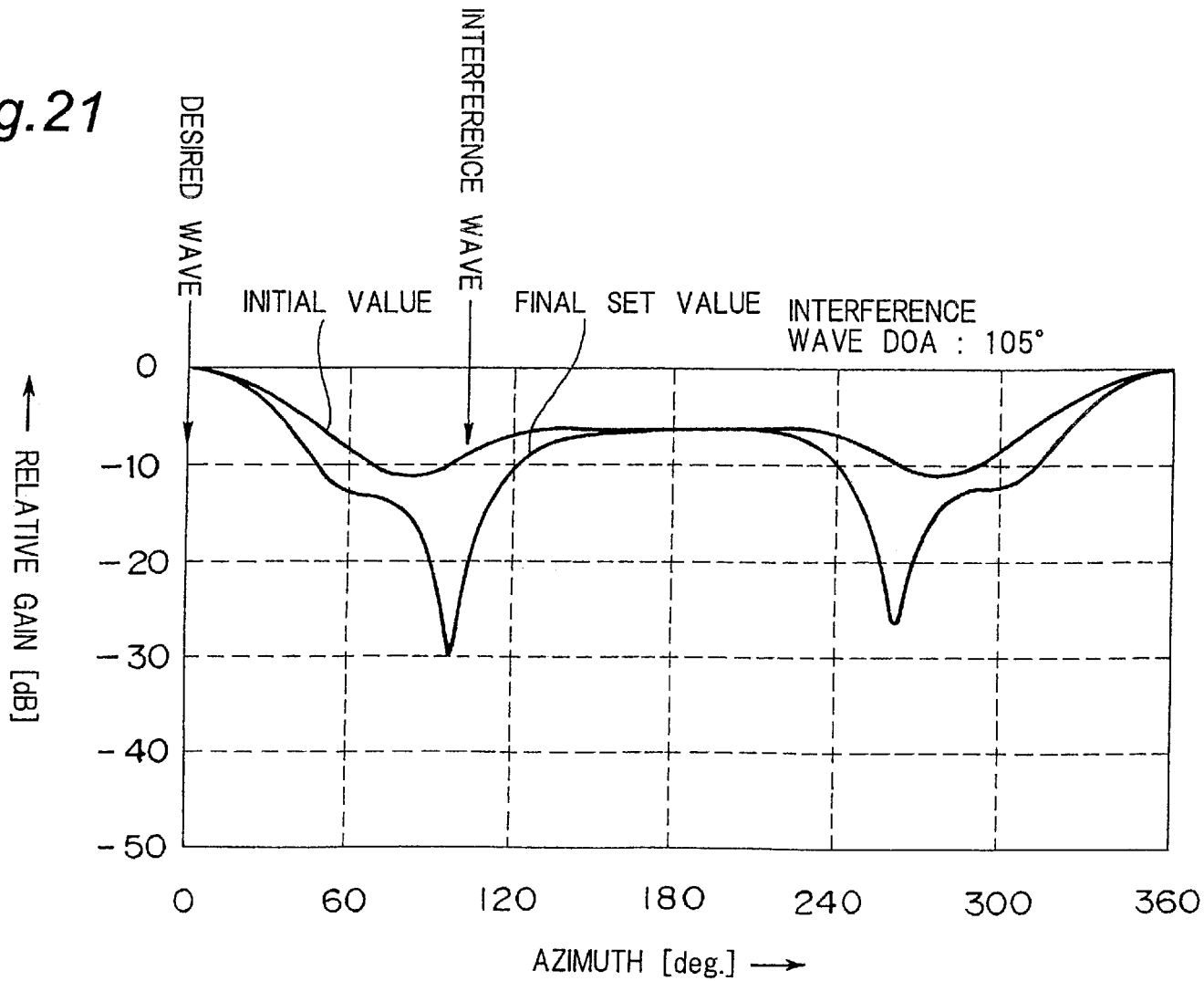
FIG. 21 is a graph showing simulation results of the array antenna control apparatus of FIG. 14 and showing a relative gain of initial value and final set value versus the azimuth when the DOA of the desired wave is 0° and the DOA of the interference wave is 105°.
Figure 22:
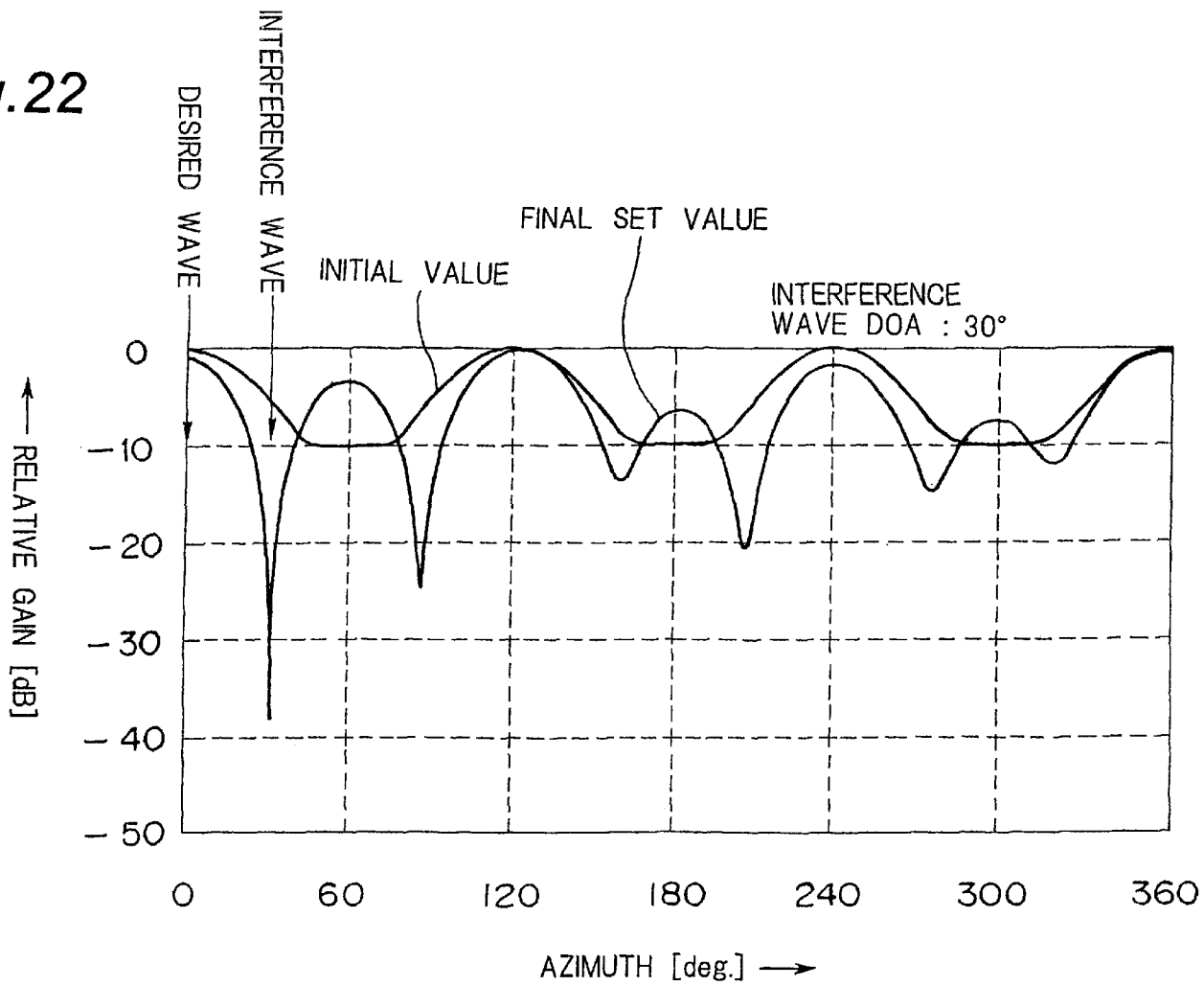
FIG. 22 is a graph showing simulation results of the array antenna control apparatus of FIG. 14 and showing a relative gain of initial value and final set value versus the azimuth when the DOA of the desired wave is 0° and the DOA of the interference wave is 30°.

First of all, the advantageous effects of initial value selection will be explained in detail. As an example of the initial value selection, FIGS. 21 and 22 shows the process of null point(s) formation in the cases where the interference-wave DOA (Direction Of Arrival) is 105° and 30°, respectively. The desired wave DOA is assumed to be 0° constant. In the case where the interference-wave DOA was 105°, a pattern 1 of the Table 3 was selected as initial values as shown in FIG. 21, and the following equation was obtained as the final solution of digital control voltage values:

$$k_v=[711, 2039, -1528, -88, -1368] \quad (30).$$

Whereas directions of arrival in the vicinity of 120° including 105° were those when the null point(s) would have been less easily formed without any selection of initial values, an output SINR (Signal to Interference-Noise Ratio) of about 18 dB was obtained by virtue of the selection of proper initial values.

In the case where the interference-wave DOA was 30°, a pattern 13 of the Table 3 was selected as initial values as shown in FIG. 22, and the following equation was obtained as the final solution:

$$k_v=[-611,2044,-513,1506,-767,1296] \quad (31).$$

In this case, the output SINR of about 23 dB was obtained. Also, with the pattern 13 used as initial values, a tendency can be seen that the null point(s) is more likely to be formed in multiple directions.

Next, the interference wave suppression performance for one interference wave will be explained below. With regard to the interference wave, the suppression performance of the array antenna apparatus 100 of the ESPAR antenna is adaptively controlled by the higher-dimensional dichotomizing search method, and convergence characteristics, are ascertained by a computer simulation. First of all, the case where one interference wave arrives is assumed. The desired wave DOA is set to a constant of 0°. It is also set that the input SIR (Signal to Interference Ratio)=0 dB, and that the input SNR (Signal to Noise Ratio)=30 dB. In the case of an angle θ, which is formed by the desired wave and the interference wave, it takes angles at steps of 15° from 30° to 180°, the convergence curves of the number of symbols of the training signal d(t) and the output SINR are shown. With respect to cases where the number of samples P is set to 700 symbols and 20 symbols, resulting in that convergence curves are shown in FIGS. 23 and 24, respectively, and then, these curves are compared with each other.

Figure 23:
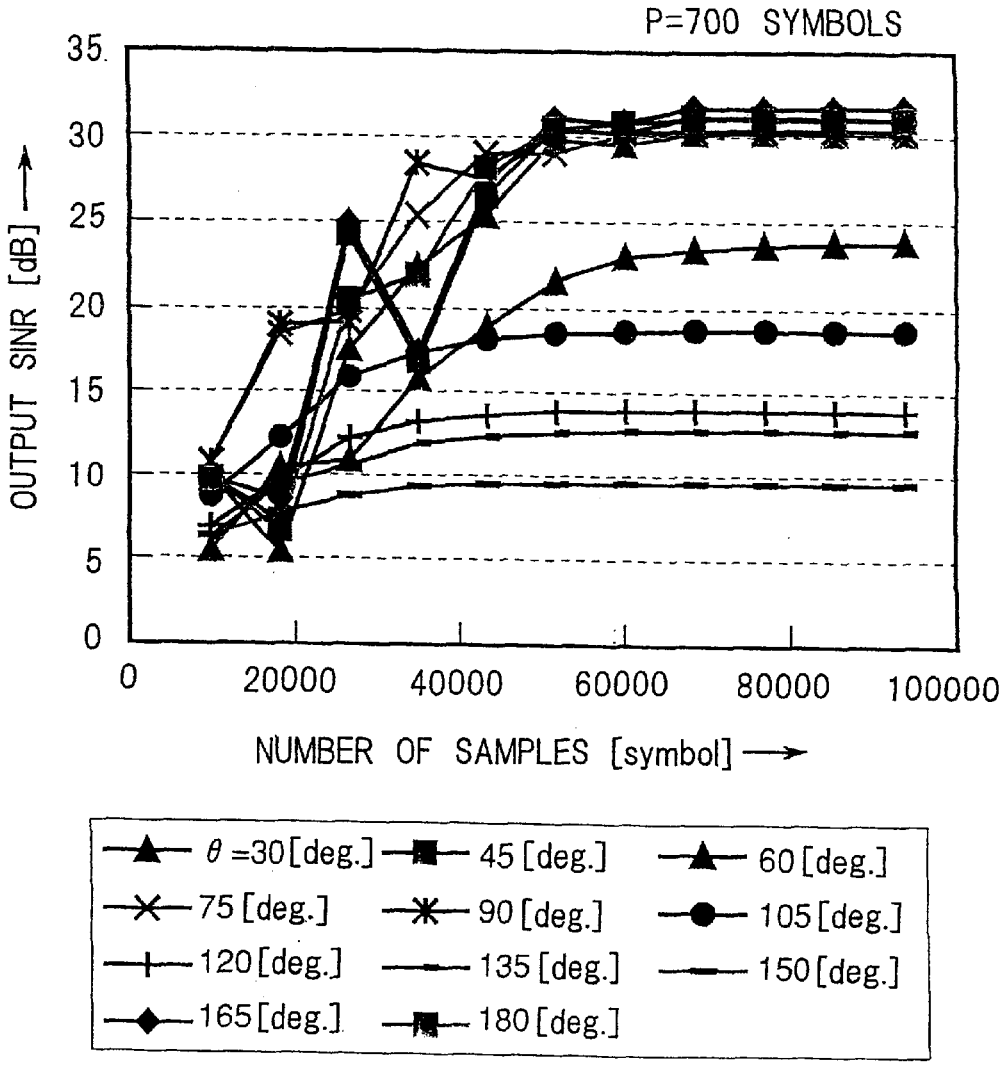
FIG. 23 is a graph showing simulation results of the array antenna control apparatus of FIG. 14 and showing an interference wave suppression performance for an output SINR versus the number of samples, with a parameter of an angle θ formed by the desired wave and the interference wave when the number of samples P for calculating the cross correlation coefficient is 700 symbols.

First of all, the characteristics in the case where the number of samples P=700 symbols are shown in FIG. 23. The number of 700 symbols was adopted in such meanings that the number of symbols would be long enough to suppress any calculation errors, as much as possible, which would occur in the calculation of the cross correlation coefficient due to a shortage of the number of samples.

As apparent from FIG. 23, it can be seen that the characteristic curves of almost all the angles showed an approach to a convergence after about six to seven iterations. Further, it can be seen that 5 dB or more was obtained by the advantageous effects of the operation of giving initial values at the first time iteration. At the angles θ=45°, 60°, 165° and 180°, their results at the second iteration were lower than those at the first iteration. It has been found out that this is a characteristic of the case where a pattern having lobes in three directions of alternately adjacent elements was selected at the first time initial value selection, and that the null(s) thereof became shallower at the second iteration. However, a deeper null point(s) was formed after about six times of iterations.

Figure 24:
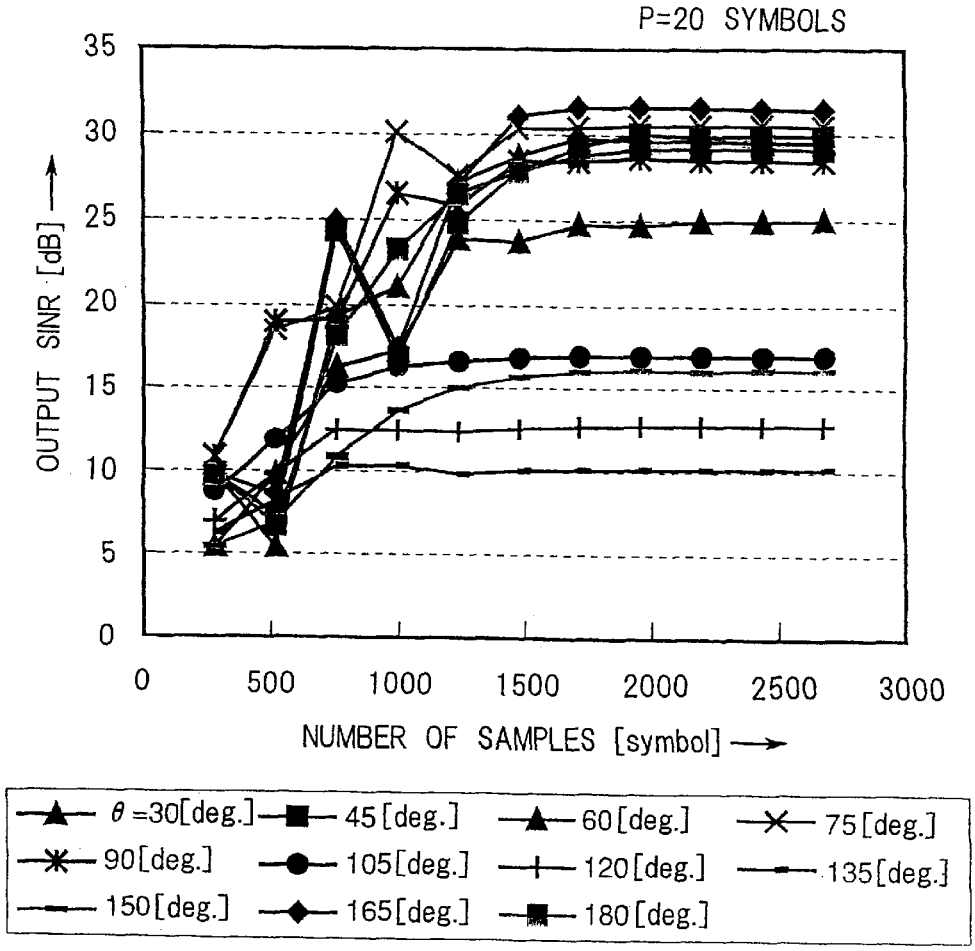
FIG. 24 is a graph showing simulation results of the array antenna control apparatus of FIG. 14 and showing an interference wave suppression performance for an output SINR versus the number of samples, with a parameter of an angle θ formed by the desired wave and the interference wave when the number of samples P for calculating the cross correlation coefficient is 20 symbols.

Next, the case where the number of samples P=20 symbols is shown in FIG. 24. In this case, requirements for radio ad hoc network experiments were assumed that the training signal length=1000 symbols and the output SINR=10 dB or more. For the number of samples P, 20 symbols were selected by calculation from the training signal length.

As apparent from FIG. 24, first of all, it can be seen that also in the case where the number of samples P=20 symbols, null points of 10 dB or more within 1000 symbols were formed with almost all the angles θ, satisfying the system requirements. Whereas the convergence tendency was similar to that of the case where the number of samples P=700 symbols, the convergence level of output SINR was slightly lower in the case of the lower number of samples, P=20 symbols, for calculation of the cross correlation coefficient, as a whole. This could be reasoned that some calculation errors due to the lower number of samples P symbols occurred on the way of convergence, causing inverses of the proper domains for selection to be selected.

In the convergence curves at the angles θ=30°, 75° and 150°, etc., there were some points at which the case of number of samples P=20 symbols showed more successful results, converse to the above. The causes of these could be attributed to mis-selection of initial values (first cause), and some twist of the curved surface (second cause). The case of angle θ=150° is due to the first cause, and the cases of θ=30° and 75° are due to the second cause. More specifically, the terms, "the mis-selection of the initial values", is referred to as a case where a first selected domain is different from a domain that allows a high correlation to be obtained finally. The terms, "the twist of the curved surface", is referred to as a case where a domain obtained by combining together ranges selected element to element is lower in correlation than the other candidate domains. The countermeasures for these causes are insufficient for the present.

Figure 25:
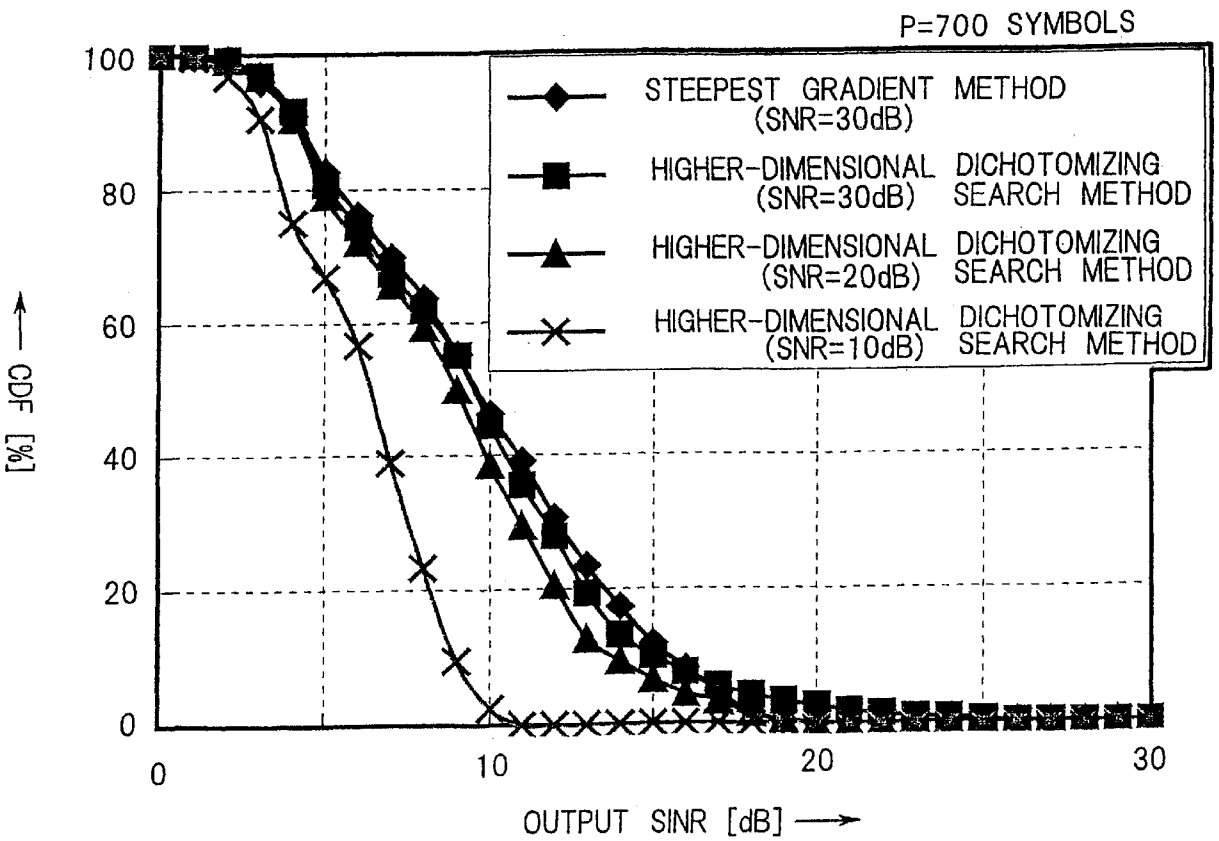
FIG. 25 is a graph showing simulation results of the higher-dimensional dichotomizing search method which is used in the array antenna control apparatus of FIG. 14 and a steepest gradient method according to a related art method, and showing a statistical estimation by CDF (Cumulative Distribution Function) versus an output SINR, with the use of 1000 sets of DOA of three interference waves, when the number of samples P for calculating the cross correlation coefficient is 700 symbols.
Figure 26:
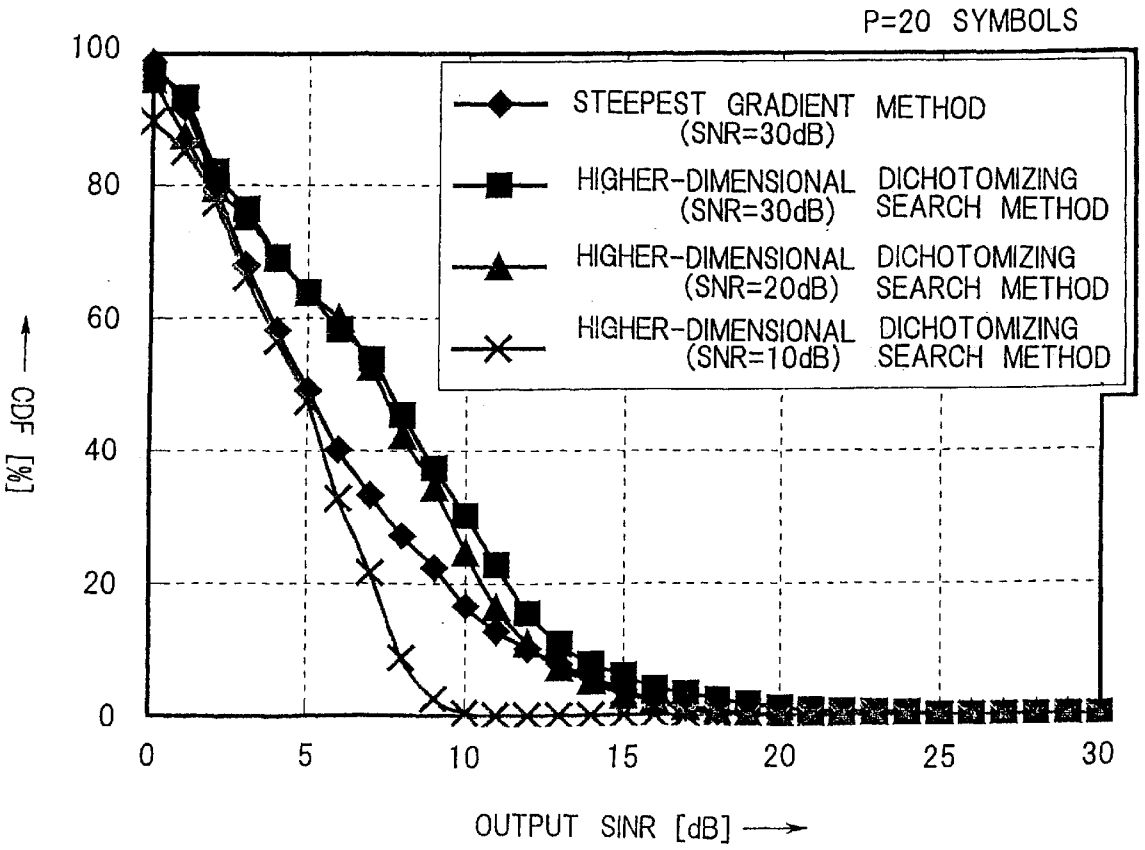
FIG. 26 is a graph showing simulation results of the higher-dimensional dichotomizing search method which is used in the array antenna control apparatus of FIG. 14 and a steepest gradient method according to a related art method, and showing a statistical estimation by CDF (Cumulative Distribution Function) versus an output SINR, with the use of 1000 sets of DOA of three interference waves, when the number of samples P for calculating the cross correlation coefficient is 20 symbols.

Further, the statistical estimation for three interference waves will be explained below. The statistical performance estimation of the higher-dimensional dichotomizing search method is performed in an environment with the arrival of three interference waves. The desired wave DOA is set to a constant of 15°, and the DOAs of three interference waves are randomly selected so that 1000 sets are prepared therefor. By using these 1000 sets of DOAs, The CDF (Cumulative Distribution Function) as shown in FIGS. 25 and 26 is calculated. The CDF is plotted to show the probability when the output SINR for a population of 1000 sets of interference-wave DOAs exceeds the output SINR of the horizontal axis. The interference-wave power was set to ⅓ of the desired wave power in each case so that the input SIR=0 dB.

Furthermore, a case where the number of samples P=700 symbols is shown in FIG. 25. The training signal was set to enough length as the time for convergence by the steepest gradient method, and results of the higher-dimensional dichotomizing search method were below those of the steepest gradient method. This could be reasoned that the steepest gradient method pursued a vicinity of an optimum solution, while the higher-dimensional dichotomizing search method did not reach a pursuit comparable to the steepest gradient method.

On the other hand, in the case of FIG. 26 where the number of samples P=20 symbols, the higher-dimensional dichotomizing search method showed results by using those of the steepest gradient method. The training signal was set to 1000 symbols. Accordingly, with such a training signal as 1000 symbols, it could be predicted that the steepest gradient method would be hard to reach an optimum solution, while the higher-dimensional dichotomizing search method would go faster toward the optimum solution or local solution.

As described hereinabove, the higher-dimensional dichotomizing search method according to the present preferred embodiment is a simple method that includes the steps of dichotomizing the domain and deciding that an optimum solution is present on one side on which a higher correlation is obtained. In this method, since the convergence of an optimum solution or local solution is approached by a relatively smaller number of iterations, there has been obtained a prospect that the method can be also applied to cases where the training signal is of 1000 symbols or so in actual radio ad hoc network experiments. Also, as a result of performing the statistical estimation in the environment that three interference waves arrive, it has been clarified that the higher-dimensional dichotomizing search method is more effective to short training signals. That is, in the control method for the ESPAR antenna apparatus, the convergence time can be remarkably reduced to a large extent, as compared with the related art method, and such adaptive control can be fulfilled that the main beam is directed toward a desired wave and the null(s) can be directed toward interference wave(s) with less amounts of calculation.

In the preferred embodiment described above, the operation goes through the steps of: dichotomizing a range of reactance values that can be taken by the respective variable-reactance elements 12; setting medians of the respective dichotomized ranges to the variable-reactance elements 12, respectively; upon this setting, calculating a predetermined cross correlation coefficient between a received signal and a training sequence signal, the received signal resulting when the training sequence signal contained in a radio signal transmitted from the remote transmitter is received by the array antenna, and the training sequence signal having been generated so as to have a signal pattern identical to that of a training sequence signal; selecting and setting, as initial values, the reactance values of the respective variable-reactance elements 12 corresponding to the larger cross correlation coefficient out of two cross correlation coefficients corresponding to the medians of the respective dichotomized ranges; thereafter, dichotomizing the range belonging to the selected reactance values; calculating the cross correlation coefficient upon the setting of the medians of the respective dichotomized ranges to the variable-reactance elements 12, respectively; and selecting and setting reactance values of the variable-reactance elements 12 corresponding to the larger cross correlation coefficient out of the two cross correlation coefficients corresponding to the medians of the respective dichotomized ranges. However, the present invention not being limited to this, the operation may also include the steps of: dividing a range of reactance values that can be taken by the respective variable-reactance elements 12; setting representative values of the resulting divided two ranges to the respective variable-reactance elements 12, respectively; upon this setting, calculating a predetermined cross correlation coefficient between a received signal and a training sequence signal, the received signal resulting when the training sequence signal contained in a radio signal transmitted from the remote transmitter is received by the array antenna, and the training sequence signal having been generated so as to have a signal pattern identical to that of a training sequence signal; selecting and setting, as initial values, reactance values of the respective variable-reactance elements 12 corresponding to the larger cross correlation coefficient out of two cross correlation coefficients corresponding to the representative values of the respective divided two ranges; thereafter, dividing the range belonging to the selected reactance values; calculating the cross correlation coefficient upon the setting of the representative values of the respective divided two ranges to the variable-reactance elements 12, respectively; and selecting and setting reactance values of the variable-reactance elements 12 corresponding to the larger cross correlation coefficient out of two cross correlation coefficients corresponding to the representative values of the respective divided two ranges.

THIRD PREFERRED EMBODIMENT

Figure 27:
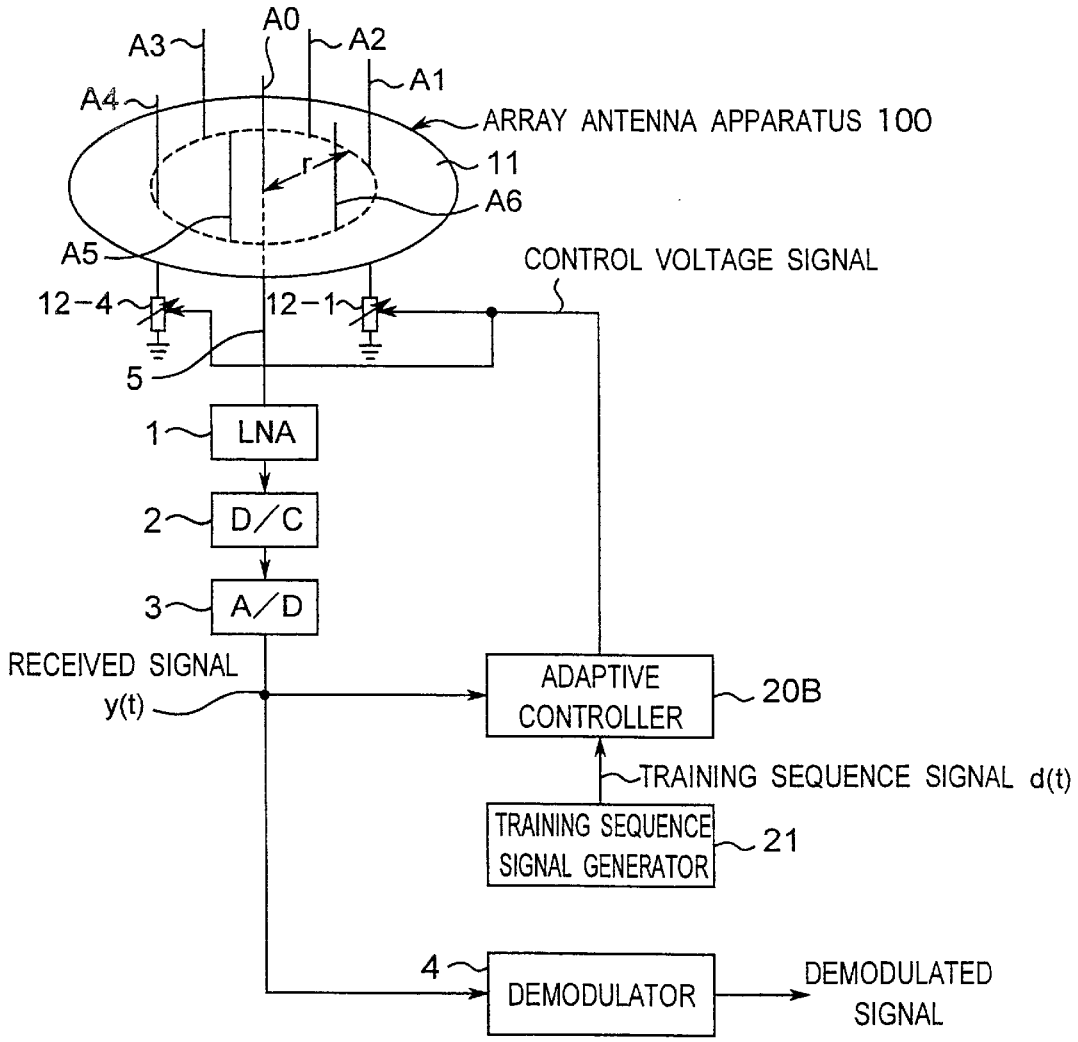
FIG. 27 is a block diagram showing a configuration of an array antenna control apparatus according to a third preferred embodiment of the present invention.

FIG. 27 is a block diagram showing a configuration of an array antenna control apparatus which is a third preferred embodiment according to the present invention. The array antenna control apparatus of the present preferred embodiment, as shown in FIG. 27, includes: an array antenna apparatus 100 which is the ESPAR antenna and which is equipped with one radiating element A0, six parasitic elements A1 to A6 having variable-reactance elements 12-1 to 12-6 loaded thereon, respectively; a grounding conductor 11; an adaptive controller 20B; and a training sequence signal generator 21. This third preferred embodiment is characterized in that the adaptive controller 20B is provided instead of the adaptive controller 20 shown in FIG. 1, as compared with the first preferred embodiment. The following description will be focused mainly on this difference point.

In this case, the adaptive controller 20B, which is implemented by a computer or the other digital computing machine as an example, is characterized in that, before starting radio communication by a demodulator 4, the adaptive controller 20B performs a later-described adaptive control process based on a received signal y(t), which is obtained by receiving a training sequence signal contained in a radio signal transmitted from a remote transmitter by the radiating element A0 of the array antenna apparatus 100, as well as based on a training sequence signal d(t) having a signal pattern identical to that of the above-mentioned training sequence signal and generated by the training sequence signal generator 21, and this leads to search for and set bias voltage values $V_m$ (m=1, 2, . . . , 6) to be applied to the variable-reactance elements 12-1 to 12-6, respectively, for directing the main beam of the array antenna apparatus 100 toward a desired wave and further directing the null(s) thereof toward an interference wave(s).

Figure 29:
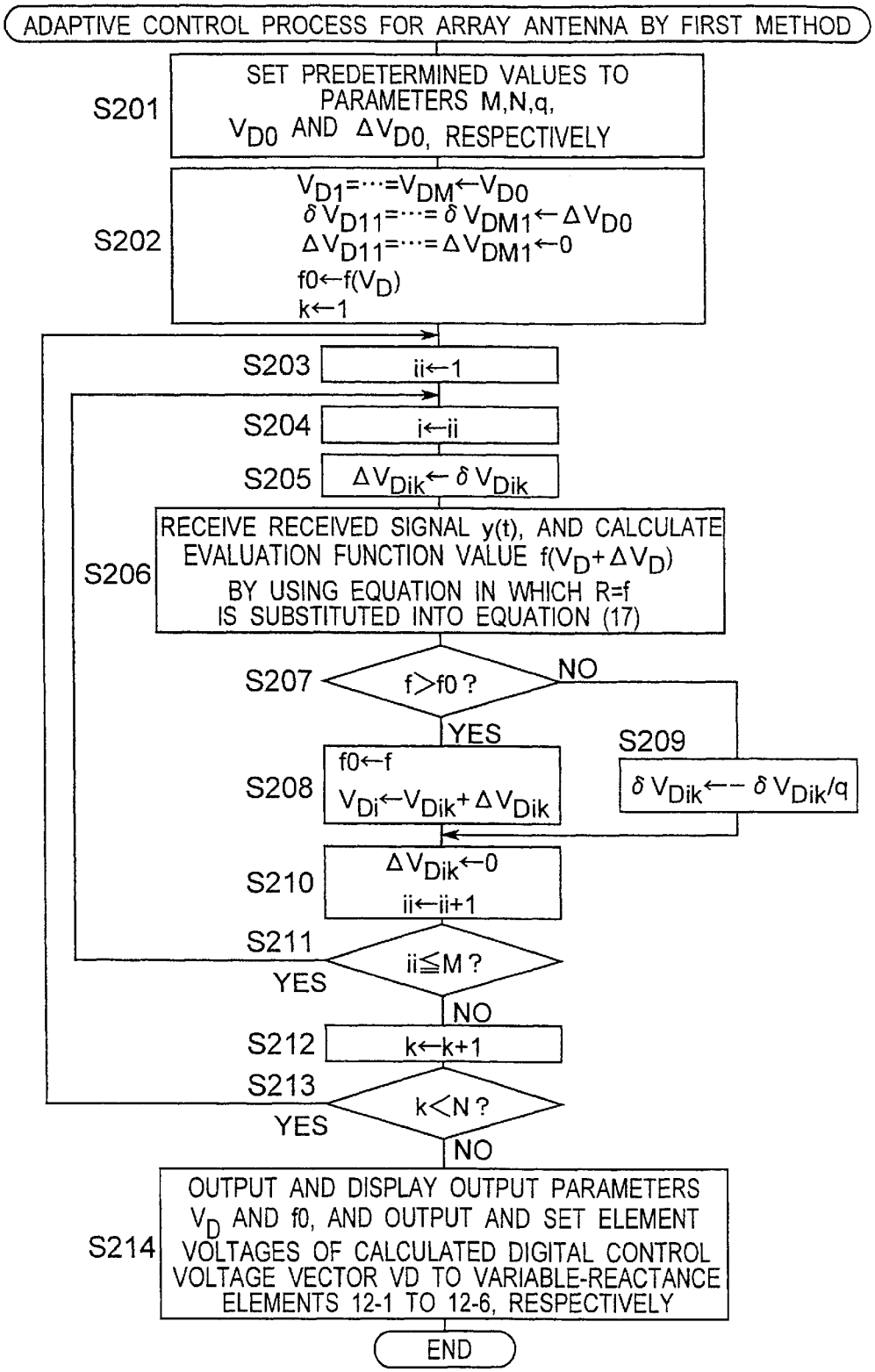
FIG. 29 is a flowchart showing an adaptive control process for the array antenna by a first method, which is executed by the adaptive controller 20B of FIG. 27.
Figure 30:
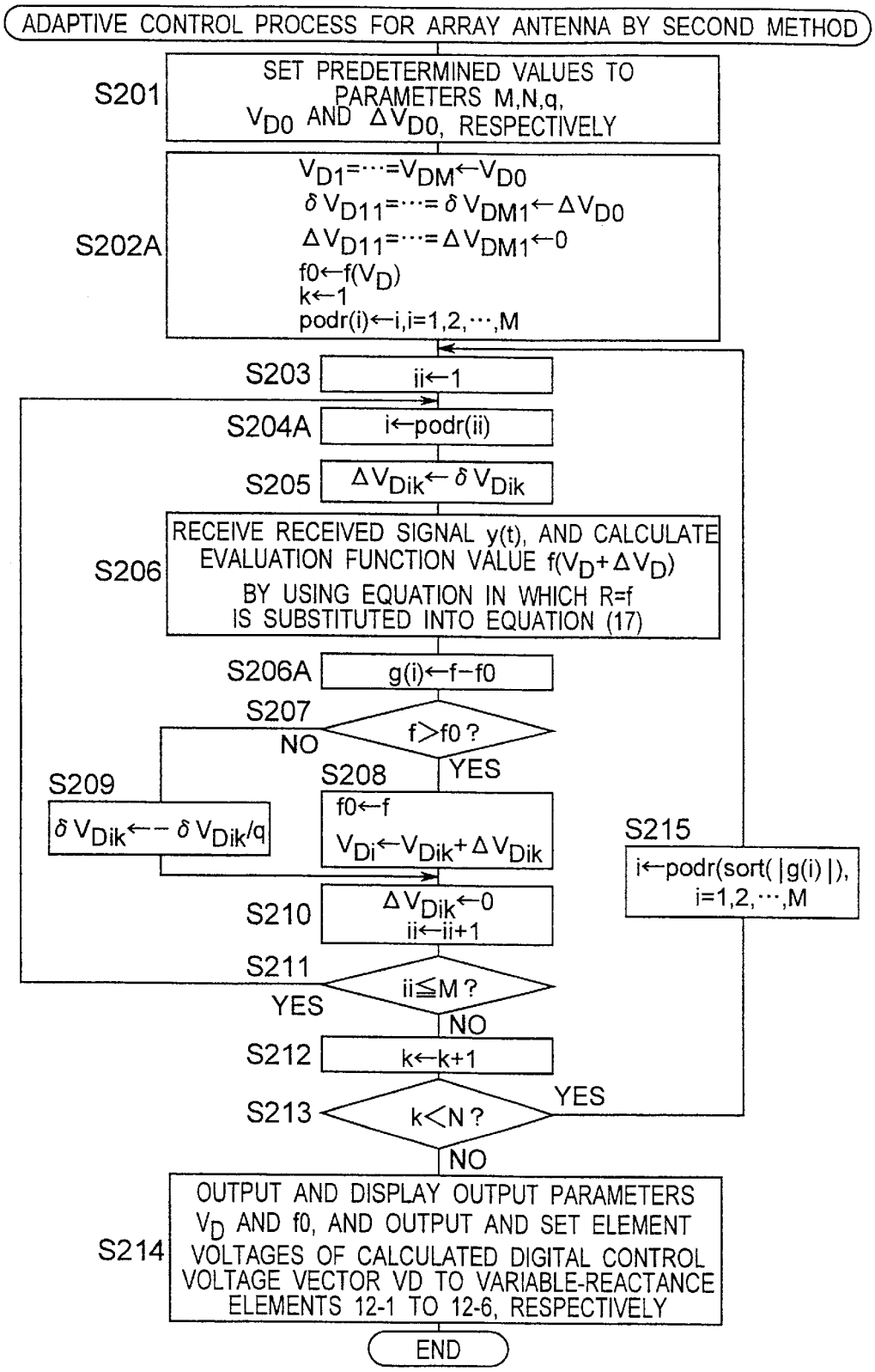
FIG. 30 is a flowchart showing an adaptive control process for the array antenna by a second method, which is executed by the adaptive controller 20B of FIG. 27.
Figure 31:
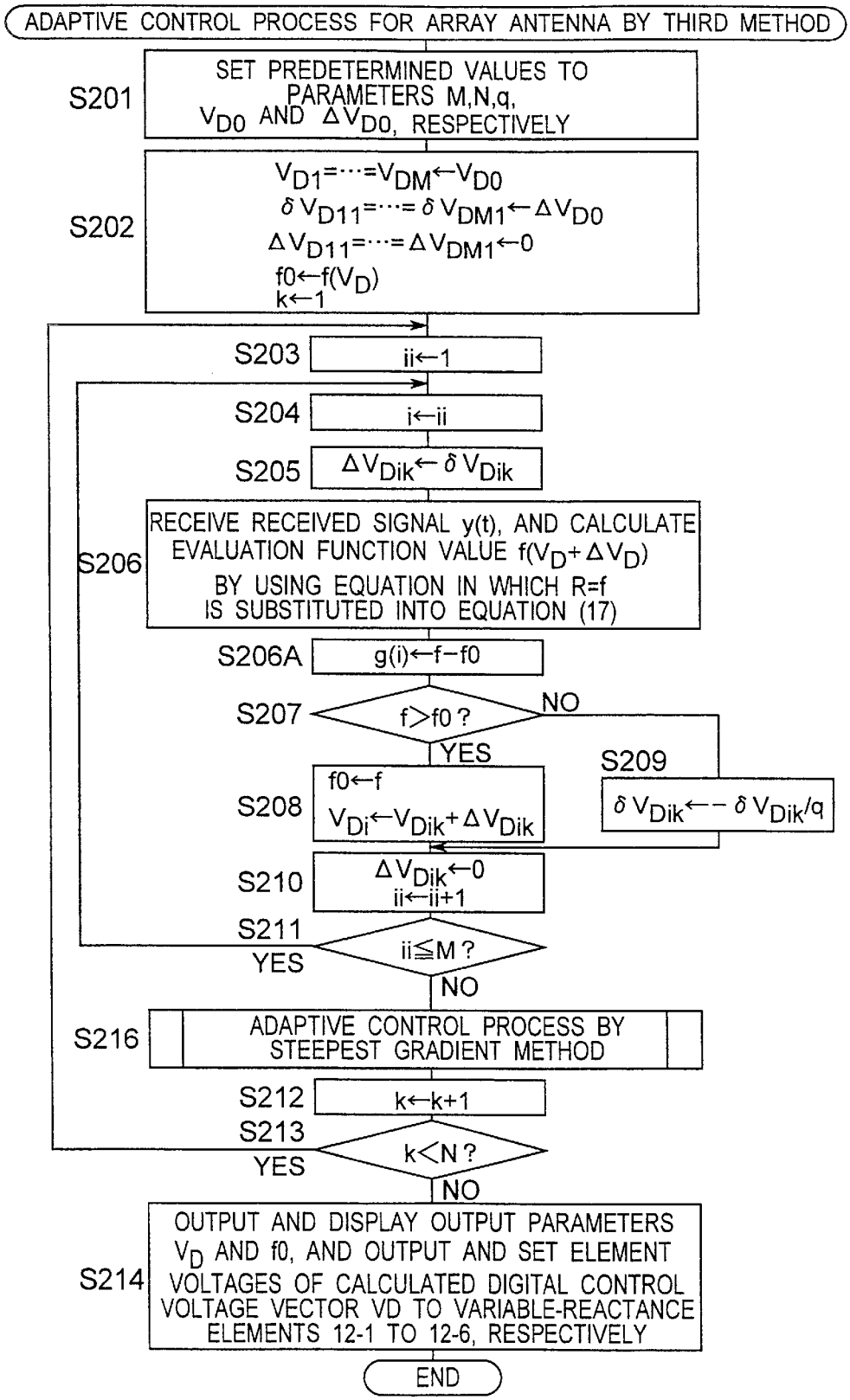
FIG. 31 is a flowchart showing an adaptive control process for the array antenna by a third method, which is executed by the adaptive controller 20B of FIG. 27.

In the present preferred embodiment, the adaptive controller 20B executes any one of the adaptive control processes of FIGS. 29, 30 and 31 to perturb reactance values of the respective variable-reactance elements 12-1 to 12-6 sequentially by a predetermined step width, and to calculate a predetermined estimation function value with respect to each of the reactance values. If the calculated estimation function value has shown an improvement before and after the perturbation, then the adaptive controller 20B sets the reactance values of the respective variable-reactance elements to post-perturbation values. On the other hand, if the calculated estimation function value has not shown any improvement before and after the perturbation, then the adaptive controller 20B sets the pre-perturbation values to the reactance values. Then the step width for the next iteration process with respect to reactance values of the variable-reactance elements that have shown no improvement of the estimation function value is decreased to one q-th (1/q) thereof by using the step-width change division factor q, and moreover the sign of the resulting step width is inverted. These steps are iteratively executed under the control by the adaptive controller 20B. By this operation, the adaptive controller 20B searches for bias voltage values $V_m$ of the respective variable-reactance elements 12-1 to 12-6 for directing the main beam of the array antenna apparatus 100 toward a desired wave and further directing the null(s) thereof toward an interference wave(s) so that the estimation function value becomes the maximum, and then outputs control voltage signals having the bias voltage values Vm found out as a result of the search to the variable-reactance elements 12-1 to 12-6, respectively, to set those bias voltage values. It is noted that the cross correlation coefficient of the estimation function f which is used in the adaptive controller 20B is defined by an equation in which R=f is assigned into the above-mentioned Equation (17).

In the present preferred embodiment, the bias voltage values $V_m$ to be applied to varactor diodes of the variable-reactance elements 12-1 to 12-6 are inputted and set in a form of control voltage signals derived from the adaptive controller 20B, as digital values of −2048 to 2047. These numerical values will hereinbelow be expressed as "a digital control voltage $V_D$". According to the brochure data of the varactor diodes used, the relationship between the digital control voltage $V_D$ and impedance $Z_V$ of the varactor diodes is expressed by the following equation:

$$Z_V=2e^{-7}V_D^2-5e^{-4}V_D+0.393-j(0.02067V_D+49.22) \quad (32)$$

The directivity of the array antenna apparatus 100 of the ESPAR antenna can be calculated by using an admittance matrix Y corresponding to the above impedance matrix Z (See, e.g., the Related art document 3 of Takashi Ohira et al., "Equivalent Weight Vector and Array Factor Formulation for ESPAR Antennas", Technical Report of IEICE, The Institute of Electronics, Information and Communication Engineers in Japan, A-P2000-44, SAT2000-41, MW2000-44, pp. 7–12, July, 2000). The values shown in FIG. 28 are used as the admittance matrix Y. By the symmetry of the element array, independent matrix elements $Y_{ij}$ are only six matrix elements $Y_{00}$, $Y_{01}$, $Y_{11}$, $Y_{12}$, $Y_{13}$ and $Y_{14}$ shown in FIG. 28. Also, the number M of parasitic elements of a seven-element ESPAR antenna is 6. It is necessary to measure some data from within a space stretched by a power M=6 of the number 4086 that can be taken by the digital control voltage $V_D$, and this leads to finding out six combinations of points having the highest possible estimation function values.

Next, a "variable-step search method", which will be described in detail below, is proposed as a method for controlling the above reactance vector. In summary, in this "variable-step search method", with a view for improving the convergence speed of ESPAR antenna control, a search for control voltages of the variable-reactance elements 12-1 to 12-6 is made for each one element. If the estimation function value has shown an improvement, then a voltage change is performed. On the other hand, if the estimation function value has shown no improvement, then the voltage change is not performed and the perturbation step width for the next iteration process with respect to the variable-reactance element that has shown no improvement is decreased to one q-th thereof (hereinafter, q is referred to as step-width change division factor, being a predetermined rational number), and moreover the direction of the step width is also reversed.

FIG. 29 is a flowchart showing an adaptive control process of the array antenna by a first method, which is executed by the adaptive controller 20B of FIG. 27. It is noted that various parameters which is used in the following adaptive control process are stored into a temporary storage memory provided in the adaptive controller 20B, and then, these parameters are used.

At step S201 of FIG. 29, predetermined values are set to parameters M, N, q, $V_{D0}$, $\Delta V_{D0}$, respectively. The reference character M denotes the number of elements of the parasitic elements A1 to A6, being 6 in the present preferred embodiment. Also, N denotes the total number of searches, and it is 8 as an example. Further, q is the step-width change division factor as described above, being 2 or 3 or the like as an example. Furthermore, $V_{D0}$ denotes an initial value of digital control voltage $V_D$ with $V_{D0}$=0 under the condition that the initial radiation pattern is an omni-pattern, and $\Delta V_{D0}$ is the initial value of step width upon changing the digital control voltage $V_D$. Next, at step S202, an initial value setting process is executed, namely, more specifically, the initial value $V_{D0}$ is set to the respective digital control voltages $V_{D1}=V_{D2}= \ldots =V_{DM}$ (hereinafter, a digital control voltage vector whose elements are the digital control voltage values $V_{D1}$, $V_{D2}$, . . . , $V_{DM}$ will be expressed as $V_D$ and, for the sake of simplicity of designation, referred to as digital control voltage) of the variable-reactance elements 12-1 to 12-6, respectively. Also, the initial value $\Delta V_{D0}$ is set to the step widths $\delta V_{D11}=\delta V_{D12}= \ldots =\delta V_{DM1}$ (which is a parameter for changing and storing the step width) of the respective digital control voltages $V_D$, and further the initial value 0 is set to the step widths $\Delta V_{D11}=\Delta V_{D12}= \ldots =\Delta V_{DM1}$ (which is a parameter for changing and storing the digital control voltage $V_D$) of the respective digital control voltages $V_D$ (hereinafter, a step width vector composed of elements of the step widths $\Delta V_{D11}$, $\Delta V_{D12}$, . . . , $\Delta V_{DM1}$ will be expressed as $\Delta V_D$, and for the sake of simplicity of designation, it is referred to as a step width). Furthermore, an estimation function value f ($V_D$) resulting from the digital control voltage $V_D$ is set to reference value f0 of the estimation function, so that an iteration parameter k is initialized to one.

Next, at step S203, an element parameter ii is initialized to one, and then at step S204, the value of the element parameter ii is assigned into an element parameter i. Then, at step S205, the step width $\delta V_{Dik}$ is assigned to the step width $\Delta V_{Dik}$, and at step S206, a received signal y(t) is received, then the estimation function f ($V_D+\Delta V_D$) for a digital control voltage ($V_D+\Delta V_D$) is calculated by using an equation obtained by assigning R=f into the Equation (17). Further, at step S207, it is judged whether or not f>f0, that is, it is judged whether or not the estimation function value has shown an improvement as compared with that of the preceding iteration. If the answer is YES, then the control flow goes to step S208. On the other hand, if the answer is NO, the control flow goes to step S209. At step S208, the above-calculated estimation function value f is assigned to the reference value f0 of the estimation function, and moreover the digital control voltage ($V_{Dik}+\Delta V_{Dik}$) is set to digital control voltage $V_{Di}$. On the other hand, at step S209, there has been shown no improvement of the estimation function value, so the step width $\delta V_{Dik}$ is divided by a rational number q and moreover the sign is changed, and then the resulting value is set to a step width step width $\delta V_{Dik}$. Subsequently, at step S210, the step width $\Delta V_{Dik}$ is set to zero, and the element parameter ii is incremented by one. Thereafter, at step S211, it is judged whether or not ii≦M. If the answer is YES, then the control flow returns to step S204, followed by further executing the process on another element.

On the other hand, if the answer is NO at step S211, the iteration parameter k is incremented by one at step S212, and at step S213, it is judged whether or not k<N, that is, it is judged whether or not the number of iterations k is below a preset total number of times of searches. If the answer is YES at step S213, the control flow return to step S203, followed by iteration of the above-described process. On the other hand, if the answer is NO at step S213, the output parameters $V_D$ and f0 are outputted at step S214, and they are displayed on a display unit or the like connected to the adaptive controller 20B. The calculated respective element voltages of the digital control voltage vector $V_D$ are outputted and set to the variable-reactance elements 12-1 to 12-6, respectively, and then, the adaptive control process is ended.

In the adaptive control process of FIG. 29, the number of elements M times of searches are performed for each iteration k. In each search, only the digital control voltage $V_{Di}$ of the i-th element is increased by the step width $\Delta V_{Dik}$, then the estimation function value f is calculated (at step S206). If the estimation function value f has been improved for the before-change reference value f0 (YES at step S207), then the digital control voltage $V_{Dik}$ is increased by the step width $\Delta V_{Dik}$ to move to a new digital control voltage $V_{Dik}$. Then, with the resulting estimation function value taken as a new reference value f0 (at step S208), the step width $\delta V_{Dik}$ is changed to a step width $\delta V_{Di(k+1)}$ for the next iteration k+1, followed by an iteration (without any change at step S209). On the other hand, if the estimation function f has not been improved (NO at step S207), then both the digital control voltage $V_{Dik}$ and the reference value f0 of the estimation function are kept at the values before the search (without any change at step S208). Then the step width $\delta V_{Dik}$ for the next iteration k+1 is decreased to one q-th thereof, and moreover its sign is inverted (step S209). It is noted here that q is a rational number, which is rounded off to a nearest integer in actual division at step S209. It is noted that although not shown, in the case of no improvement of the estimation function f at the first-time iteration, it is preferable that the step width for the second iteration is kept at the initial value $|\Delta V_{D0}|$ at the second iteration and only its sign is changed. Further, although not shown, when the digital control voltage $V_D$ has reached a limit value of the variable range, it is preferable that the direction of step is reversed to that of the limit value, that is, the sign of the step width is reversed to the sign of the step width with which the direction of step is directed toward the limit value, and moreover, the step width is decreased to one q-th thereof every iteration, followed by continuing the search. Since the step width is changed based on the preceding-iteration information as shown above, the method will be referred to as "variable-step search method".

The initial value $V_{D0}$ of the digital control voltage and the initial value $\Delta V_{D0}$ of the step width are input parameters. The step width needs to be large enough to reach the limit of the control range with N times of iterations. In the case where the first direction of step is reverse to that of a convergence value, in which the effective number of steps is N−1, if the initial value $\Delta V_{D0}$ is set to zero and the variable range is set to $-V_{Dmax} \leqq V_D \leqq V_{Dmax}$, then it is desirable that the initial value $\Delta V_{D0}$ of step width satisfies the following relationship:

$$\Delta V_{D0} \geqq V_{Dmax}/(N-1) \quad (33).$$

In this case, with the settings that $V_{Dmax}$=2048 and N=8, the lower limit value calculated by the Equation (33) is 293.

On the other hand, since a fine search cannot be made with the step width kept large as it is, the step width is decreased to one q-th thereof in the case where the estimation function value has not been improved. However, it is at the subsequent iteration that the decrease of the step width is executed. That is, two iterations are necessary for the step width to be one q-th thereof. Accordingly, an implementable minimum step width (resolution) $\Delta V_{Dmin}$ is given by the following equation:

$$\Delta V_{Dmin} = |\Delta V_{D0}|/q^{N/2} \quad (34).$$

In this connection, in the case of N=8, $\Delta V_{D0}$=1024, and the highest resolution with q=2 is 64, whereas the resolution with q=3 is improved to about 13. By increasing q like this, the final resolution can be heightened while the initial step width is kept so large. Indeed a method of decreasing the step width as a function of the number of iterations k could be also considered as another method for gradually improving the resolution, and this method could not yet afford changes according to the state of the estimation function. Also, another method of controlling the step width depending on the estimation function could be considered, however, the selection of a proper dependence parameter would matter since the estimation function value is dependent on the electric wave environment.

Figure 33:
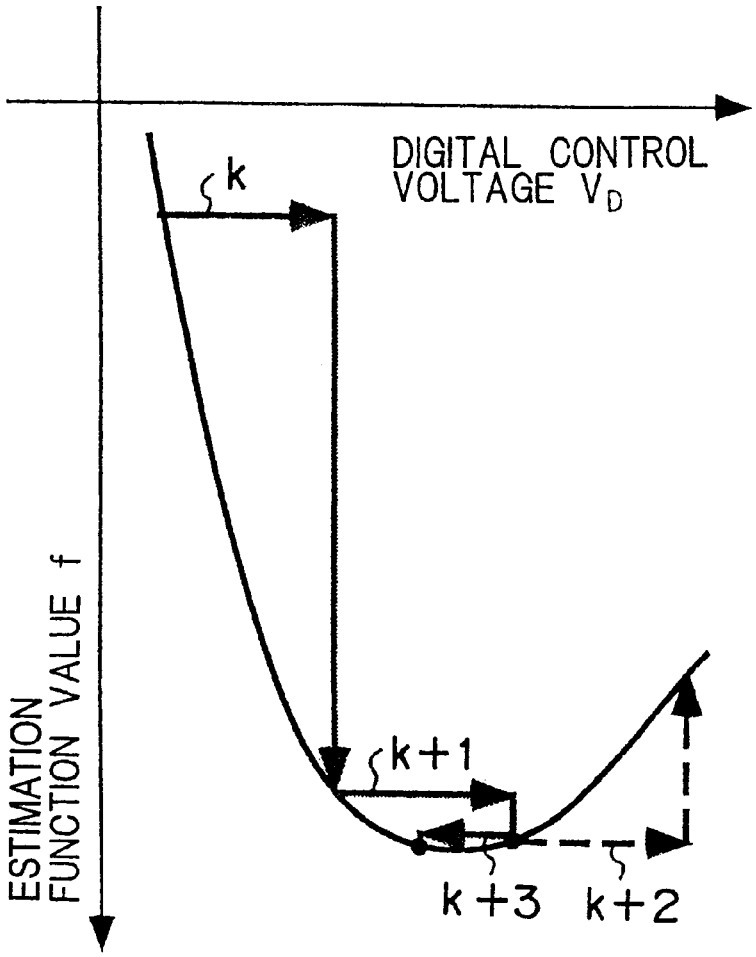
FIG. 33 is a view showing a state of a directional change and showing a state of a change in the estimation function value f versus a digital control voltage VD with a convergence of estimation function value in the adaptive control process for the array antenna, which is executed by the adaptive controller 20B of FIG. 27.
Figure 34:
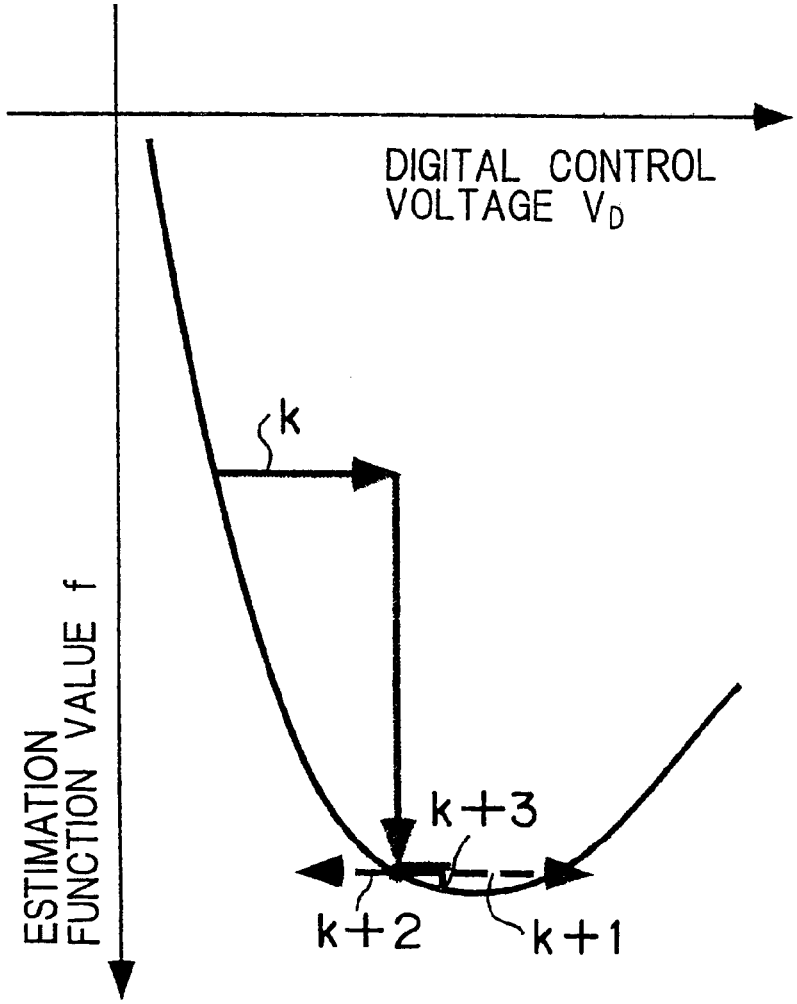
FIG. 34 is a view showing a state of another directional change and showing a state of a change in the estimation function value f versus the digital control voltage $V_D$ with a convergence of estimation function value in the adaptive control process for the array antenna, which is executed by the adaptive controller 20B of FIG. 27.
Figure 35:
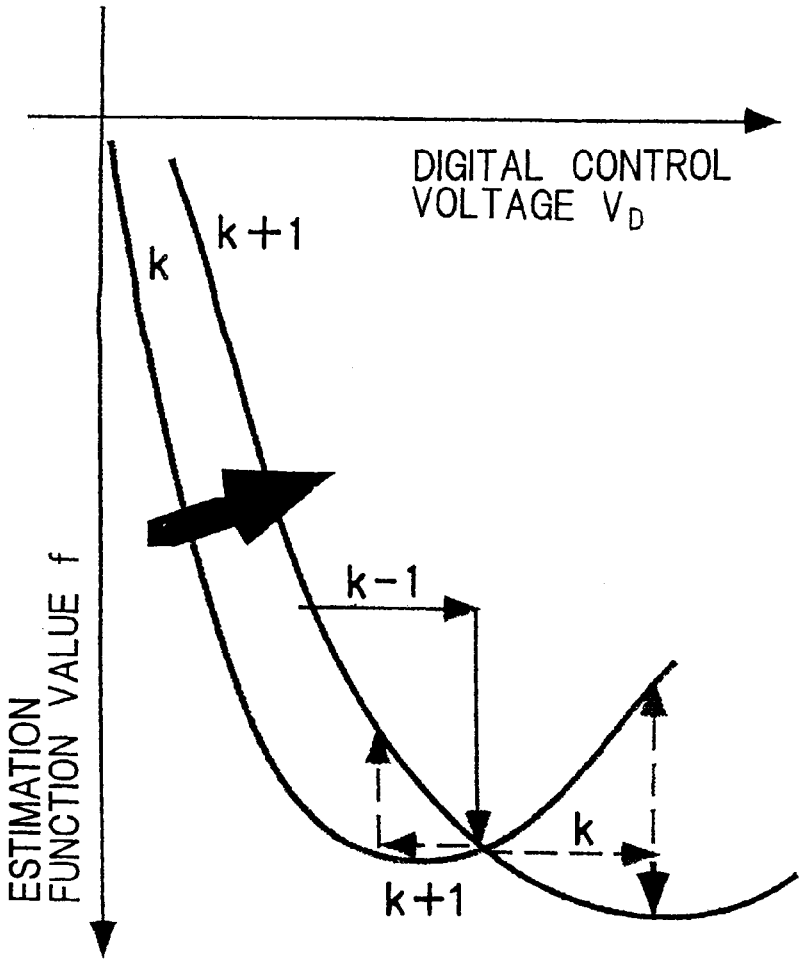
FIG. 35 is a view showing a state of a change in the estimation function and showing a state of a change in the estimation function value f versus the digital control voltage $V_D$ with a convergence of estimation function value in the adaptive control process for the array antenna, which is executed by the adaptive controller 20B of FIG. 27.

The states of improvement of the estimation function value are shown in FIGS. 33 to 35, each of which shows a state of searching for a local minimum point, where the estimation function f goes higher downward on the assumption that q=2. It is assumed that the number of elements M=1 and that the horizontal axis represents the digital control voltage $V_D$ of the element. Without any improvement of the estimation function value as a result of a search, in the present preferred embodiment, it is presumed that a wall of potential has been reached as shown in FIG. 33, and the step width is set to one q-th thereof, and then, the control flow turns back in the reverse direction. Without no improvement also in the reverse direction, the control flow goes toward a further reverse direction (original direction) as shown in FIG. 34. It should be noted that, since the number M of the variable-reactance elements 12-1 to 12-6 corresponding to the parasitic elements A1 to A6 is plural, the shape of the estimation function changes depending on the voltage changes in the other (M−1) variable-reactance elements as shown in FIG. 35. However, it is necessary to obtain P samples to remeasure the estimation function value. Further, the method of iterating the search on the element until the estimation function value is improved would result in a lowered arrival value of improvement (See later-described Appendix 1), so the preceding iteration information is used.

As shown above, the variable-step search method, although using information about increase or decrease of the estimation function, is capable of reflecting the magnitude of any change in the estimation function as well on the subsequent iteration. Indeed a method in which the reflection is made on the step width in a manner similar to that of the steepest gradient method could be conceived, however, a method in which the reflection is made into an order of elements to be searched for is proposed as a second method in the present preferred embodiment, since the convergence of each element does not need to be performed concurrently and in order that any increase of the computing time of step width is avoided. In contrast to this, the above-mentioned method in which the order of elements to be searched for is fixed is assumed as a first method.

FIG. 30 is a flowchart showing an adaptive control process of the array antenna by the second method, which is executed by the adaptive controller 20B of FIG. 27. The adaptive control process by the second method is different from the adaptive control process by the first method in that a search order parameter podr(') is utilized. In this case, the argument is a natural number showing a search order and the parameter value represents a parameter of the element to be searched for. The above difference point will be described more concretely as follows:

(1) At step S202 of FIG. 29, i is assigned into the search order parameter podr(i) (i=1, 2, . . . , M), where the step S202 is replaced by step S202A. More specifically, one is assigned into podr(1), two is assigned into podr(2), and so on. That is, ascending natural numbers are assigned into the search order parameter podr(i) as initial values, and this leads to representing the search order of the element parameter.

(2) The step S204 of FIG. 29 is replaced by step S204A in which the value of search order parameter podr(ii) is assigned into the element parameter i.

(3) Step S206A is inserted between step S206 and step S207 of FIG. 29. At step S206A, a gradient value (f−f0), which is a difference between the estimation function values, is calculated, and the calculated value is assigned into the gradient value g(i).

(4) If the answer is YES at step S213 of FIG. 29, the process of step S215 is ekecuted, followed by return to step S203. At step S215, a value of the search order parameter podr(sort(|g(i)|)) (i=1, 2, . . . , M) is assigned into i, where podr(sort(|g(i)|)) serves to sequentially output arguments (element parameters) i of gradient values g(i) whose absolute values have been sorted in a descending order (in an order in which larger values come earlier) among i 1, 2, . . . , M. The concrete method for calculating the search order parameter podr(sort(|g(i)|)) (i=1, 2, . . . , M) is as follows:

(a) If the argument (element parameter) i corresponding to the largest value of the absolute value |g(i)| (i=1, 2, . . . , M) of the gradient value is $i_1$, then podr(1)=$i_1$.

(b) If the argument (element parameter) i corresponding to the second largest value of the absolute value |g(i)| (i=1, 2, . . . , M) of the gradient value is $i_2$, then podr(2)=$i_2$.

(c) If the argument (element parameter) i corresponding to the third largest value of the absolute value |g(i)| (i=1, 2, . . . , M) of the gradient value is $i_3$, then podr(3)=$_3$.

(d) Thereafter, the calculation can be performed in a manner similar to that of above: podr(4)=$i_4$; podr(5)=$i_5$; . . . and; podr(M)=$i_M$.

That is, in the second method, a method of performing the search in an descending order of the magnitudes of changes in the estimation function value at the preceding iteration is used as the method for order selection. That is, this method is aimed at obtaining or earning the gain of improvement as much as possible before overlapping of changes in the estimation function value due to voltage changes in the other elements. Also, it is based on a presumption that even when the estimation function value has deteriorated, it would be improved in the opposite direction.

The present inventors executed a simulation of the array antenna control apparatus of FIG. 27, and its results are described below. As the estimation function of the array antenna for adaptive control, the output SINR that determines the received signal quality is practically used, and an estimation function f shown by an equation that R=f is assigned into the above Equation (17) for maximizing this output SINR is used in the present preferred embodiment. This estimation function f is effective for use in the cases where the desired wave or the interference wave(s) is unknown in actual communication systems.

Figure 36:
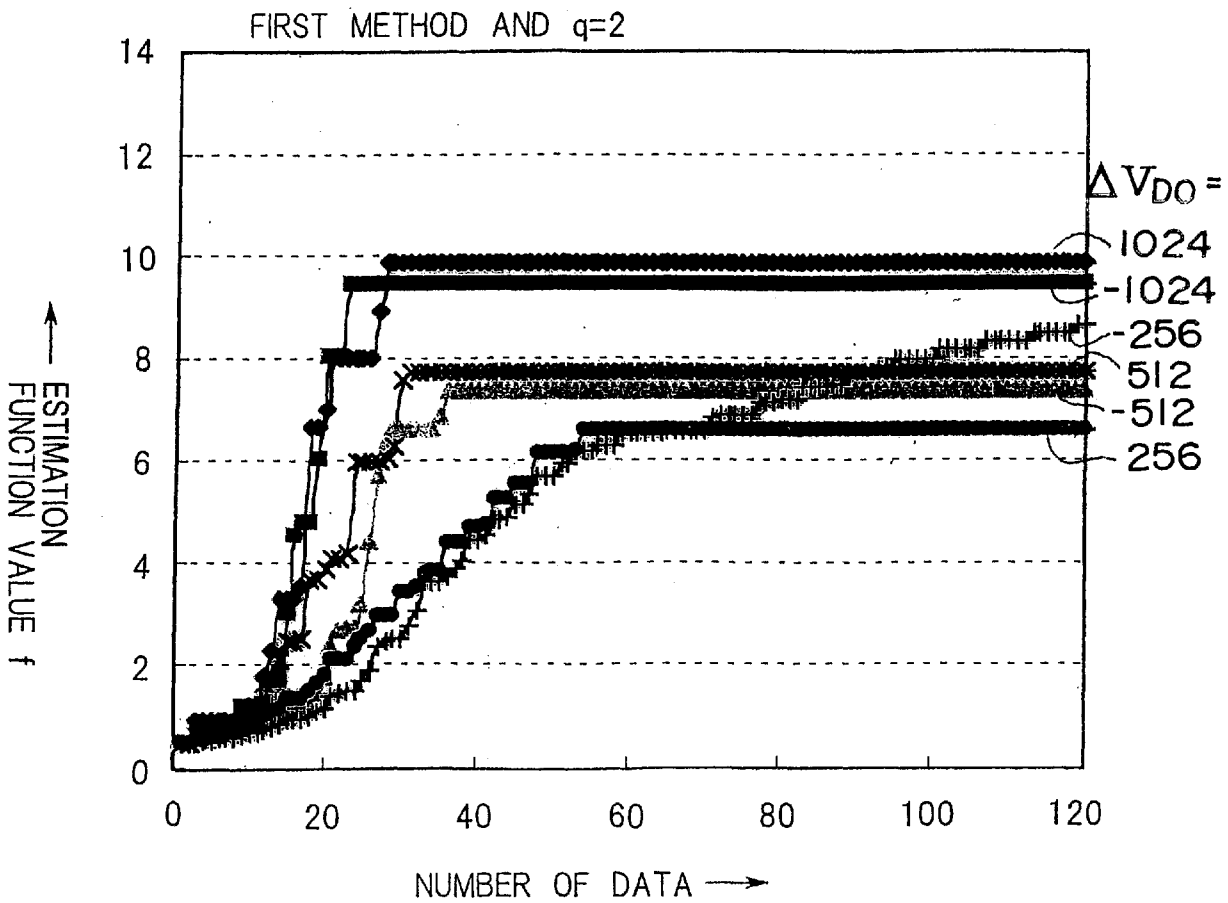
FIG. 36 is a graph showing simulation results showing a convergence state of the array antenna apparatus 100 of FIG. 27 and showing estimation function values versus the number of data with a step-width change division factor of q=2 by the first method.
Figure 37:
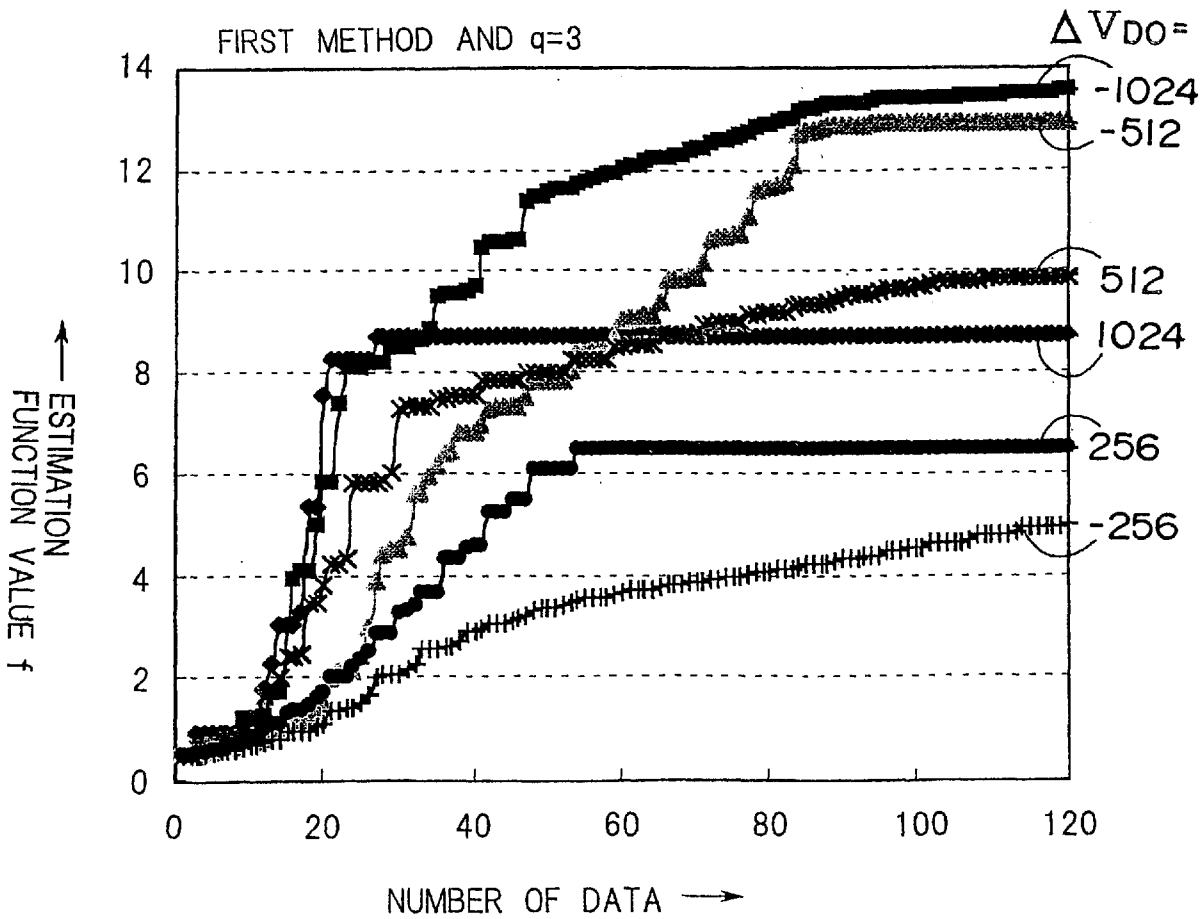
FIG. 37 is a graph showing simulation results showing a convergence state of the array antenna apparatus 100 of FIG. 27 and showing estimation function values versus the number of data with a step-width change division factor of q=3 by the first method.

However, in an implemental example shown below, the following estimation function f is used, where the effects of noise is excluded in order to examine the convergence performance of the proposed algorithm, and where the direction of arrival of the desired wave or the interference wave(s) is known. That is, as is specifically described here, while the estimation function of the Equation (17) is used in the preferred embodiment which is used in the actual communication system shown in FIG. 27, an estimation function shown by the following equation is used in an implemental example according to the simulation shown below:

$$f = \frac{|F(\phi_0)|^2}{\sum_{t=1}^{n_N} k_t |F(\phi_t)|^2} \quad (35),$$

where F corresponds to an array factor, $\phi_0$ represents a desired wave azimuth, and $\phi_t$ represents an interference wave azimuth. $k_t$ is a parameter for expressing the intensity of an interference wave or a desired wave, and $n_N$ is the number of interference waves. The array factor F is calculated by the following equations according to the Related art document 4 of Takashi Ohira, "Basic Theory on ESPAR Antenna Equivalent Weight Vector and Its Gradient", Technical Report of IEICE, The Institute of Electronics, Information and Communication Engineers in Japan, A-P2001-16, SAT2001-3, pp. 15–20, May 2001:

$$F = E \cdot u_0 \cdot a \quad (36), \text{ and}$$

$$E = (Y^{-1} + X)^{-1} \quad (37),$$

where $u_0$ is the above-mentioned vector, and "a" is a steering vector on the assumption that the phase center of the array antenna apparatus 100 is located in the radiating element A0. Since there are several maximal solutions for the estimation function f, the convergence value depends on the initial value. Whereas the selection of a proper initial value is effective in terms of practical use, all the initial values $V_{D0}$ of digital control voltage are set to zero in the present preferred embodiment in order to estimate the convergence performance of the algorithm. The number of interference waves is set to two waves, all of which are of the same signal level. That is, it is assumed that $n_N=2$ and that $k_1=k_2=1$. In this case, convergence curves of the estimation function by the first method under the settings that $\phi_0=0°$, $\phi_1=90°$ and $\phi_2=-135°$ are shown in FIGS. 36 and 37. Six steps of the scale in the horizontal axis correspond to one round search for all the elements, i.e., the unit of the number of iterations k. As apparent from FIGS. 36 and 37, the estimation function value is improved faster and comes to a converged state where the estimation function is no longer improved by iterations also faster in the case of larger initial step widths. In addition, the speed of convergent and the convergence value change depending on the sign of the initial step, making it hard to say which method is better at all times. The speed of convergence and the convergence value further change depending on the step-width change division factor q representing the speed of decrease of the step width as well.

Figure 38:
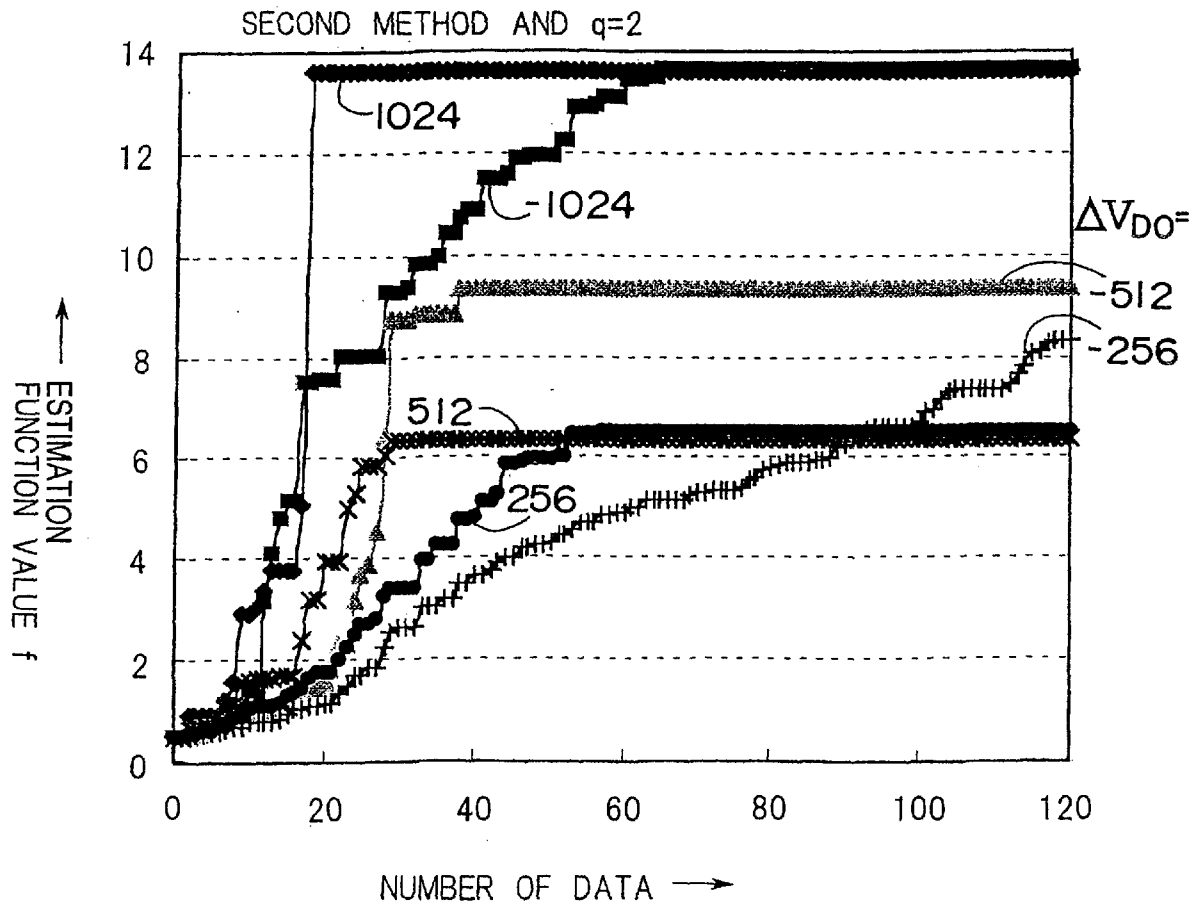
FIG. 38 is a graph showing simulation results showing a convergence state of the array antenna apparatus 100 of FIG. 27 and showing estimation function values versus the number of data with a step-width change division factor of q=2 by the second method.
Figure 39:
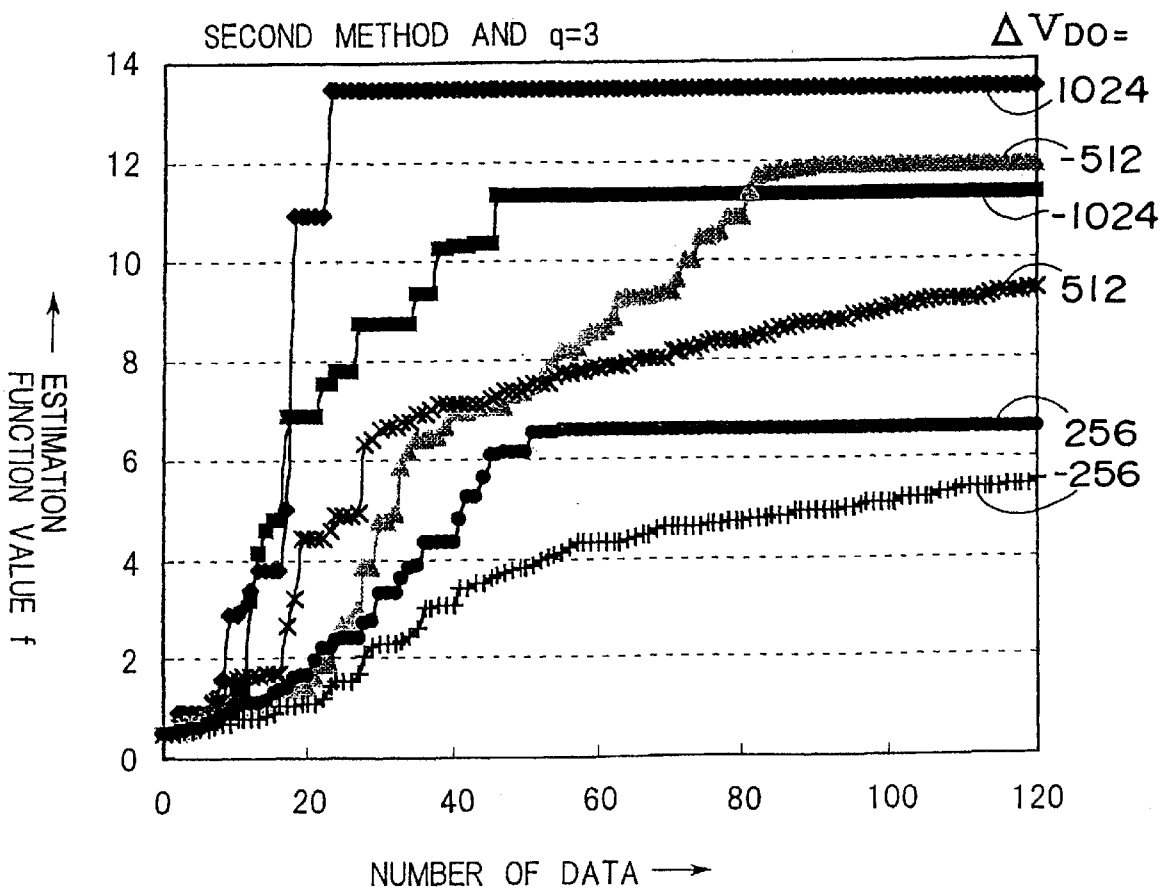
FIG. 39 is a graph showing simulation results showing a convergence state of the array antenna apparatus 100 of FIG. 27 and showing estimation function values versus the number of data with a step-width change division factor of q=3 by the second method.

Also, the calculation results by the second method, in which the search order is changed, are shown in FIGS. 38 and 39. The speed of convergence and the convergence value are different from results of the first method. As can be understood, it cannot necessarily be said that the estimation function value is improved faster by the second method. Given a step-width initial value $\Delta V_{D0}=256$, resulting differences of the convergence curves depending on the first and second methods or on the step-width change division factor q are small. Also, given a step-width initial value $\Delta V_{D0}=\pm 512$, the convergence value becomes higher with the step-width change division factor q=3 in both of the cases of the first and second methods. Among about 50 data, good estimation function values are obtained with an initial step width of ±1024, which is the largest thereamong. In this case, higher estimation function values can be obtained with the use of the second method, as compared with the first method. Further, higher estimation function values can be obtained with the step-width change division factor q=2, as compared with the step-width change division factor q=3.

Figure 40:
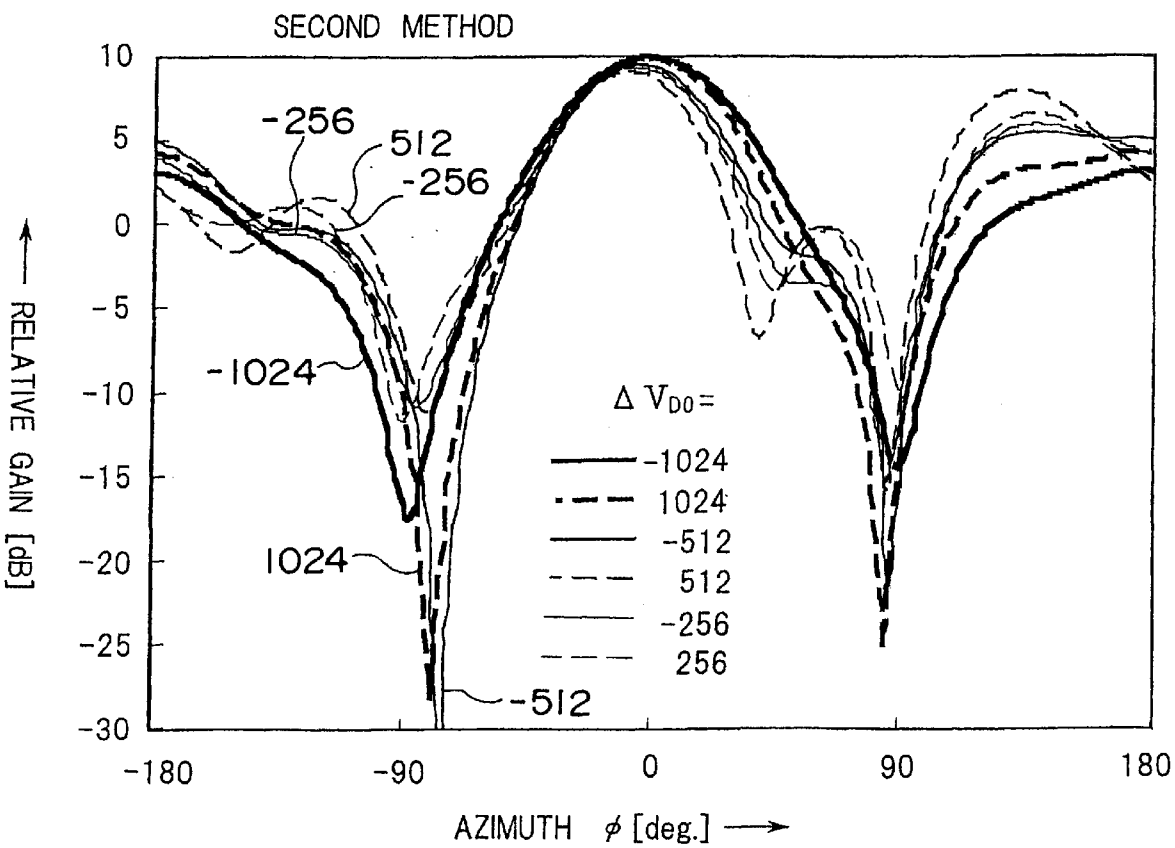
FIG. 40 is a graph showing a directivity gain pattern which is a convergence result by the second method in the array antenna apparatus 100 of 27.
Figure 41:
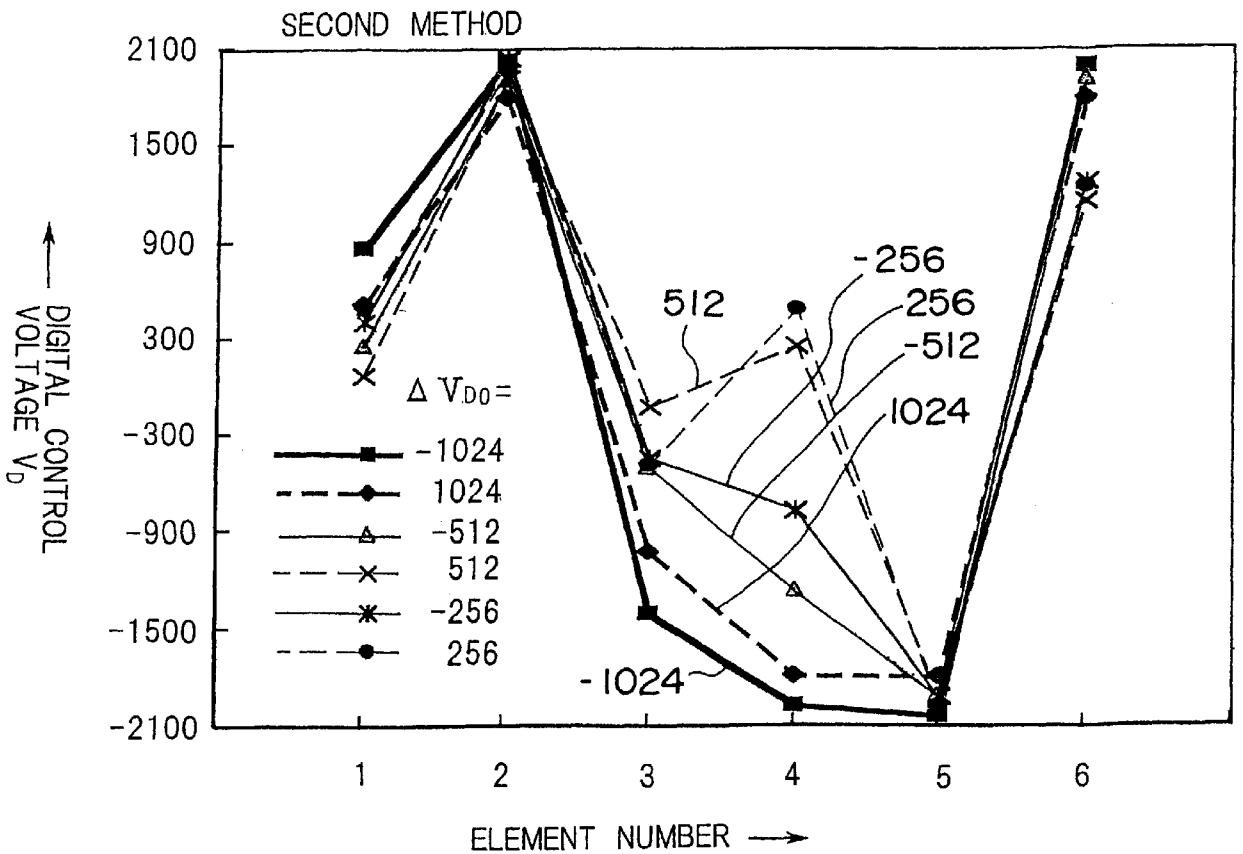
FIG. 41 is a graph showing a digital control voltage $V_D$ which is a convergence result by the second method in the array antenna apparatus 100 of FIG. 27.

A convergence radiation pattern with a number of data of 120 with the step-width change division factor q=2 in the second method is shown in FIG. 40. As apparent from FIG. 40, a beam is formed in a direction of 0° corresponding to the direction of a desired wave. Also, a null is formed in a direction of 90°, which is the direction of one interference wave. Another null is also formed, however, it is directed not toward the other interference-wave direction of −135° but toward a direction of about −90°. Further, a distribution of convergence values of the digital control voltage $V_D$ is shown in FIG. 41. As apparent from FIG. 41, all of the results show a coincident tendency, where differences in convergence value markedly appear in the third and fourth elements. Conversely speaking, under this electric-wave environment, it can be presumed that control voltage values of the other four elements are important.

Figure 42:
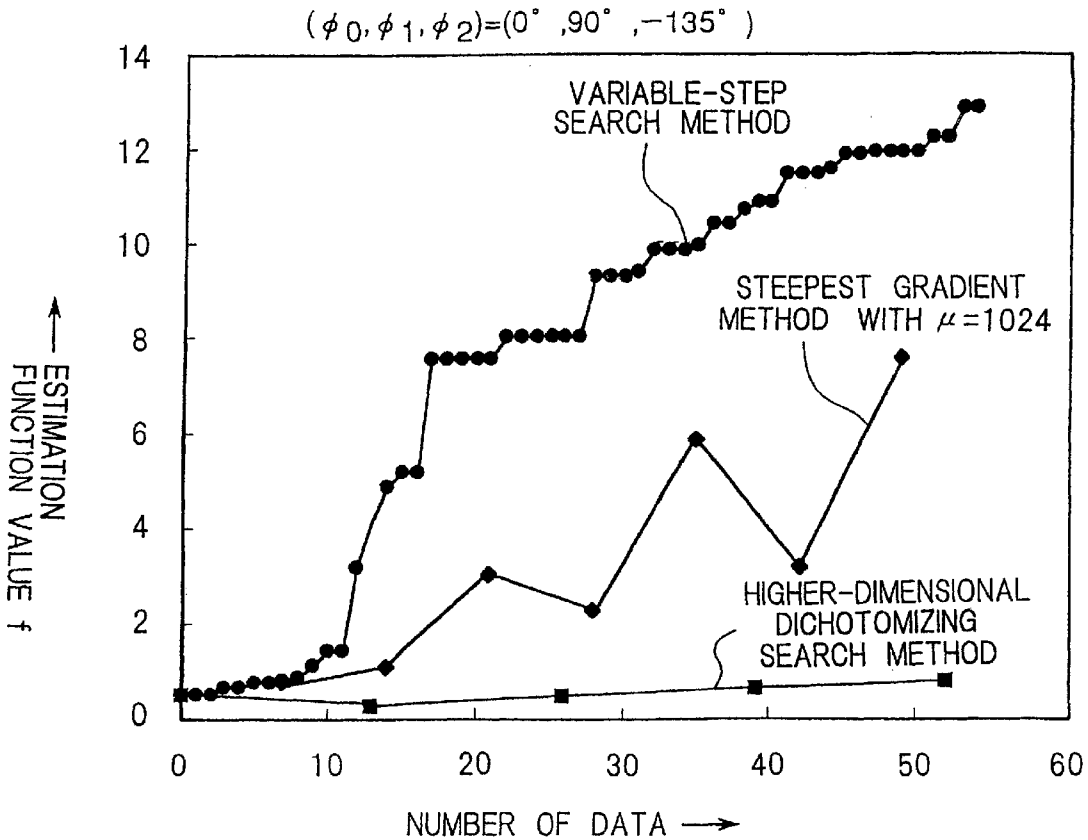
FIG. 42 is a graph showing an estimation function value versus a number of data, which is a simulation result showing convergence characteristics in a first case, when (desired wave azimuth $\phi_0$, first interference wave azimuth $\phi_1$, second interference wave azimuth $\phi_2$)=(0°, 90°, −135°), by a variable-step search method, a steepest gradient method, and a higher-dimensional dichotomizing search method for the array antenna apparatus 100 of FIG. 27.
Figure 43:
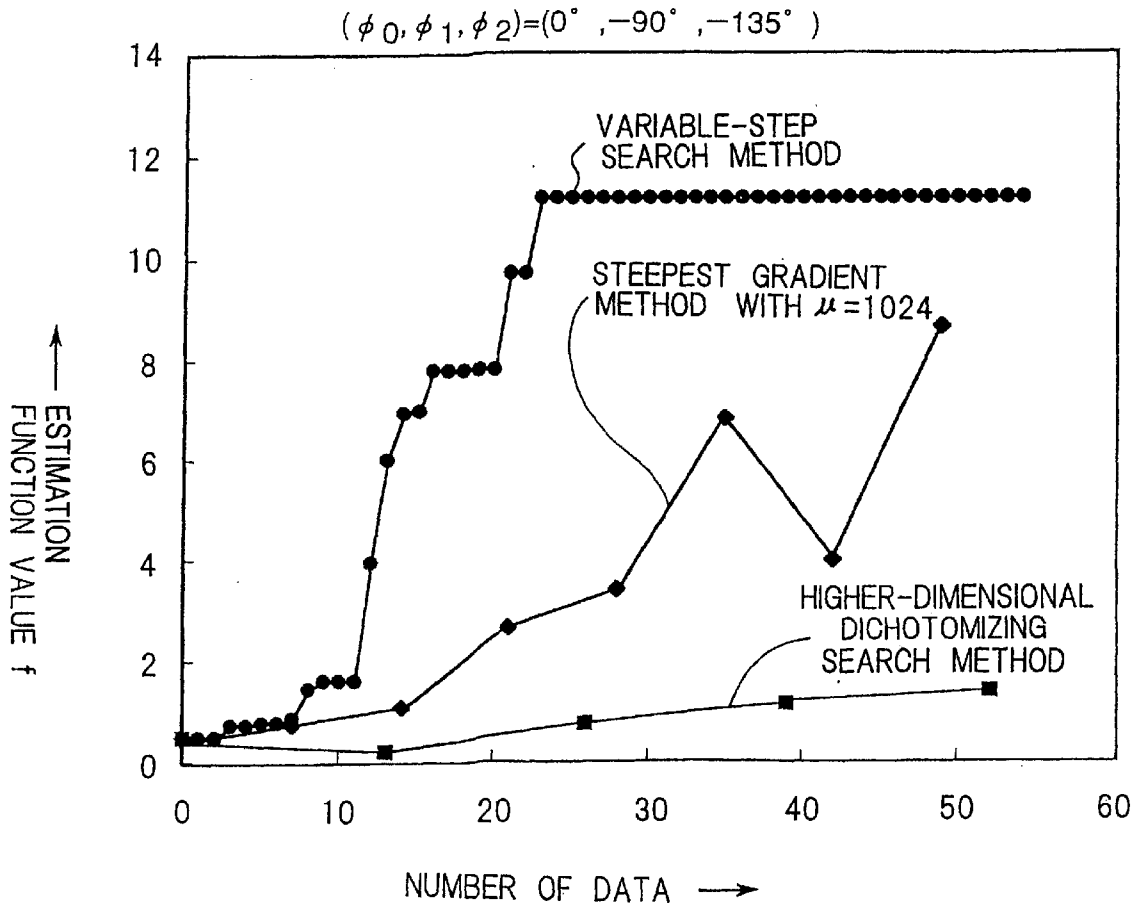
FIG. 43 is a graph showing an estimation function value versus a number of data, which is a simulation result showing convergence characteristics in a second case, when (desired wave azimuth $\phi_0$, first interference wave azimuth $\phi_1$, second interference wave azimuth $\phi_2$)=(0°, 90°, −135°), by the variable-step search method, the steepest gradient method and the higher-dimensional dichotomizing search method of the array antenna apparatus 100 of FIG. 27.
Figure 44:
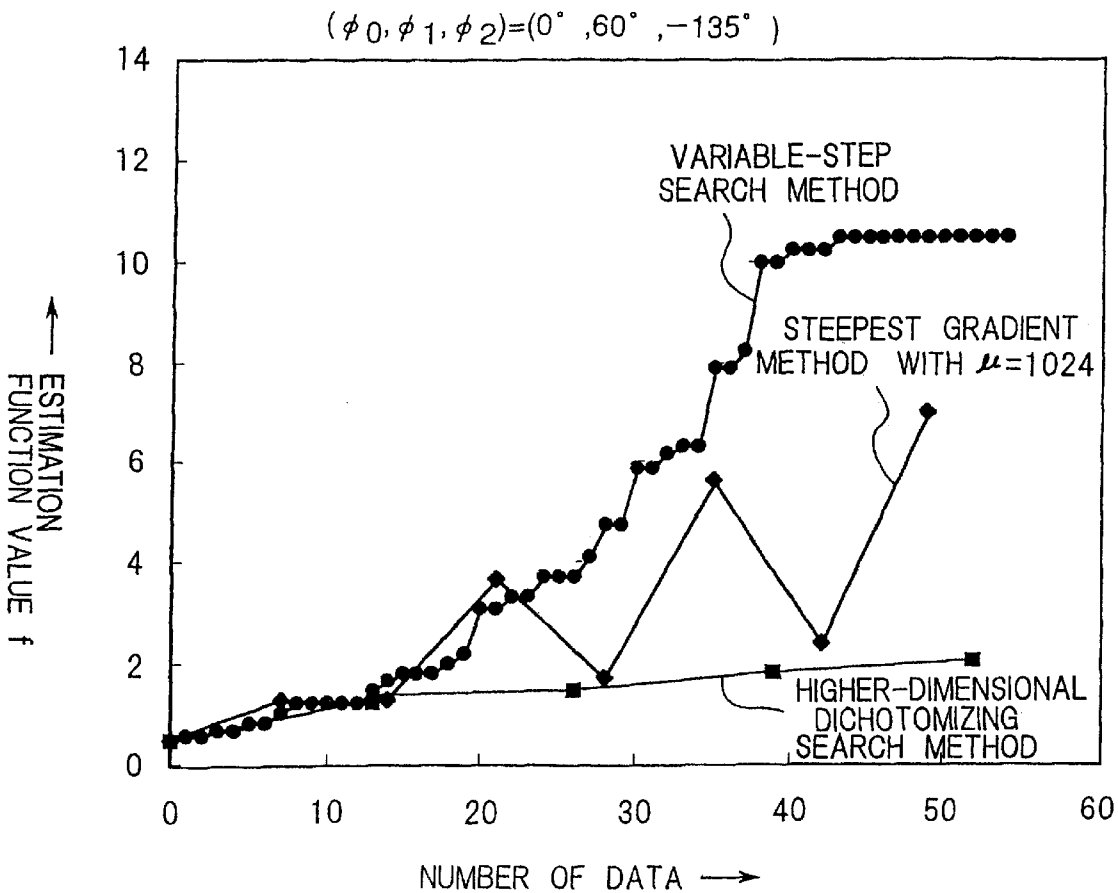
FIG. 44 is a graph showing an estimation function value versus a number of data, which is a simulation result showing convergence characteristics in a third case, when (desired wave azimuth $\phi_0$, first interference wave azimuth $\phi_1$, second interference wave azimuth $\phi_2$)=(0°, 60°, 135°), by the variable-step search method, the steepest gradient method and the higher-dimensional dichotomizing search method of the array antenna apparatus 100 of FIG. 27.

Next, a comparison is made among various adaptive control methods of the variable-step search method according to the present preferred embodiment, the steepest gradient method that is a related art, the higher-dimensional dichotomizing search method according to the second preferred embodiment, and the sequential random search method according to the first preferred embodiment. In this case, the convergence curves of up to about 50 data with which convergence has been nearly obtained are shown in FIGS. 42 to 44. In FIGS. 42 to 44, for comparison with the other algorithms, there is shown a case where the initial value $V_{D0}$ of digital control voltage is set to −1024, which yields worse results than 1024. Also, with $(\phi_0,\phi_1,\phi_2)=(0°, 90°,-135°)$, $(0°,90°,135°)$ and $(0°,60°,-135°)$ assumed as first case, second case, and third case, respectively, in this order, results of these cases are shown in FIGS. 42 to 44, respectively. In all the cases, estimation function values of 10 or more were obtained. In addition, since the initial value of estimation function value is 0.5, it follows that an improvement of SIR of about 13 dB would result if the desired wave and the interference wave are of the same signal intensity.

For comparison sake, the changes in the estimation function value by the steepest gradient method according to the related art and by the higher-dimensional dichotomizing search method are shown in superposition in FIGS. 42 to 44. Although the improved methods using proper initial patterns are proposed in these algorithms, the initial values are so assumed, for comparison, that the initial values $V_{D0}$ of digital control voltage are all zero in a manner similar to that of the case of the proposed method. It is noted that the sequential random search method, in which the convergence curve is not determined uniquely, is not shown in FIGS. 22 to 44. In the steepest gradient method, since calculation with respect to six data is required for calculation of the gradient during an iteration, an iteration point is obtained every seven data. On the other hand, in the higher-dimensional dichotomizing search method, since 12 data are required, an iteration point is obtained every 13 data. The numbers of iteration points in these two methods are smaller, as compared with the variable-step search method, and moreover the estimation function does not simply increase, thus making it understood that the improvement of the estimation function value is small. In the steepest gradient method, if the gradient is calculated by differentiation, the estimation function simply increases. However, actually, the difference calculation is substituted for the differential calculation. Since both of the difference width and the step width are set to as large as 1024 in order to prevent the estimation function value from stopping at a low local solution and to obtain an improvement with a smaller number of samples, the estimation function does not simply increase (See later-described Appendix 2).

A comparison among these steepest gradient method, higher-dimensional dichotomizing search method and sequential random search method is shown in FIG. 45. As apparent from FIG. 45, as a new data point required for the comparison of estimation function values, it is necessary to measure an intermediate point between both the sides of results of the preceding iteration in the higher-dimensional dichotomizing search method, whereas a comparison is made with a pre-change point in the other three methods, involving only data points on one side for new measurement. Also, in the steepest gradient method and the higher-dimensional dichotomizing search method, since a point other than the points that have undergone the search is taken as a new iteration point, one more data is required for one iteration, and an estimation function value of that point might be lower than the original point. In the variable-step search method as well in a manner similar to that of the sequential random search method, the estimation function value increases monotonously, and has such a degree of freedom as to remain in the same state without any improvement of the estimation function value.

As to the fineness of change (search) step, although the fineness thereof changes depending on the magnitude of gradient in the steepest gradient method, the fineness thereof can be made constant by normalizing the magnitude of gradient (See Appendix 2). In the higher-dimensional dichotomizing search method, the control space rapidly reduces to $1/2^M$ thereof. In the sequential random search method, the parameter setting for gradually decreasing the search range can be done. In the variable-step search method, the step width is decreased to one q-th thereof in response to the result of search that has shown no improvement. That is, the method has such a capability that the resolution improves with a rate adapted to an electric-wave environment.

Also, as to the direction of change (search), it is changed randomly in the sequential random search method. In the higher-dimensional dichotomizing search method, as a result of a comparison between new two states, a better direction is selected. In the variable-step search method, a direction is predicted based on preceding-iteration information. In the steepest gradient method, an optimum direction is calculated.

Further, a countermeasure process for a case where no improvement has been obtained by a one-round search will be explained. As described above, the variable-step search method, which involves a large number of iteration points and therefore a monotonous increase, is effective for obtaining an improvement of the estimation function value with a small number of data. However, from FIGS. 42 to 45, it can be seen that there is no improvement of the estimation function value in a six-element one-round search. By contrast, in the steepest gradient method and the higher-dimensional dichotomizing search method, a state necessarily moves to the next one after one iteration. Also, in actual communication systems, there is such a risk that a high estimation function value is obtained because of an error due to noise, making the state of the resulting voltage value locked. As one countermeasure process for the case where no improvement of the estimation function value is obtained after one round, it may be conceived to remeasure the estimation function value of a voltage state that is referenced for comparison and to make a re-comparison between the remeasured value and already obtained search values. In the present preferred embodiment, as a further step, difference data with respect to all the elements can be obtained in such a case. Performing the steepest gradient method based on the resulting data is proposed here as a third method.

Figure 32:
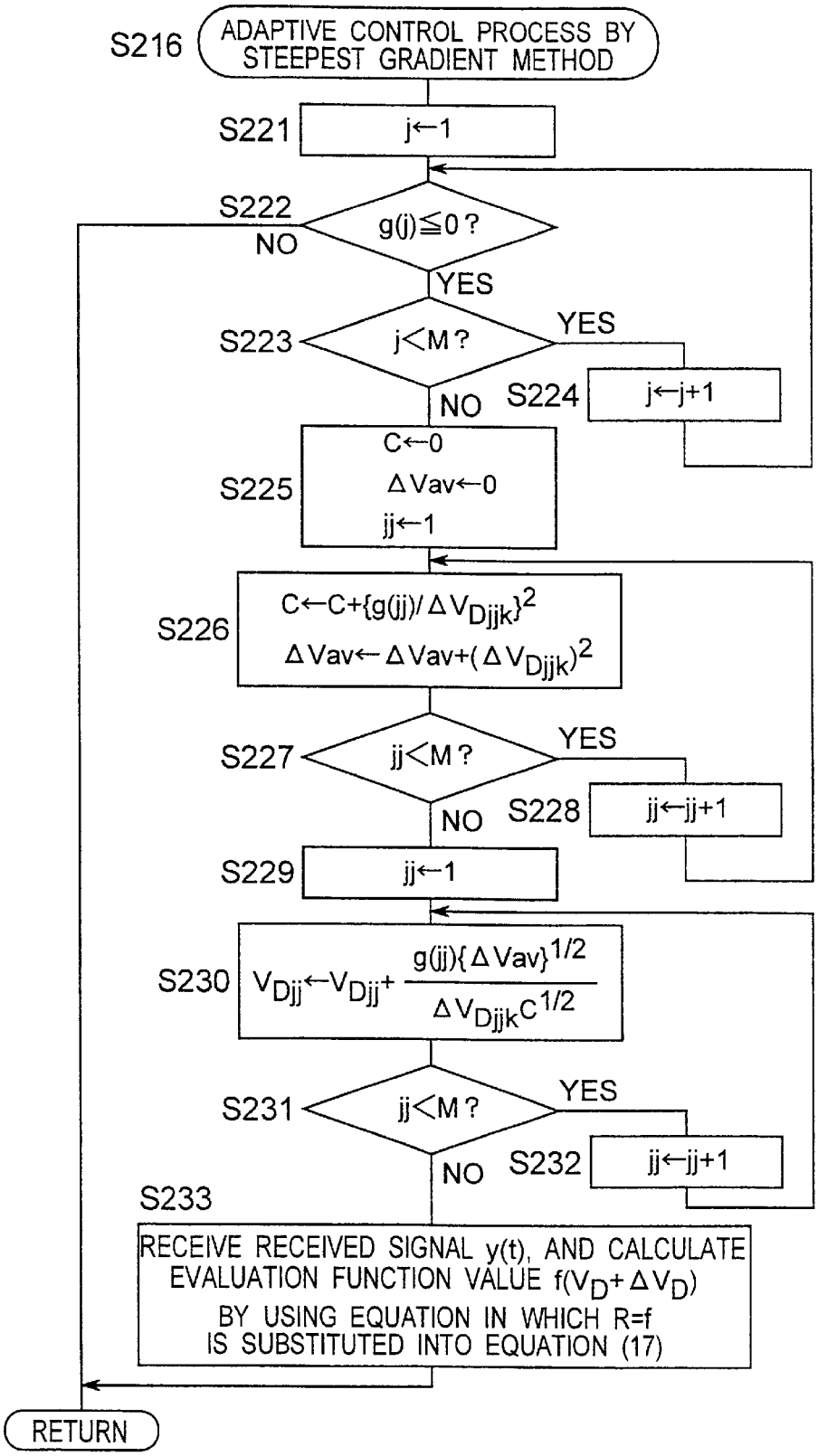
FIG. 32 is a flowchart showing an adaptive control process (S216) by the steepest gradient method, which is a subroutine of FIG. 31.

FIG. 31 is a flowchart showing an adaptive control process of the array antenna by the third method, which is executed by the adaptive controller 20B of FIG. 27. As compared with the first method of FIG. 29, the third method of FIG. 31 is different therefrom in the following points:

(1) Between steps S206 and S207, step S206A is inserted to calculate a gradient value g(i), in a manner similar to that of the second method; and (2) Between steps S211 and S212, an adaptive control process (step S216) by using the steepest gradient method, which is a subroutine shown in FIG. 32, is inserted.

In the adaptive control process by the steepest gradient method of FIG. 32, the processes of steps S222 to S224 are those for checking all the elements to determine whether the estimation function value has not been improved. If it has not been improved, then the processes of steps S225 and the following by the actual steepest gradient method are executed.

The element parameter j is initialized to one at step S221 of FIG. 32, and it is judged at step S222 whether or not gradient $g(j) \leqq 0$. If the answer is NO, then the control flow return to the original main routine. On the other hand, if it is YES, then the control flow goes to step S223. At step S223, it is judged whether or not element parameter j<M. If the answer is YES, the element parameter j is incremented by one at step S224, then the control flow returns to step S222. On the other hand, if the answer at step S223 is NO, the initial setting process is executed at step S225, then a convergence control variable C is initialized to zero, a step-width average value ΔVav is initialized to zero, and an element parameter jj is initialized to one. Then, at step S226, the convergence control variable C according to the steepest gradient method and the step-width average value ΔVav are calculated and assigned as shown in the following equations:

$$C \leftarrow C + \{g(jj)/\Delta V_{Djjk}\}^2 \quad (38), \text{ and}$$

$$\Delta V_{av} \leftarrow \Delta V_{av} + (\Delta V_{Djjk})^2 \quad (39).$$

Next, at step S227, it is judged whether or not element parameter jj<M. If the answer is YES, the element parameter jj is incremented by one at step S228, then the control flow returns to step S226. On the other hand, if No at step S227, the element parameter jj is initialized to one at step S229, and then, at step S230, the digital control voltage $V_{Djj}$ for each element is calculated and assigned as shown by the following equation:

$$V_{Djj} \leftarrow V_{Djj} + \frac{g(jj)\{\Delta V_{av}\}^{\frac{1}{2}}}{\Delta V_{Djjk} C^{\frac{1}{2}}} \quad (40),$$

Next, at step S231, it is judged whether or not the element parameter jj<M. If the answer is YES, the element parameter jj is incremented by one at step S232, then the control flow returns to step S230. On the other hand, if the answer at step S231is NO, a received signal y(t) is received at step S233, and the. estimation function $f(V_D+\Delta V_D)$ is calculated by using an equation obtained by assigning R=f into the above-mentioned Equation (17), and then the control flow returns to the original main routine.

In this third method shown in FIGS. 31 and 32, as shown at step S226 of FIG. 32, the gradient is given by using a normalized value, and the step width is given by the step-width (difference) average value ΔVav of each element used for search (this average value ΔVav is calculated in the processes of steps S226 to S228).

Figure 46:
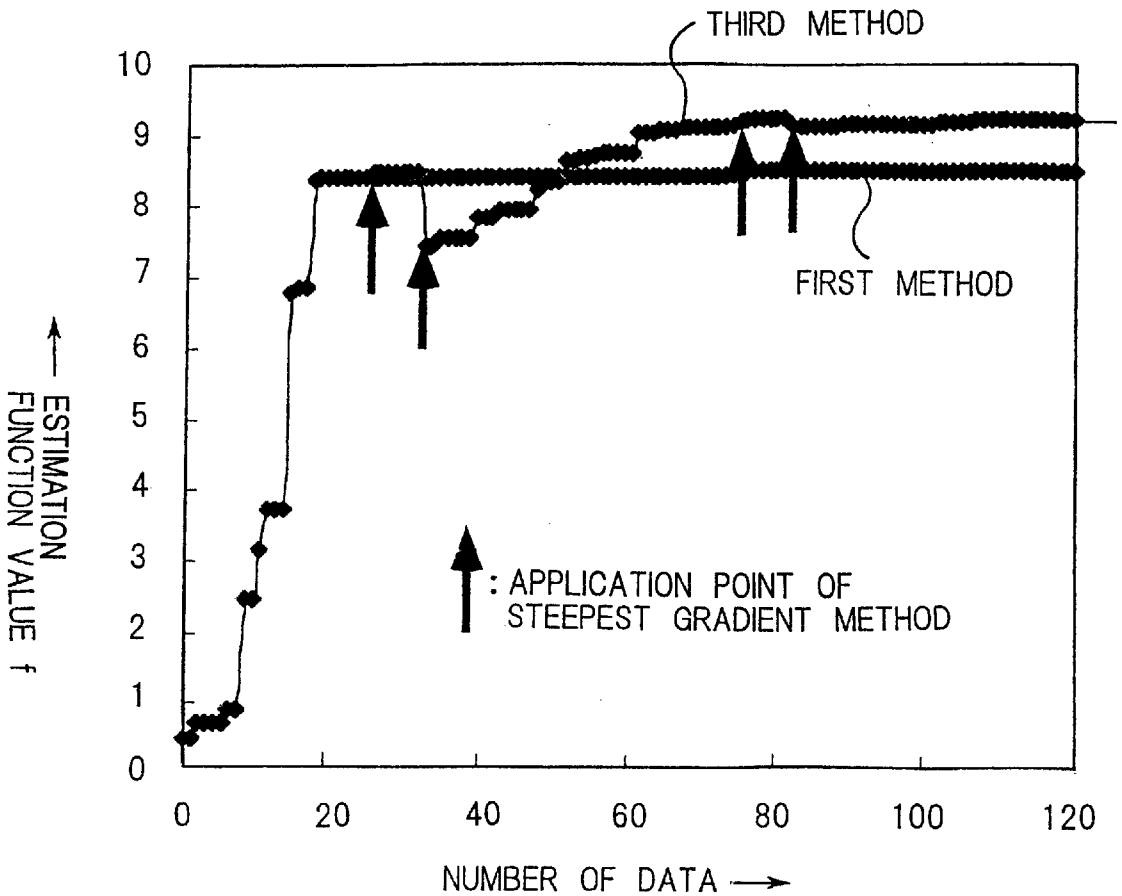
FIG. 46 is a graph showing an estimation function value versus a number of data, which is a simulation result showing convergence characteristics of the array antenna apparatus 100 of FIG. 27, when the steepest gradient method is incorporated by the third method.

A convergence curve of a simulation result by using this third method is shown in FIG. 46, in which the points to which the steepest gradient method is applied are indicated by arrows. As apparent from FIG. 46, it can be understood that the estimation function value has changed but, not necessarily, in a direction of improvement. The reason of this could be considered that a correct gradient value is not calculated because of the use of the difference. However, in this example, the estimation function value, indeed degrading halfway, but has improved finally. From this fact, it can be considered that this method has an effect of coming out of a local solution, thus this method being effective for avoiding, in actual systems involving noise, falling into a high estimation function value state resulting from errors.

Figure 47:
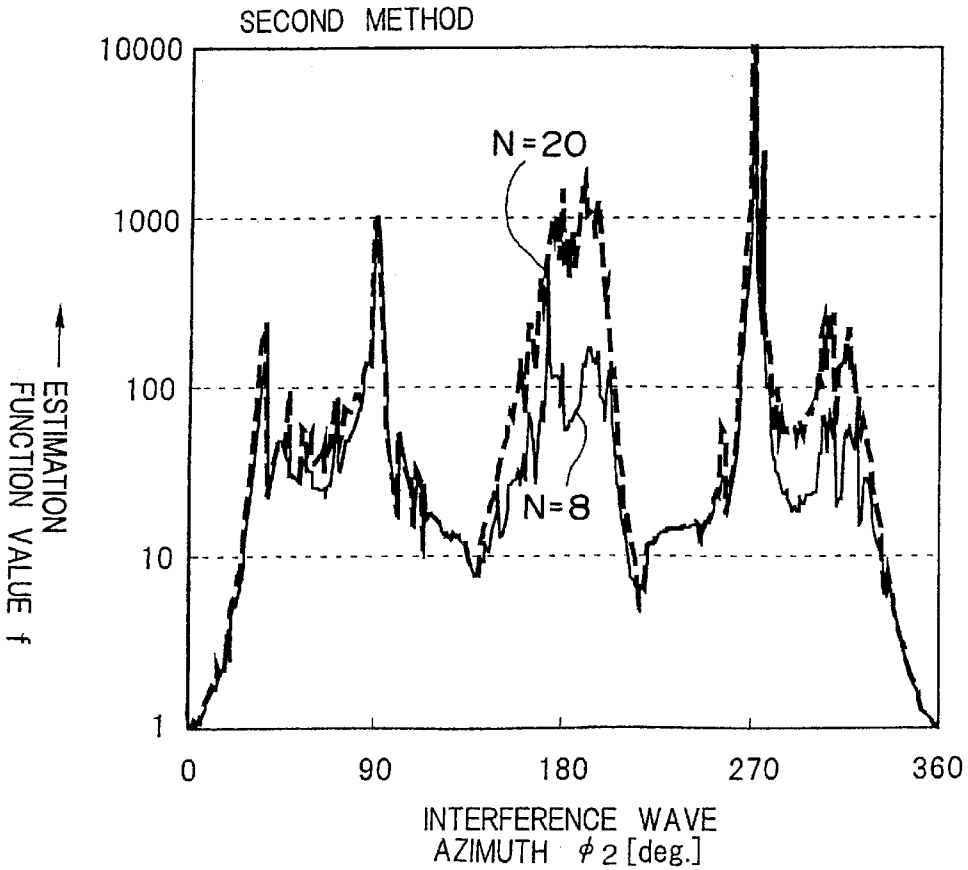
FIG. 47 is a graph showing simulation results showing a null direction and iteration dependence of the array antenna apparatus 100 of FIG. 27 and showing an estimation function value against the second interference wave azimuth $\phi_2$ with a step-width change division factor of q=2 by the second method.

Further, the null-direction dependence of the improvement of the estimation function will be explained below. FIG. 47 shows a case of a step-width initial value $\Delta V_{D0}$= 1024 and a step-width change division factor q=2 by the second method, where $\phi_0$=0° and $\phi_1$=90°, and where the horizontal axis represents another interference wave azimuth $\phi_2$ and the vertical axis represents the convergence value of the estimation function f. As apparent from FIG. 47, the broken line represents a case where the number of iterations N is 20, showing a near convergence, and the solid line represents a case where N is 8, corresponding to the number of data of about 50. Other than the vicinities of the interference wave azimuth $\phi_2=180°$ and $-90°$, a near convergence state has been obtained at the number of iterations N=8. Also in the case of the number of iterations N=8, improvement of about 10 or more can be obtained in a range except for $-25<\phi_2<25$.

As described above, it has been found out that earlier convergence can be obtained by increasing the initial step width with the use of the variable-step search method according to the present preferred embodiment. It can be considered that this is an algorithm effective for obtaining a high estimation function value with a small number of about 50 data.

In the above-mentioned preferred embodiment, six parasitic elements A1 to A6 are used. However, in least any plurality of parasitic elements, if provided, allows directivity characteristics of the array antenna apparatus to be electronically controlled. Instead of this, more than six parasitic elements may be also provided. Further, the arrangement configuration of the parasitic elements A1 to A6 is not limited to that of the above preferred embodiment, and they have only to be apart from the radiating element A0 by a predetermined distance. That is, the distance between the radiating element A0 and each of the respective parasitic elements A1 to A6 is not required to be a constant.

In the above-mentioned preferred embodiment, the adaptive control process using the training sequence signal is executed before a start of actual communication. However, the present invention is not limited to this, and the adaptive control process may be executed at the beginning of communication or every time period.

In the above-mentioned preferred embodiment, the adaptive control is performed for such an improvement that the estimation function value f calculated by an equation obtained by assigning R=f in the Equation (17) is maximized. However, when the estimation function is inverted, the adaptive control may be executed for such an improvement that the estimation function value is minimized.

In the above-mentioned preferred embodiment, when the estimation function value has not been improved, the step width $\delta V_{Dik}$ is decreased to one q-th thereof and moreover its sign is inverted at step S209 of FIG. 29. However, the present invention is not limited to this, and it is allowed that the step width $\delta V_{Dik}$ is at least decreased and its sign is inverted.

In the above-mentioned preferred embodiment, the Equation (17) is used as the estimation function, however, an output SINR or the other various estimation functions showing its level may be also used. Further, in the above-mentioned preferred embodiment, the Equation (17) is used as the estimation function and the estimation function is calculated by using the training sequence signal d(t). However, the present invention is not limited to this, and various estimation functions not using the training sequence signal d(t) may be also used. For example, as disclosed in the Related art document 5 of Takashi Ohira, "ESPAR Antenna Blind Adaptive beamforming Based on a Moment Criterion", Technical Report of IEICE, The Institute of Electronics, Information and Communication Engineers in Japan, ED2001-155, MW2001-115, pp. 23–28, November 2001, it is also possible to include the steps of, based on a received signal received by the radiating element, and with the use of an iterative numerical solution in a nonlinear programming such as the steepest gradient method, and calculating and setting reactance values of the variable-reactance elements, respectively, for directing the main beam of the array antenna toward a desired wave and directing the null(s) thereof toward an interference wave(s) so that the value of an objective function represented by the received signal alone becomes the maximum or the minimum. In this case, the objective function is such a function that the square of a time-average value of absolute values of the received signal in a predetermined period is divided by the time-average value of squares of absolute values of the received signal.

Furthermore, Appendix 1 attached to the third preferred embodiment is described below. Here is explained below a case where the search is continued until an improvement is achieved. In the case where the estimation function value is not improved with respect to one element in the variable-step search method, a method of iterating the search for the element until the estimation function value is improved is examined. In this case, it is assumed that the total number N of searches permitted for each element is a fixed number. That is, in the case of each of the six elements, 20 times of searches are made for a total number of 120 data, while 8 times of searches can be made for a total number of 48 data. The calculation results in a Case 1 where the desired wave azimuth $\phi_0=0°$, and the interference wave azimuth $\phi_1=90°$ and $\phi_2=-135°$ are shown in FIGS. 48, and 49.

Figure 48:
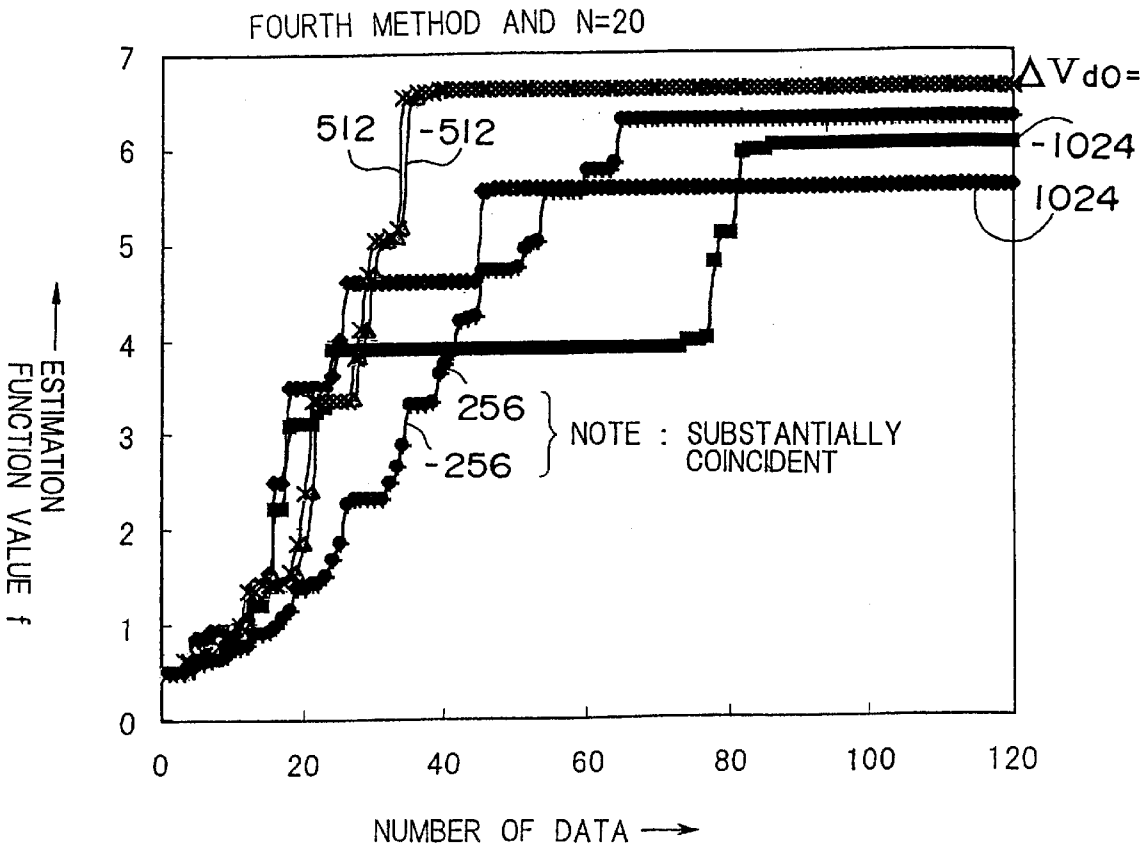
FIG. 48 is a graph showing simulation results showing a convergence result of the array antenna apparatus 100 of FIG. 27 and showing an estimation function value versus the number of data with a total number of searches of N=20 by a fourth method.
Figure 49:
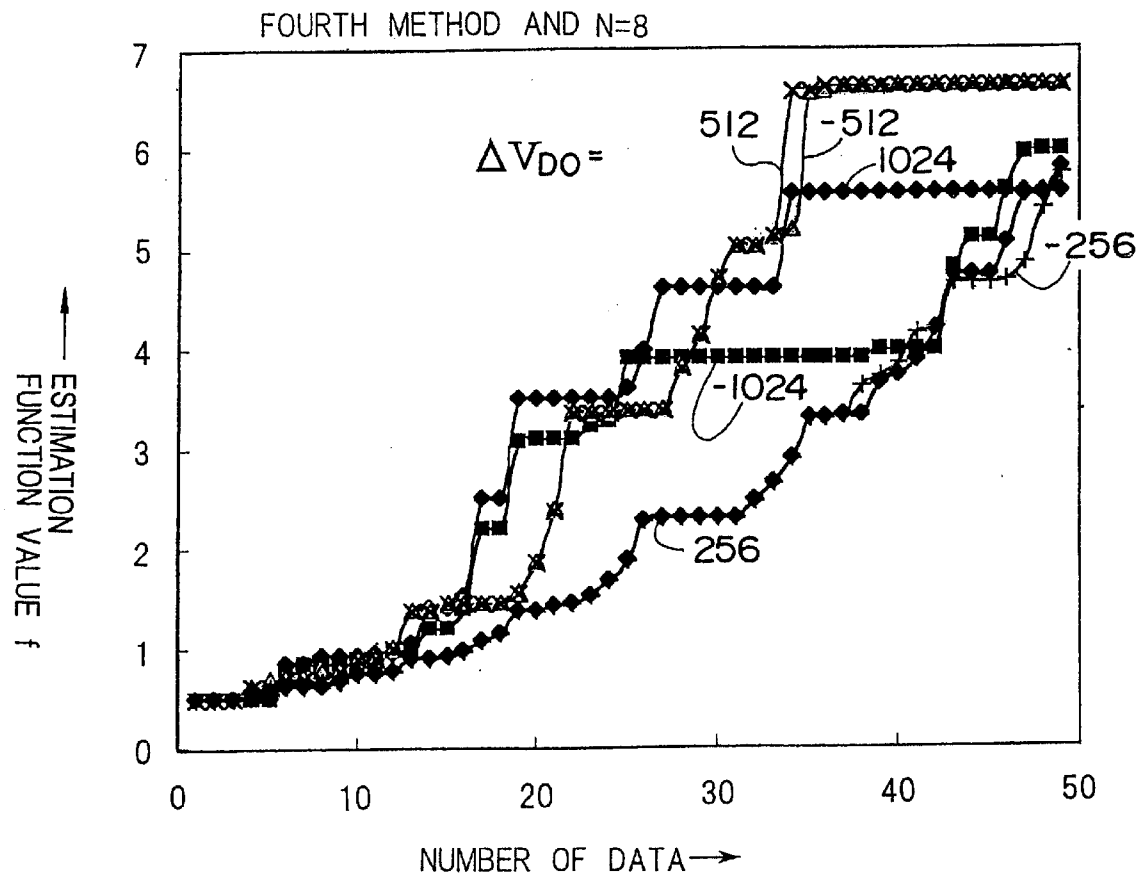
FIG. 49 is a graph showing simulation results showing a convergence result of the array antenna apparatus 100 of FIG. 27 and showing an estimation function value versus the number of data with a total number of searches of N=8 by the fourth method.

As apparent from FIGS. 48 and 49, the convergence curves do not overlap on each other because of the difference in the total numbers of searches N between the total number of 120 data and 48 data. In either case, the estimation function arrival value is about 7, which is smaller than that of the first method (FIGS. 36 and 37), in which the search is performed in order. Also, the amount of improvement of the step-width initial value $\Delta V_{D0}=\pm 1024$ is low. These could be attributed to such a fact that the search for one element advances at earlier stages so that its improvement is no longer reflected effectively due to changes in the other elements, and that there becomes no chances for search related to the element at later stages.

Figure 50:
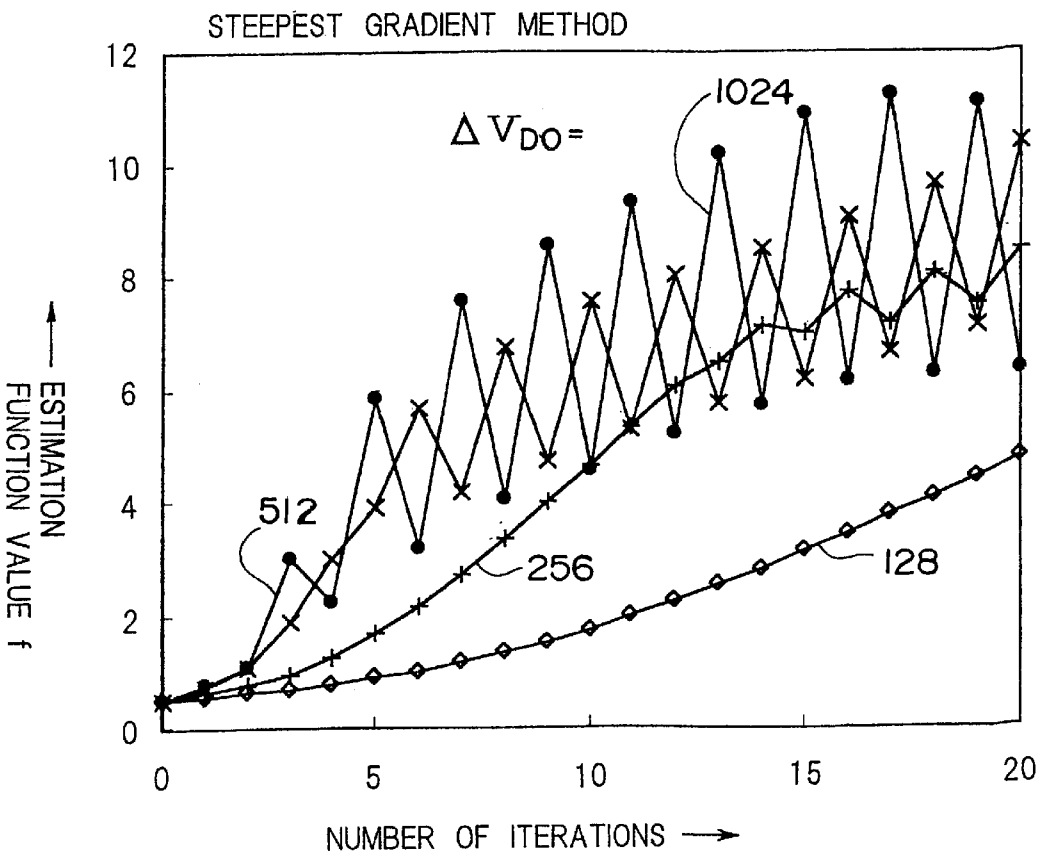
FIG. 50 is a graph showing simulation results showing an convergence dependence of the related art steepest gradient method on difference width and step width and showing an estimation function value versus the number of iterations.

Furthermore, Appendix 2 attached to the third preferred embodiment is described below. Here is explained below the difference width and step width of the steepest gradient method. Searching for an optimum estimation function value by the steepest gradient method requires a large number of iterations for a fine difference width $\Delta V_D$ and a fine step width $\mu$. When the permissible number of data is limited, it is necessary to increase the difference width $\Delta V_D$ and the step width $\mu$. In order to remove the convergence speed dependence on the magnitude of the gradient, the magnitude of the gradient is normalized , and then, it is set that $\Delta V_D=\mu$. In the case of $\phi_0=0°$, $\phi_1=90°$ and $\phi_2=-135°$, the convergence curves of the estimation function f of the above-mentioned Equation (35) are shown in FIG. 50. Since one iteration of the horizontal axis requires seven data, a number of iterations of 20 corresponds to a number of data of 140. As apparent from FIG. 50, although the estimation function value increases generally monotonously when $\Delta V_D=\mu=126$ and 256, the improvement at the number of iterations of 7 corresponding to a number of data of about 50 is still small. Also, when $\Delta V_D=\mu=512$ and 1024, it can be seen that although the improvement of the estimation function value is fast, the convergence curves immediately swings and does not yet converge. It is considered that when the estimation function value at a number of iterations of 7 becomes the highest, the value of the step width $\mu$ depends on environments such as the number of interference waves or their intensity, direction and the like.

FOURTH PREFERRED EMBODIMENT

Figure 51:
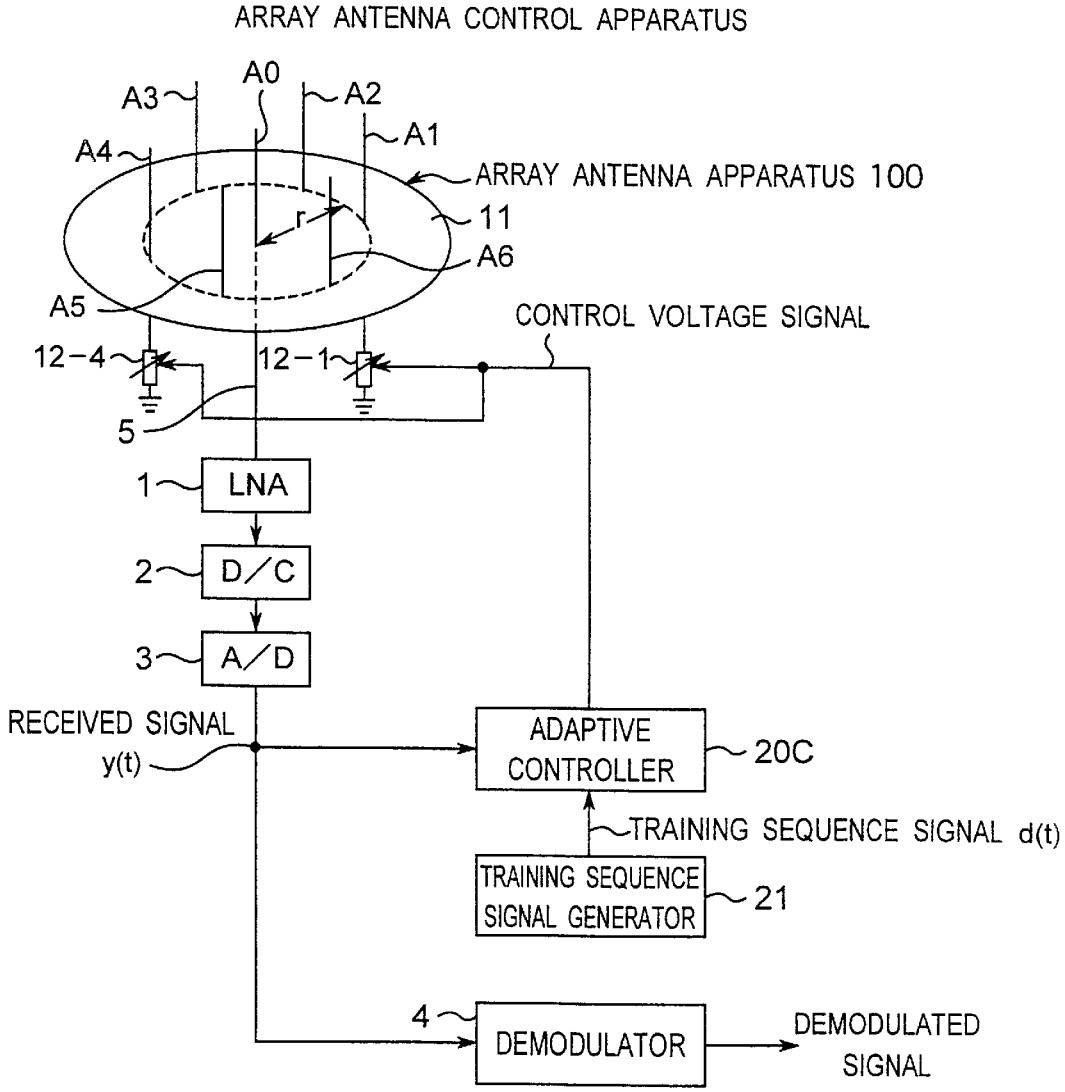
FIG. 51 is a block diagram showing a configuration of an array antenna control apparatus according to a fourth preferred embodiment of the present invention.

FIG. 51 is a block diagram showing a configuration of an array antenna control apparatus which is a fourth preferred embodiment according to the present invention. The array antenna control apparatus of the present preferred embodiment, as shown in FIG. 51, includes: an array antenna apparatus 100 which is the ESPAR antenna and which is equipped with one radiating element A0, six parasitic elements A1 to A6 having variable-reactance elements 12-1 to 12-6 loaded thereon, respectively, and. a grounding conductor 11; an adaptive controller 20C; and a training sequence signal generator 21. This fourth preferred embodiment is characterized in that the adaptive controller 20C is provided instead of the adaptive controller 20, as compared with the first preferred embodiment shown in FIG. 1. The following description will be focused mainly on this difference point.

In this case, the adaptive controller 20C, which is implemented by a computer or the other digital computing machine as an example, is characterized in that, before starting radio communication by a demodulator 4, the adaptive controller 20C executes an adaptive control process by the steepest gradient method based on a received signal y(t), which is obtained by receiving a training sequence signal contained in a radio signal transmitted from a remote transmitter by the radiating element A0 of the array antenna apparatus 100, as well as on a training sequence signal d(t) having a signal pattern identical to that of the above-mentioned training sequence signal and generated by the training sequence signal generator 21, and this leads to search for and set bias voltage values $V_m$ (m=1, 2, . . . , 6) to be applied to the variable-reactance elements 12-1 to 12-6, respectively, for directing the main beam of the array antenna apparatus 100 toward a desired wave and further directing the null(s) thereof toward an interference wave(s). More specifically, the adaptive controller 20C performs the steps of perturbing reactance values of the respective variable-reactance elements 12-1 to 12-6 sequentially by a predetermined difference width, calculating predetermined estimation function values with respect to the respective reactance values, and iteratively calculating the reactance values of the respective variable-reactance elements 12-1 to 12-6 based on the above calculated estimation function values and by using the steepest gradient method having the step width $\mu$ so that the estimation function value becomes the maximum. As a result of these steps, in the calculation and setting of the reactance values of the respective variable-reactance elements 12-1 to 12-6 for directing the main beam of the array antenna apparatus 100 toward a desired wave and directing the null(s) thereof toward an interference wave(s), the iteration operation is so controlled that the difference width ΔX and the step width $\mu$ are decreased depending on the signal to interference noise ratio SINR, which is calculated from the above estimation function value, by using a predetermined decreasing function representing the above difference width ΔX. By this operation, the adaptive controller 20C searches for bias voltage values $V_m$ of the respective variable-reactance elements 12-1 to 12-6 for directing the main beam of the array antenna apparatus 100 toward a desired wave and further directing the null(s) thereof toward an interference wave(s) so that the estimation function value becomes the maximum, and then outputs control voltage signals having the bias voltage values $V_m$ found out as a result of the search to the variable-reactance elements 12-1 to 12-6, respectively, to set those bias voltage values. It is noted that the cross correlation coefficient of the estimation function f which is used in the adaptive controller 20C is defined by an equation in which R=f is assigned into the above-mentioned Equation (17).

A transmitting station that transmits a radio signal to be received by the array antenna 100 modulates a carrier signal of radio frequency by using a digital modulation method such as BPSK or QPSK according to a digital data signal of a predetermined symbol rate containing a training sequence signal having a signal pattern identical to that of a predetermined training sequence signal generated by the training sequence signal generator 21, then amplifies the power of the modulated signal, and transmits the resulting signal toward the array antenna apparatus 100 of a receiving station. In the present preferred embodiment, before data communication is performed, a radio signal containing a training sequence signal is transmitted from the transmitting station toward the receiving station, and the receiving station performs an adaptive control process by the adaptive controller 20C.

In the present preferred embodiment, the bias voltage values $V_m$ to be applied to varactor diodes of the variable-reactance elements 12-1 to 12-6 are inputted and set in a form of control voltage signals derived from the adaptive controller 20C, as digital values of −2048 to 2047. These numerical values will be hereinbelow expressed as "a digital control voltage $V_D$". According to brochure data of the varactor diodes used, the relationship between the digital control voltage $V_D$ and impedance $Z_V$ of the varactor diodes is expressed by the following equation:

$$Z_V=-j(0.0217V_D+49.21) \quad (41).$$

The directivity of the array antenna apparatus 100 of the ESPAR antenna can be calculated by using an admittance matrix Y corresponding to the above impedance matrix Z (See, e.g., Related art document 3 or the like). The values shown in FIG. 28 are used as the admittance matrix Y. Also, the number M of parasitic elements of a seven-element ESPAR antenna is 6. It is required to measure some data from within a space stretched by a power M=6 of the number 4086 that can be taken by the digital control voltage $V_D$, and this leads to finding out six combinations of points having the highest possible estimation function values.

Next, a "difference-step control search method", which is described in detail below, is proposed as a method for controlling the above reactance vector X. In the present preferred embodiment, the gradient of the steepest gradient method is calculated with a gradient value $\nabla_{\Delta X}f$ as normalized as shown by the following equation:

$$X_{n+1} = X_n + \mu\frac{\nabla_{\Delta X} f}{|\nabla_{\Delta X} f|} \quad (42),$$

where the gradient value $\nabla_{\Delta X}f$ of the second term in the right side of the Equation (42) is a gradient value of the estimation function value f resulting from the perturbation effected to the estimation function value f by the difference width ΔX, and the resulting gradient value is normalized by its magnitude. That is, by normalizing the gradient as shown by the above Equation (42), improvement speed of the estimation function can be enhanced even in a small-gradient state. $X_n$ is a control parameter for reactance vectors, and takes a value of −2048 to 2047 in the present preferred embodiment. f is an estimation function representing a cross correlation function f represented by an equation obtained, for example, by assigning R=f into the above Equation (17), and the estimation function is calculated by using the admittance matrix Y.

Figure 52:
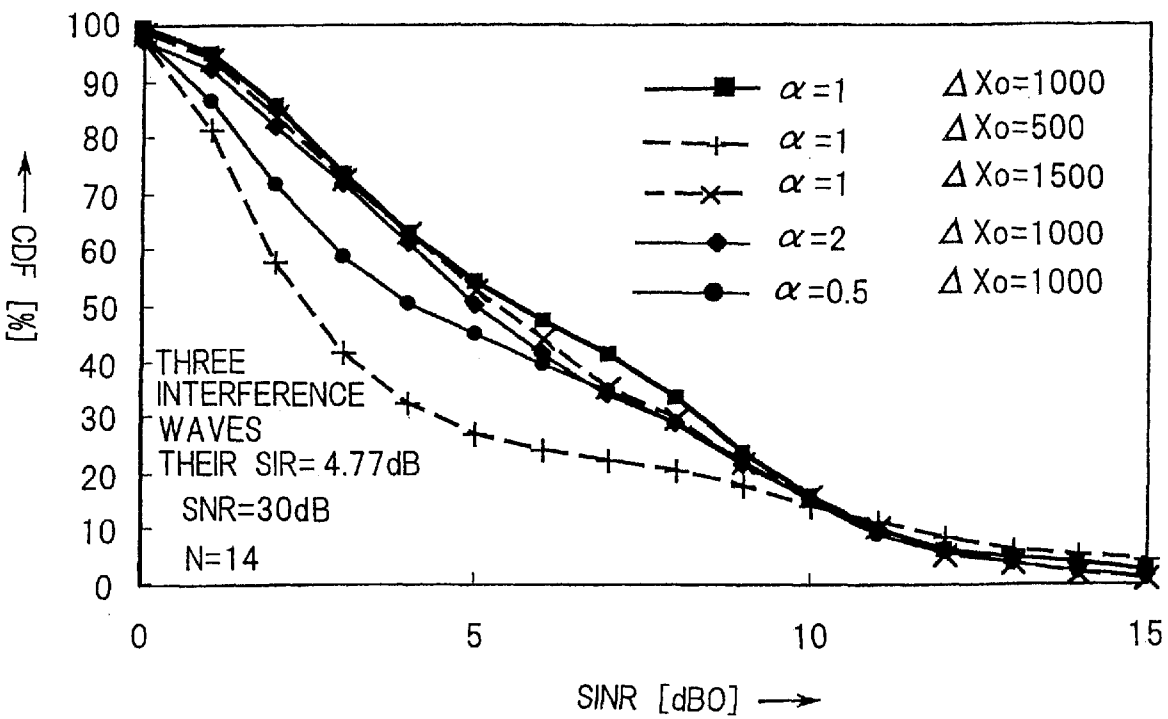
FIG. 52 is a graph, which is a simulation result according to a comparative example, showing CDF characteristics against a constant difference width.

FIG. 52 is a graph, which is a simulation result according to a comparative example, showing CDF (Cumulative Distribution Function) characteristics against a constant difference width, where the CDF characteristics shown here are calculated on the assumptions that the number of samples for averaging is 20 symbols and that the total number of iterations N=14 under an environment of three interference waves having a signal-to-noise ratio (SNR)=30 dB and a power ratio of 1/3to a desired wave. As apparent from FIG. 52, better CDF characteristics are obtained when the difference-width initial value $\Delta X_0$ is set to about 1000 and a parameter $\alpha$(where $\mu=\alpha\Delta X$) representing a ratio of the step width $\mu$ to the difference width $\Delta X$ is set to one.

Figure 53:
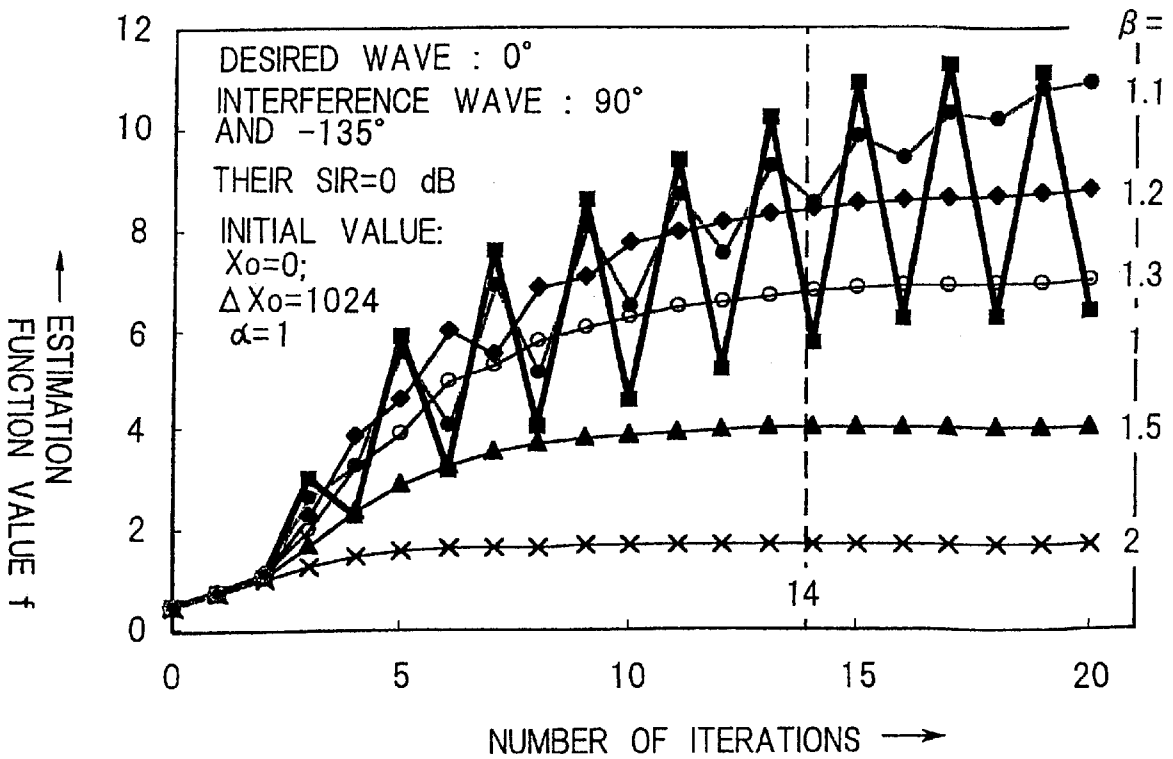
FIG. 53 is a graph, which is a simulation result according to the fourth preferred embodiment, showing convergence curves of a predetermined estimation function with the difference width decreased every iteration.

FIG. 53 is a graph, which is a simulation result according to the present preferred embodiment, showing convergence curves of a predetermined estimation function with the difference width decreased every iteration. With the following equation used as an estimation function, a convergence curve on the assumptions that the difference-width initial value $\Delta X_0=1024$ and the parameter $\alpha=1$ under an environment that the desired wave azimuth $\phi=0°$ and interference waves of the same power arrive from $\phi1=90°$ and $\phi2=-135°$ is shown by solid line in FIG. 53. In an implemental example given below, the following equation is used as the estimation function f:

$$f = \frac{|F(\phi_0)|^2}{\sum_{t=1}^{n_N} |F(\phi_t)|^2} \quad (43),$$

where $n_N$ is the number of interference waves and $F(\phi)$ is the array factor of the array antenna apparatus 100. As apparent from FIG. 53, the convergence curve show occurrence of swings because of the normalization of the gradient. Thus, in order to improve this, the difference width $\Delta X$ is reduced to one $\beta$-th thereof every iterations n according to the following equation:

$$\Delta X=\Delta X_0/\beta^n \quad (44).$$

The results of this case are shown in superposition in FIG. 53, where it can be understood that the larger the parameter $\beta$ is, the higher the swing convergence effect becomes. However, the convergence value of the estimation function becomes lower.

Figure 54:
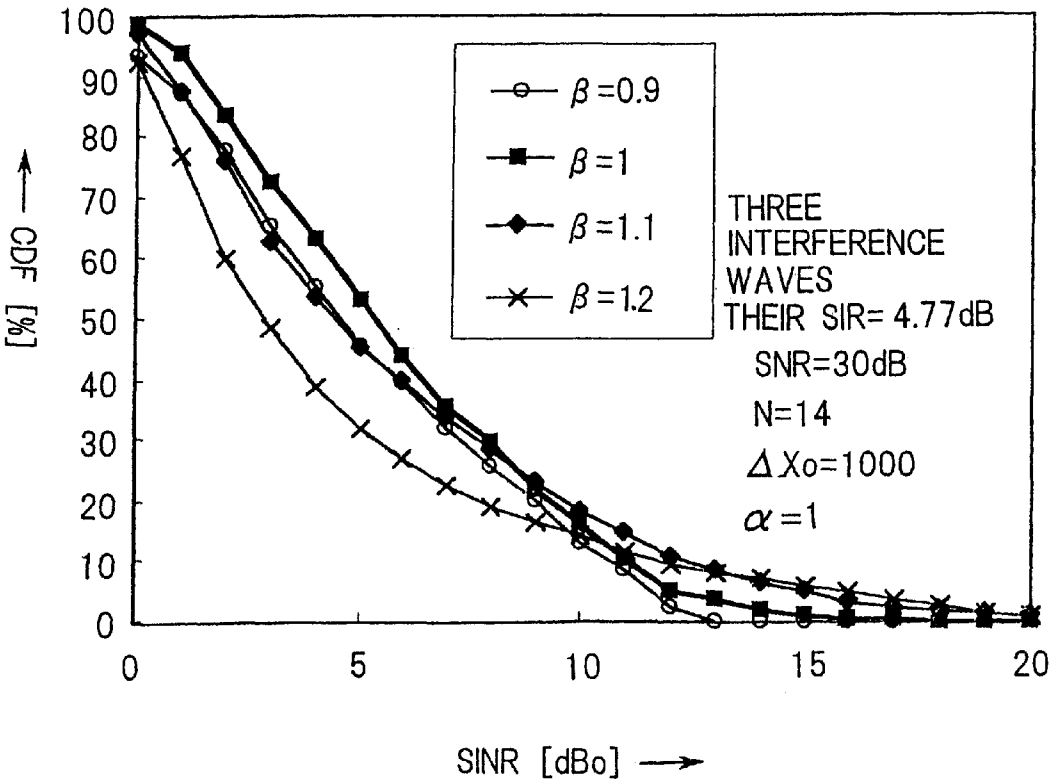
FIG. 54 is a graph, which is a simulation result according to the fourth preferred embodiment, showing CDF characteristics with the difference width decreased every iteration.
Figure 55:
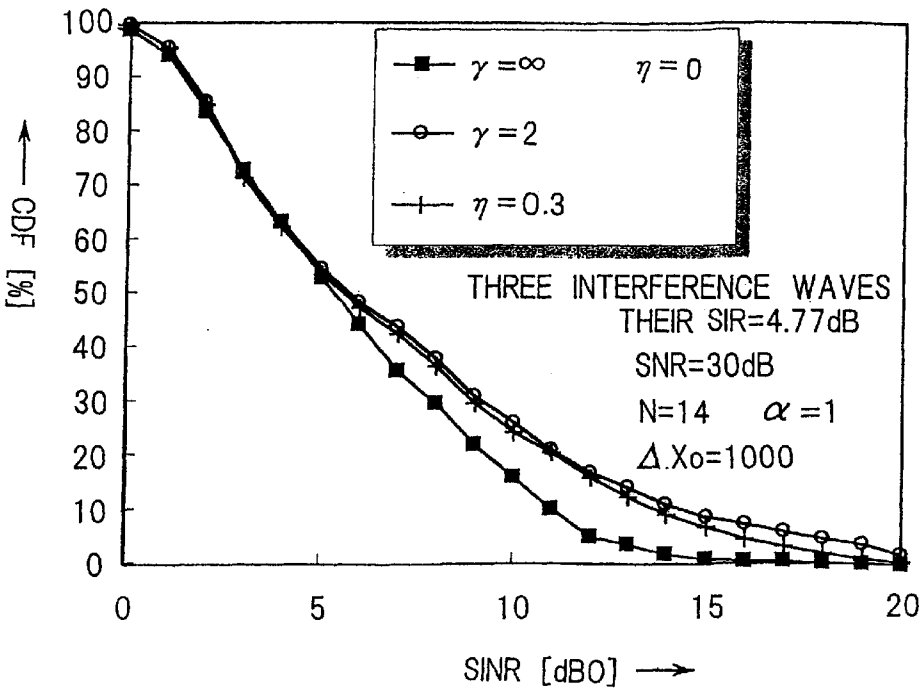
FIG. 55 is a graph, which is a simulation result according to the fourth preferred embodiment, showing CDF characteristics with the difference width decreased in response to improvements in the estimation function.

FIG. 54 is a graph, which is a simulation result according to the present preferred embodiment, showing CDF characteristics with the difference width decreased every iteration, and showing a parameter $\beta$ dependence of the CDF characteristics. It can be understood that setting the parameter $\beta$ to 1.1 or 1.2 allows the probability of output SINR's over about 10 dB0 to be improved, however, it causes the probability of SINRs smaller than that to be deteriorated. This could be attributed to the reason that in the case where the SINR is improved, the improvement of SINR is advanced by the swing convergence, however, the improvement of SINR is retarded due to decreased difference width $\Delta X$ in a low-SINR state. Therefore, the following equations are proposed in order that the difference width $\Delta X$ is decreased depending on SINR, and its CDF characteristics is shown in FIG. 55:

$$\Delta X=\Delta X_0[1-\{\log_{10}(\mathrm{SINR})\}/\gamma] \quad (45), \text{ and}$$

$$\Delta X=\Delta X_0(\mathrm{SINR})^{-\eta} \quad (46).$$

It is noted that the SINR is calculated by the following equation based on the estimation function value f of an equation in which R=f is assigned into the above-mentioned Equation (17):

$$\mathrm{SINR}=f/(1-f) \quad (47).$$

In this case, preferably, $\gamma=2$ and $\eta=0.3$. That is, FIG. 55 shows simulation results according to the present preferred embodiment, and shows CDF characteristics with the difference width $\Delta X$ decreased in response to improvements in the estimation function. In FIG. 55, a curve of $\gamma=2$ represents a case where the difference width $\Delta X$ is controlled by using the above Equation (45), and a curve of $\eta=0.3$ represents a case where the difference width $\Delta X$ is controlled by using the above Equation (46). In either case, probabilities of SINR in the whole range are improved or maintained, making the effectiveness ascertained. In addition, the above Equation (45), although incapable of defining the difference width $\Delta X$ with SINR>$10^{\gamma}$, yet is higher in improvement of CDF than the Equation (46) of FIG. 55, thus proving to be an effective method.

As described above, according to the present preferred embodiment, the difference width is controlled by using such a decreasing function that the difference width of the steepest gradient method is decreased according to improvements of the estimation function, by which the output SINR, which is an estimation function value, can be remarkably improved to a large extent, so that an improved convergence value can be obtained.

In the above-mentioned preferred embodiment, six parasitic elements A1 to A6 are used. However, at least any plurality of parasitic elements, if provided, allows directivity characteristics of the array antenna apparatus to be electronically controlled. Instead of this, more than six parasitic elements may be also provided. Further, the arrangement configuration of the parasitic elements A1 to A6 is not limited to that of the above preferred embodiment, and they have only to be apart from the radiating element A0 by a predetermined distance. That is, the distances to the respective parasitic elements A1 to A6 do not need to be constant. Further, the element length does not need to be uniform, either.

In the above-mentioned preferred embodiment, the adaptive control process using the training sequence signal is executed before a start of actual communication. However, the present invention is not limited to this, and the adaptive control process may be executed at the beginning of communication or at every time period.

In the above-mentioned preferred embodiment, adaptive control is performed for such an improvement that the estimation function value f shown by, for example, an equation obtained by assigning R=f into the Equation (17) is maximized. However, when the estimation function is inverted, adaptive control may be executed for such an improvement that the estimation function value is minimized.

In the above-mentioned preferred embodiment, the Equation (17) is used as the estimation function, but the output SINR or the other various estimation functions showing its level may be also used. Further, in the above-mentioned preferred embodiment, the Equation (17) is used as the estimation function and the estimation function is calculated by using the training sequence signal d(t). However, the present invention is not limited to this, and various estimation functions not using the training sequence signal d(t) may be also used. For example, as disclosed in the Related art document 5, it is also possible to include the steps of, based on a received signal received by the radiating element, and with the use of an iterative numerical solution in a nonlinear programming such as the steepest gradient method, and calculating and setting reactance values of the variable-reactance elements, respectively, for directing the main beam of the array antenna toward a desired wave and directing the null(s) thereof toward an interference wave(s) so that the value of an objective function represented by the received signal alone becomes the maximum or the minimum, where the objective function is a function that the square of a time-average value of absolute values of the received signal in a predetermined period is divided by the time-average value of squares of absolute values of the received signal.

FIFTH PREFERRED EMBODIMENT

Figure 56:
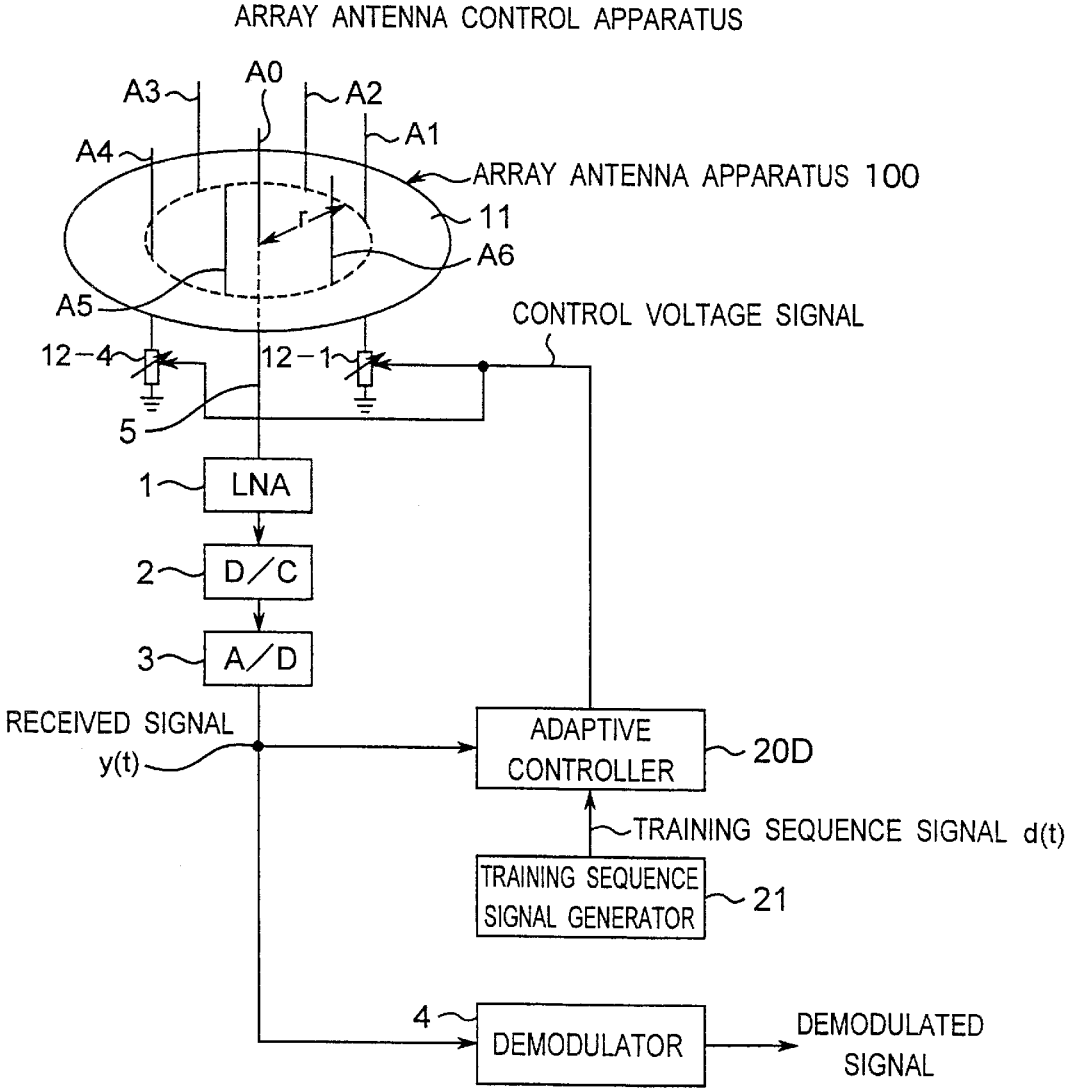
FIG. 56 is a block diagram showing a configuration of an array antenna control apparatus according to a fifth preferred embodiment of the present invention.

FIG. 56 is a block diagram showing a configuration of an array antenna control apparatus according to a fifth preferred embodiment of the present invention. The array antenna control apparatus of the present preferred embodiment, as shown in FIG. 56, includes: an array antenna apparatus 100 which is the ESPAR antenna and which is equipped with one radiating element A0, six parasitic elements A1 to A6 having variable-reactance elements 12-1 to 12-6 loaded thereon, respectively, and a grounding conductor 11; an adaptive controller 20D; and a training sequence signal generator 21. This fifth preferred embodiment is characterized in that the adaptive controller 20D is provided instead of the adaptive controller 20, as compared with the first preferred embodiment shown in FIG. 1. The following description will be focused mainly on this difference point.

Figure 57:
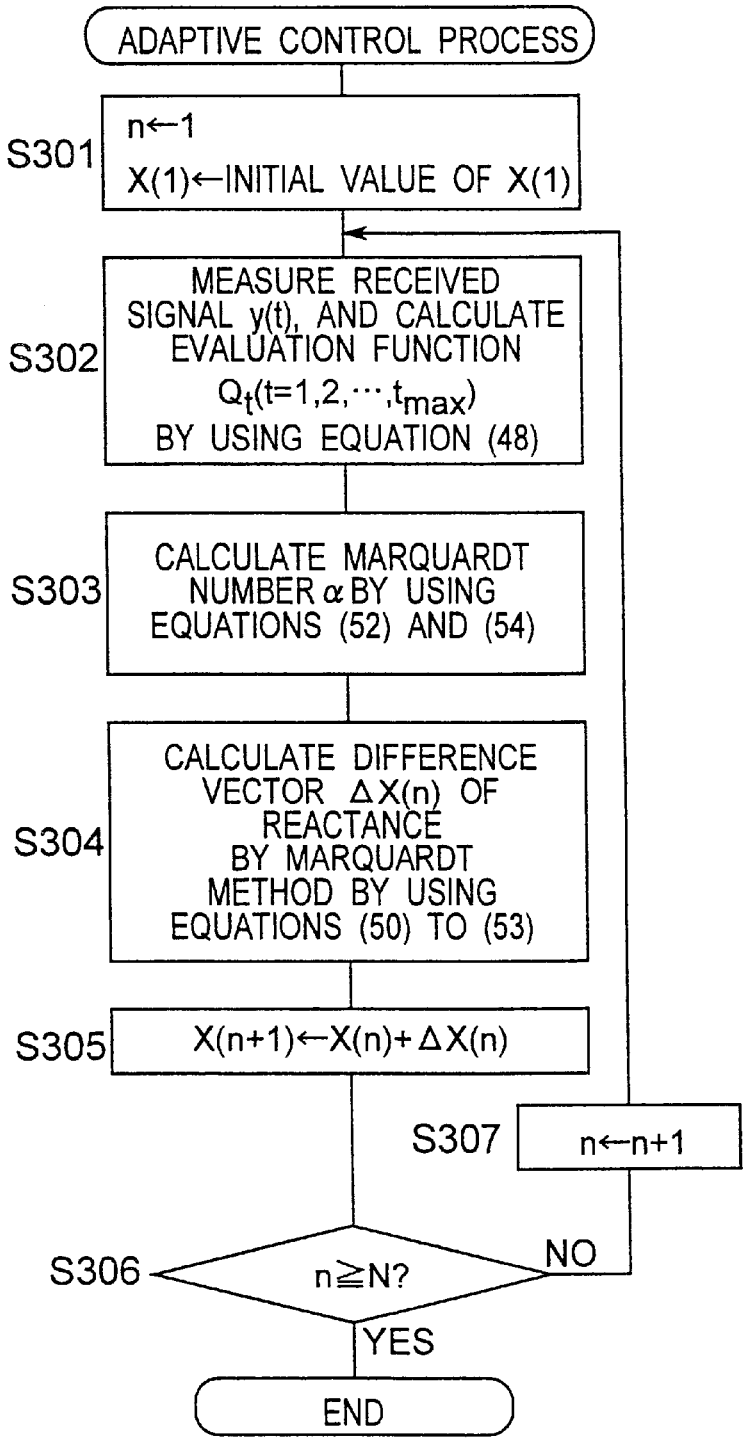
FIG. 57 is a flowchart showing an adaptive control process which is executed by an adaptive controller 20D of FIG. 56.

In this case, the adaptive controller 20D, which is implemented by a computer or the other digital computing machine as an example, is characterized in that, before starting radio communication by a demodulator 4, the adaptive controller 20D executes an adaptive control process by Marquardt method shown in FIG. 57 based on a received signal y(t), which is obtained by receiving a training sequence signal contained in a radio signal transmitted from a remote transmitter by the radiating element A0 of the array antenna apparatus 100, as well as on a training sequence signal d(t) having a signal pattern identical to that of the above-mentioned training sequence signal and generated by the training sequence signal generator 21, and this leads to search for and set bias voltage values $V_m$ (m=1, 2, . . . , 6) to be applied to the variable-reactance elements 12-1 to 12-6, respectively, for directing the main beam of the array antenna apparatus 100 toward a desired wave and further directing the null(s) thereof toward an interference wave(s).

More specifically, as shown in FIG. 57, the adaptive controller 20D is characterized by performing the steps of: calculating an estimation function value $Q_t$ shown by a later-described Equation (48) based on a received signal y(t); calculating difference reactance values of the respective variable-reactance elements 12-1 to 12-6 based on the calculated estimation function value $Q_t$ by using Marquardt method having a Marquardt number; and perturbing the reactance values of the variable-reactance elements 12-1 to 12-6, respectively, by a predetermined difference reactance value in succession, and that the adaptive controller 20D iterates these steps to calculate and set optimum solutions of the reactance values of the respective variable-reactance elements 12-1 to 12-6 for directing the main beam of the array antenna apparatus toward a desired wave and directing the null(s) thereof toward an interference wave(s) so that the estimation function value becomes the maximum, where the Marquardt number a is controlled so as to be gradually decreased as an optimum solution is approached. As a result of this, it becomes possible to search for bias voltage values $V_m$ of the respective variable-reactance elements 12-1 to 12-6 for directing the main beam of the array antenna apparatus 100 toward a desired wave and directing the null(s) thereof toward an interference wave(s), and output and set control voltage signals having the bias voltage values $V_m$ found out as a result of the search to the variable-reactance elements 12-1 to 12-6, respectively.

A transmitting station that transmits a radio signal to be received by the array antenna 100 modulates a carrier signal of radio frequency by using a digital modulation method such as BPSK or QPSK according to a digital data signal of a predetermined symbol rate containing a training sequence signal having a signal pattern identical to that of a predetermined training sequence signal generated by the training sequence signal generator 21, then amplifies the power of the modulated signal, and transmits the resulting signal toward the array antenna apparatus 100 of a receiving station. In the present preferred embodiment, before data communication is performed, a radio signal containing a training sequence signal is transmitted from the transmitting station toward the receiving station, and the receiving station performs an adaptive control process by the adaptive controller 20D.

Next, an "adaptive control method by Marquardt method", which will be described in detail below, is proposed as a method for controlling the above reactance vector X. As already described in the paragraphs of the related art, it has been the conventional case that much time is required for determining optimum solutions of the reactance values of the respective variable-reactance elements 12-1 to 12-6, which are to be loaded on the ESPAR antenna. In order to solve this issue, in the present preferred embodiment, it is proposed to perform an optimization by using the steepest descent method and the Marquardt method for an MMSE estimation function in the ESPAR antenna.

The Marquardt method, which is one of nonlinear least-squares methods, has the same advantage effects as those of both Gauss-Newton's method and steepest descent method. On the assumptions that $t_{max}$ times of sampling are performed in a predetermined training time period, instantaneous values of the estimation function at the timing t (t=1, 2, . . . , $t_{max}$) are $Q_t$, an instantaneous value of the received signal from the antenna apparatus is y(t), and that an instantaneous value of the training sequence signal is expressed as d(t), the following objective function F(X) is defined as follows:

$$F(X) \equiv \sum_{t=1}^{t_{max}} Q_i = \sum_{t=1}^{t_{max}} |d(t) - y(t)|^2 \quad (48),$$

A common reactance vector X that causes the estimation function $Q_t$ at each timing t to be uniformly reduced by minimizing the objective function F(X) is calculated. In the Gauss-Newton's method, a reactance vector X(n) is corrected or changed by a reactance difference vector ΔX(n), which is a minute quantity as shown by the following equation to obtain the following X(n+1):

$$X(n+1)=X(n)+\Delta X(n) \quad (49).$$

However, when the reactance vector X(n) is far from an optimum value or when the $t_{max}$ sample data are weak in independence, the reactance difference vector ΔX(n) itself may diverge. On the other hand, the steepest descent method according to the related art method, although ensuring the decrease of the estimation function most securely, yet has a drawback that repeating the iteration would cause a zigzag motion to be started, and an attempt to avoid this would cause the convergence speed to be sacrificed unavoidably. Thus, in the present preferred embodiment, in order to make up for the drawbacks of the two methods by using Marquardt method, the reactance difference vector ΔX(n) is calculated by the following equation:

$$(J_n J_n^H + \alpha I)\Delta X(n) = -J_n H(X(n)) \quad (50),$$

where α is a Marquardt number and I is a unit matrix. Further, an estimation function vector H(X(n)) is expressed by the following equations:

$$H(X(n)) = [h_1, h_2, \ldots, h_{imax}] \quad (51), \text{ and}$$

$$h_i = Q_i^{1/2}(X(n)) \quad (52),$$

where $J_n$ is a Jacobian matrix associated with X(n) of the estimation function vector H(X(n)), and is given by the following equation:

$$J_n = [\nabla h_1(X(n)), \nabla h_2(X(n)), \ldots, \nabla h_{imax}(X(n))] \quad (53).$$

From the above Equation (53), if the Marquardt number α=0, then the direction of ΔX(n) results in one according to the Gauss-Newton's method, and as the Marquardt number α becomes larger, then ΔX(n) results in a direction according to the steepest descent method. In the present preferred embodiment, the Marquardt number α is so set that its value becomes gradually smaller as an optimum point is approached, as shown by the following equation:

$$\alpha = \frac{\sum_{t=1}^{t_{\max}} \|\nabla_x h_t(X)\|^2}{(6 \cdot t_{\max})^2} \quad (54),$$

FIG. 57 is a flowchart showing an adaptive control process which is executed by the adaptive controller 20D of FIG. 56.

Referring to FIG. 57, first of all, at step S301, an iteration parameter n is initialized to one, and a predetermined initial value therefor is assigned into a reactance vector X(1). Then, at step S302, a received signal y(t) is measured and the estimation function $Q_t$ (t=1, 2, . . . , $t_{max}$) is calculated by using the above Equation (48). Then, at step S303, the Marquardt number a is calculated by using the above Equations (52) and (54). At step S304, the reactance difference vector ΔX(n) is calculated by the Marquardt method by using the above Equations (50) to (53). Further, at step S305, a reactance vector X(n+1) of the next iteration is calculated by using a recurrence formula of the above Equation (49), and control voltage signals corresponding to respective components of the reactance vector X(n+1) are generated, and then further outputted and set to the variable-reactance elements 12-1 to 12-6. Then, it is jusged at step S306 whether or not a convergence condition of n≧N (the maximum number of iterations) is satisfied. If the answer is NO, then the control flow goes to step S307, and the iteration parameter n is incremented by one, then the control flow goes to step S302. On the other hand, if the answer is YES at step S306, then the adaptive control process is ended.

The present inventors performed a simulation under the following conditions on the array antenna apparatus according to the present preferred embodiment:

TABLE 4

| Simulation conditions: | |
|---|---|
| Element length: | 0.463λ |
| Element thickness (radius): | 0.0031λ |
| Element distance: | 1/4λ |
| Modulation code: | M-series 7-stage PN code |
| Modulation system: | π/4-shiftQPSK |
| Filter: | Nyquist filter |
| S/N ratio: | Infinite |

Figure 58:
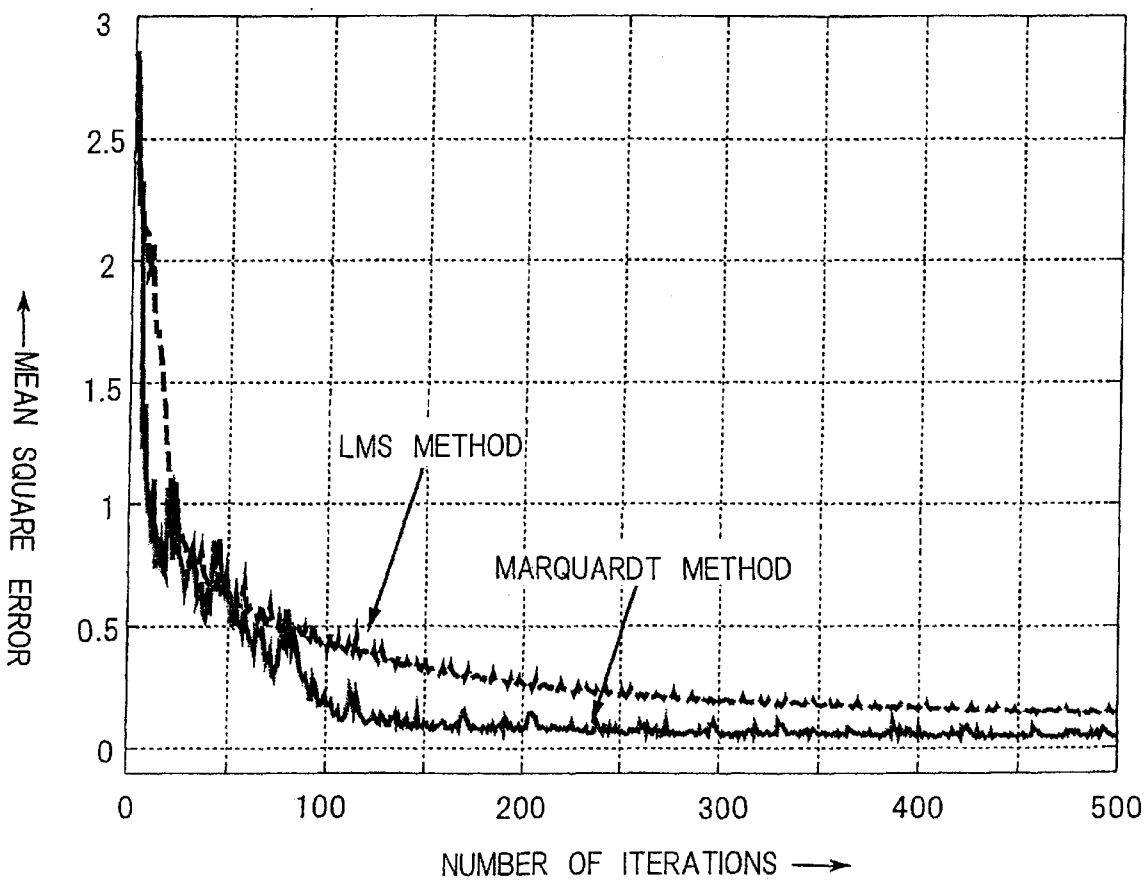
FIG. 58 is a graph showing simulation results of an LMS method according to the related art and the Marquardt method according to the fifth preferred embodiment and showing a root-mean-square error versus the number of iterations.

Under an environment that the S/N ratio is infinite and only one desired wave arrives, how the expectation value of the square error changes with the use of the steepest descent method by LMS method and the use of Marquardt method is shown in FIG. 58. As apparent from FIG. 58, it can be understood that the use of Marquardt method makes the convergence speed faster, allowing the optimization of the reactance value to be achieved with a relatively smaller number of samples than the steepest descent method.

As described above, according to the present preferred embodiment, since optimum solutions for the respective variable-reactance elements 12-1 to 12-6 of the ESPAR antenna are calculated by using Marquardt method, it has been realized to reduce the time required for the optimization of the ESPAR antenna.

In the present preferred embodiment, six parasitic elements A1 to A6 are employed in the present preferred embodiment. However, at least a plural number of parasitic elements are enough to electronically control the directivity characteristics of the array antenna apparatus. Alternatively, more than six parasitic elements may be provided. Besides, the arrangement configuration of the parasitic elements A1 to A6 is not limited to the above preferred embodiment, either, and they have only to be distant from the radiating element A0 by a predetermined distance. That is, the distances to the parasitic elements A1 to A6 may be inconstant.

In the above-mentioned preferred embodiment, the adaptive control process using the training sequence signal is executed before the start of actual communication. However, the present invention is not limited to this, and the adaptive control process may be also done either at the beginning of the communication or every some time period.

In the above-mentioned preferred embodiment, adaptive control is performed for such an improvement that the estimation function value shown in, for example, the above Equation (48) is maximized. However, when the estimation function is inverted, adaptive control may be executed for such an improvement that the estimation function value is minimized.

In the above-mentioned preferred embodiment, the Equation (48) is used as the estimation function, but output SINR or the other various estimation functions showing its level may be also used. Further, in the above-mentioned preferred embodiment, the Equation (48) is used as the estimation function and the estimation function is calculated by using the training sequence signal d(t). However, the present invention is not limited to this, and various estimation functions not using the training sequence signal d(t) may be also used. For example, as disclosed in the Related art document 5, it is also possible to include the steps of, based on a received signal received by the radiating element, and with the use of an iterative numerical solution in a nonlinear programming such as the steepest gradient method, and calculating and setting reactance values of the variable-reactance elements, respectively, for directing the main beam of the array antenna toward a desired wave and directing the null(s) thereof toward an interference wave(s) so that the value of an objective function represented by the received signal alone becomes the maximum or the minimum, where the objective function is a function that the square of a time-average value of absolute values of the received signal in a predetermined period is divided by the time-average value of squares of absolute values of the received signal.

ADVANTAGEOUS EFFECTS OF THE PREFERRED EMBODIMENTS

As described in detail hereinabove, according to a method for controlling an array antenna according to a preferred embodiment of the present invention, in the method for controlling an ESPAR antenna, the method is characterized in including a step of iterating the following steps of: upon setting the reactance values of the respective variable-reactance elements by randomly perturbing the reactance values from predetermined initial values, calculating predetermined cross correlation coefficients between a received signal and a training sequence signal before and after the perturbation, the received signal being obtained by receiving by the array antenna a training sequence signal contained in a radio signal transmitted from a remote transmitter, and the training sequence signal being generated so as to have a signal pattern identical to that of the transmitted training sequence signal; selecting and setting reactance values when the cross correlation coefficient increases between those before and after the perturbation; and setting reactance values obtained by randomly perturbing the selected reactance values, to the variable-reactance elements, respectively. Accordingly, it becomes implementable to fulfill training so that the performance is improved every iteration of search, so that the convergence time to an optimum solution can be remarkably reduced. As a result, the quantity of calculations is reduced and a long training sequence signal is not required.

Also, in the above method for controlling an array antenna, the initial values are preferably reactance values of the respective variable-reactance elements corresponding to one radiation pattern having the maximum cross correlation coefficient out of reactance values of the respective variable-reactance elements corresponding to a predetermined plurality of radiation patterns. Accordingly, by starting the search from optimum initial values, the convergence time to an optimum solution can be remarkably reduced to a large extent, and the quantity of calculations can be reduced.

Also, in the above method for controlling the array antenna of the ESPAR antenna, according to a preferred embodiment of the present invention, the method includes the following steps of: upon dividing a range of each reactance value available for each of the variable-reactance elements, into two ranges thereof and setting representative values of respective divided two ranges to the variable-reactance elements, respectively, calculating predetermined cross correlation coefficients between a received signal and a training sequence signal before and after the perturbation, the received signal being obtained by receiving by the array antenna a training sequence signal contained in a radio signal transmitted from a remote transmitter, and the training sequence signal being generated so as to have a signal pattern identical to that of the transmitted training sequence signal, and selecting and setting, as initial values, reactance values of the respective variable-reactance elements corresponding to a larger cross correlation coefficient out of the two cross correlation coefficients corresponding to the representative values of the respective divided two ranges; and dividing a range belonging to the selected reactance values into two ranges thereof, calculating the cross correlation coefficients upon setting of the representative values of the respective divided two ranges to the variable-reactance elements, respectively, and selecting and setting reactance values of the variable-reactance elements corresponding to a larger cross correlation coefficient out of the two cross correlation coefficients corresponding to the representative values of the respective divided two ranges, thereby controlling a main beam and a null(s) of the array antenna so that the main beam is directed toward a desired wave and the null(s) is directed toward an interference wave(s).

In this case, preferably, the method includes the following steps of: upon dividing the range of each reactance value available for each of the variable-reactance elements, into two ranges thereof and setting representative values of respective divided two ranges to the variable-reactance elements, respectively, calculating a predetermined cross correlation coefficient between a received signal and a training sequence signal, the received signal being obtained by receiving a training sequence signal contained in a radio signal transmitted from a remote transmitter by the array antenna, and the training sequence signal being generated so as to have a signal pattern identical to that of the received training sequence signal, and selecting and setting, as initial values, reactance values of the respective variable-reactance elements corresponding to a larger cross correlation coefficient out of the two cross correlation coefficients corresponding to medians of the respective divided two ranges; and upon dividing the range belonging to the selected reactance values into two ranges thereof and setting of the medians of the respective divided two ranges to the variable-reactance elements, respectively, calculating the cross correlation coefficient, and selecting and setting reactance values of the variable-reactance elements corresponding to a larger cross correlation coefficient out of the two cross correlation coefficients corresponding to the medians of the respective divided two ranges. Accordingly, as compared with the related art method, the convergence time can be remarkably reduced to a large extent, and the adaptive control can be achieved with less quantity of calculations so that the main beam is directed toward a desired wave and the null(s) is directed toward an interference wave(s).

Also, instead of the former step as described above, preferably, the method includes the step of: upon setting of reactance values of the respective variable-reactance elements corresponding to a predetermined plurality of radiation patterns to the variable-reactance elements, respectively, calculating the cross correlation coefficient, and selecting and setting, as initial values, reactance values of the respective variable-reactance elements corresponding to one radiation pattern having the maximum cross correlation coefficient. Therefore, initial values of reactance values of the respective variable-reactance elements can be selected properly, and, as compared with the related art method, the convergence time for an optimum solution can be remarkably reduced to a large extent and adaptive control can be achieved with less quantity of calculations so that the main beam is directed toward a desired wave and the null(s) is directed toward an interference wave(s).

Further, according to a method for controlling an array antenna according to a preferred embodiment of the present invention, in a method for controlling the ESPAR antenna, the reactance values of the respective variable-reactance elements are searched for by the variable-step search method. Accordingly, it becomes implementable to fulfill training so that the performance is improved every iteration of search, so that the convergence time to an optimum solution can be remarkably reduced to a large extent. As a result, the quantity of calculations is reduced and a long training sequence signal is not required.

Still further, according to a method for controlling an array antenna according to a preferred embodiment of the present invention, in the method for controlling the ESPAR antenna, the method includes the following steps of: perturbing the reactance values of the variable-reactance elements, respectively, by a predetermined difference width $\Delta X$ sequentially, calculating a predetermined estimation function value for each of the reactance values, and based on the calculated estimation function value and by using a steepest gradient method having a step width $\mu$, iteratively calculating reactance values of the variable-reactance elements, respectively, so that the estimation function value becomes either one of the maximum and the minimum; and, upon calculating and setting each of the reactance values of the variable-reactance elements for directing a main beam of the array antenna apparatus toward a desired wave and directing a null(s) thereof toward an interference wave(s), decreasing the difference width $\Delta X$ and the step width $\mu$ by using a predetermined decreasing function depending either one of on the estimation function value f and on a signal to interference noise ratio SINR calculated from the estimation function f. Accordingly, upon directing the main beam of the array antenna apparatus toward a desired wave and directing the null(s) thereof toward an interference wave(s), a successful estimation function value can be obtained at higher speed with a smaller number of iterations and a successful convergence value can be obtained, as compared with the related art method.

Still further, according to a method for controlling an array antenna according to a preferred embodiment of the present invention, in the method for controlling the ESPAR antenna, the method includes the following steps of: calculating a predetermined estimation function value based on the received radio signal, calculating difference reactance values of the variable-reactance elements, respectively, based on the calculated estimation function value by using a Marquardt method having a predetermined Marquardt number, perturbing the reactance values of the respective variable-reactance elements by a predetermined difference reactance value sequentially, and iterating the above steps, thereby calculating and setting optimum solutions of reactance values of the variable-reactance elements for directing a main beam of the array antenna toward a desired wave and directing a null(s) thereof toward an interference wave(s), so that the estimation function value becomes either one of the maximum and the minimum. In this. case, preferably, the Marquardt number is controlled so as to be gradually decreased as the optimum solutions are approached. Accordingly, the convergence speed is enhanced by using the Marquardt method, and the optimization of reactance values can be achieved with a relatively smaller number of samples, as compared with the steepest descent method, allowing the main beam to be directed toward a desired wave at a high speed.

As described hereinabove, although the present invention has been described in detail by preferred embodiments thereof, the present invention is not limited to this, and it would be apparent to those skilled in the art that various preferred changes and modifications are possible within the technical scope of the present invention as defined by the following appended claims.

What is claimed is:

1. A method for controlling an array antenna, said array antenna comprising:

a radiating element for receiving a radio signal;

a plurality of parasitic elements provided apart from said radiating element by a predetermined distance;

a plurality of variable-reactance elements connected to said plurality of parasitic elements, respectively; and controlling means for changing a directivity characteristic of said array antenna by changing each reactance value set to each of said variable-reactance elements so that each of said parasitic elements operates as either one of a director and a reflector, wherein said method includes a step of iterating the following steps of:

upon setting the reactance values of said respective variable-reactance elements by randomly perturbing the reactance values from predetermined initial values, calculating predetermined cross correlation coefficients between a received signal and a training sequence signal before and after the perturbation, the received signal being obtained by receiving by said array antenna a training sequence signal contained in a radio signal transmitted from a remote transmitter, and the training sequence signal being generated so as to have a signal pattern identical to that of the transmitted training sequence signal;

selecting and setting reactance values when the cross correlation coefficient increases between those before and after the perturbation; and setting reactance values obtained by randomly perturbing the selected reactance values, to the variable-reactance elements, respectively.

2. The method for controlling the array antenna as claimed in claim 1, wherein the initial values are reactance values of said respective variable-reactance elements corresponding to one radiation pattern having the maximum cross correlation coefficient out of the reactance values of said respective variable-reactance elements corresponding to a predetermined plurality of radiation patterns.

3. The method for controlling the array antenna as claimed in claim 2, wherein the plurality of radiation patterns include at least one set of the following patterns:

(a) a plurality of sector beam patterns having the maximum gains in directions directed from said radiating element toward said respective parasitic elements, respectively; and (b) a plurality of sector beam patterns having the maximum gains in directions directed from said radiating element toward respective intermediate positions located between respective pairs of mutually adjacent parasitic elements.

4. A method for controlling an array antenna, said array antenna comprising:

a radiating element for receiving a radio signal;

a plurality of parasitic elements provided apart from said radiating element by a predetermined distance;

a plurality of variable-reactance elements connected to said plurality of parasitic elements, respectively; and controlling means for changing a directivity characteristic of said array antenna by changing each reactance value set to each of said variable-reactance elements so that each of said parasitic elements operates as either one of a director and a reflector, wherein said method includes:

upon dividing a range of each reactance value available for each of said variable-reactance elements, into two ranges thereof and setting representative values of respective divided two ranges to said variable-reactance elements, respectively, a first step of calculating predetermined cross correlation coefficients between a received signal and a training sequence signal before and after the perturbation, the received signal being obtained by receiving by said array antenna a training sequence signal contained in a radio signal transmitted from a remote transmitter, and the training sequence signal being generated so as to have a signal pattern identical to that of the transmitted training sequence signal, and selecting and setting, as initial values, reactance values of said respective variable-reactance elements corresponding to a larger cross correlation coefficient out of the two cross correlation coefficients corresponding to the representative values of the respective divided two ranges; and a second step of dividing a range belonging to the selected reactance values into two ranges thereof, calculating the cross correlation coefficients upon setting of the representative values of the respective divided two ranges to said variable-reactance elements, respectively, and selecting and setting reactance values of said variable-reactance elements corresponding to a larger cross correlation coefficient out of the two cross correlation coefficients corresponding to the representative values of the respective divided two ranges, thereby controlling a main beam and a null(s) of said array antenna so that the main beam is directed toward a desired wave and the null(s) is directed toward an interference wave(s).

5. The method for controlling the array antenna as claimed in claim 4, wherein the first step includes a step of, upon dividing the range of each reactance value available for each of said variable-reactance elements, into two ranges thereof and setting representative values of respective divided two ranges to said variable-reactance elements, respectively, calculating a predetermined cross correlation coefficient between a received signal and a training sequence signal, the received signal being obtained by receiving a training sequence signal contained in a radio signal transmitted from a remote transmitter by said array antenna, and the training sequence signal being generated so as to have a signal pattern identical to that of the received training sequence signal, and selecting and setting, as initial values, reactance values of said respective variable-reactance elements corresponding to a larger cross correlation coefficient out of the two cross correlation coefficients corresponding to medians of the respective divided two ranges, and wherein the second step includes a step of, upon dividing the range belonging to the selected reactance values into two ranges thereof and setting of the medians of the respective divided two ranges to said variable-reactance elements, respectively, calculating the cross correlation coefficient, and selecting and setting reactance values of said variable-reactance elements corresponding to a larger cross correlation coefficient out of the two cross correlation coefficients corresponding to the medians of the respective divided two ranges.

6. The method for controlling the array antenna as claimed in claim 4, further including a step of iterating the process of the second step until a predetermined number of iterations.

7. The method for controlling the array antenna as claimed in claim 4, instead of the first step, said method including, upon setting of reactance values of said respective variable-reactance elements corresponding to a predetermined plurality of radiation patterns to said variable-reactance elements, respectively, calculating the cross correlation coefficient, and selecting and setting, as initial values, reactance values of said respective variable-reactance elements corresponding to one radiation pattern having the maximum cross correlation coefficient.

8. The method for controlling the array antenna as claimed in claim 7, wherein the plurality of radiation patterns include at least one set of:

(a) a plurality of sector beam patterns having maximum gains in directions directed from said radiating element toward said parasitic elements, respectively;

(b) a plurality of sector beam patterns having maximum gains in directions directed from the radiating element toward respective intermediate positions between respective pairs of mutually adjacent parasitic elements, respectively; and (c) a plurality of radiation patterns having lobes in directions directed from the radiating element toward a plurality of mutually non-adjacent alternate parasitic elements.

9. A method for controlling an array antenna, said array antenna comprising:

a radiating element for receiving a radio signal;

a plurality of parasitic elements provided apart from said radiating element by a predetermined distance;

a plurality of variable-reactance elements connected to said plurality of parasitic elements, respectively; and controlling means for changing a directivity characteristic of said array antenna by changing each reactance value set to each of said variable-reactance elements so that each of said parasitic elements operates as either one of a director and a reflector, wherein said method includes a control step of:

perturbing the reactance values of said variable-reactance elements, respectively, by a predetermined step width, sequentially, calculating a predetermined estimation function value for each of the reactance values, setting post-perturbation values to the reactance values when the estimation function values calculated for each of said variable-reactance elements before and after the perturbation are improved whereas setting pre-perturbation values to the reactance values when the estimation function values calculated before and after the perturbation are not improved, decreasing the step width for a succeeding-iteration process with respect to a reactance value of a variable-reactance element for which the estimation function value is not improved, and further iteratively executing a process of inverting a sign of the step width, thereby calculating and setting reactance values of said variable-reactance elements, respectively, for directing a main beam of said array antenna toward a desired wave and directing a null(s) thereof toward an interference wave(s).

10. The method for controlling the array antenna as claimed in claim 9, wherein the control step includes a step of, when the estimation function values calculated before and after the perturbation is not improved, decreasing a step width for a succeeding-iteration process with respect to a reactance value of a variable-reactance element for which the estimation function value is not improved so that the step width becomes one q-th thereof (where q is a rational number) by using a predetermined step-width change division factor q, and further inverting a sign of the resulting step width.

11. The method for controlling the array antenna as claimed in claim 9, wherein the control step includes a step of, when the estimation function value is not improved at a first-time iteration, maintaining the step width as it is and inverting the sign of the step width at a second-time iteration.

12. The method for controlling the array antenna as claimed in claim 9, wherein the control step includes the following steps of, when the set reactance value reaches a setting-limit value of a variable range for each of the reactance values of said variable-reactance elements, making the sign of the step width inverse to a sign of the step width when the set reactance value reaches the setting-limit value, and further decreasing the step width every iteration.

13. The method for controlling the array antenna as claimed in claim 9, wherein the control step includes the following steps of calculating an absolute value of a gradient value which is a difference between estimation function values before and after the iteration in the preceding-time iteration with respect to said variable-reactance elements, sorting the absolute values of a plurality of calculated gradient values in the descending order, perturbing each of the reactance values of said variable-reactance elements by a predetermined step width sequentially in an order of said variable-reactance elements corresponding to the order in which said variable-reactance elements are sorted.

14. The method for controlling the array antenna as claimed in claim 9, wherein the control step includes the following steps of calculating a gradient value which is a difference between estimation function values before and after the iteration in the preceding-time iteration with respect to said variable-reactance elements, then when the gradient values calculated for all the variable-reactance elements equal to or smaller than zero, calculating reactance values of said variable-reactance elements for directing a main beam of the array antenna apparatus toward a desired wave and directing a null(s) thereof toward an interference wave(s), so that the estimation function values calculated by using the steepest gradient method are maximized or minimized so as to be improved.

15. A method for controlling an array antenna, said array antenna comprising:

a radiating element for receiving a radio signal;

a plurality of parasitic elements provided apart from said radiating element by a predetermined distance;

a plurality of variable-reactance elements connected to said plurality of parasitic elements, respectively; and controlling means for changing a directivity characteristic of said array antenna by changing each reactance value set to each of said variable-reactance elements so that each of said parasitic elements operates as either one of a director and a reflector, wherein said method includes the following steps of:

perturbing the reactance values of said variable-reactance elements, respectively, by a predetermined difference width ΔX sequentially, calculating a predetermined estimation function value for each of the reactance values, and based on the calculated estimation function values and by using a steepest gradient method having a step width $\mu$, iteratively calculating reactance values of said variable-reactance elements, respectively, so that the estimation function value becomes either one of the maximum and the minimum; and upon calculating and setting each of the reactance values of said variable-reactance elements for directing a main beam of said array antenna apparatus toward a desired wave and directing a null(s) thereof toward an interference wave(s), decreasing the difference width ΔX and the step width $\mu$ by using a predetermined decreasing function depending either one of on the estimation function value f and on a signal to interference noise ratio SINR calculated from the estimation function f.

16. The method for controlling the array antenna as claimed in claim 15, wherein the following equation is used as a recurrence formula for the steepest gradient method:

$$X_{n+1} = X_n + \mu \frac{\nabla_{\Delta X} f}{|\nabla_{\Delta X} f|},$$

where $\mu = \alpha \Delta X$, $X_n$ is a reactance vector whose elements are reactance values of said respective variable-reactance elements at an n-th iteration, $\nabla_{\Delta X} f$ is a gradient resulting when the estimation function f is perturbed by the difference width ΔX, and α is a predetermined constant.

17. The method for controlling the array antenna as claimed in claim 15, wherein the decreasing function representing the difference width ΔX is represented by the following equation with respect to the signal to interference noise ratio SINR calculated from the estimation function value f:

$$\Delta X = \Delta X_0 [1 - \{\log_{10}(\mathrm{SINR})\}/\gamma],$$

where $\Delta X_0$ is an initial value of the difference width, and γ is a predetermined constant.

18. The method for controlling the array antenna as claimed in claim 15, wherein the decreasing function representing the difference width ΔX is represented by the following equation with respect to the signal to interference noise ratio SINR calculated from the estimation function value f:

$$\Delta X = \Delta X_0 (\mathrm{SINR})^{-\eta},$$

where $\Delta X_0$ is an initial value of the difference width, and η is a predetermined constant.

19. A method for controlling an array antenna, said array antenna comprising:

a radiating element for receiving a radio signal;

a plurality of parasitic elements provided apart from said radiating element by a predetermined distance;

a plurality of variable-reactance elements connected to said plurality of parasitic elements, respectively; and controlling means for changing a directivity characteristic of said array antenna by changing each reactance value set to each of said variable-reactance elements so that each of said parasitic elements operates as either one of a director and a reflector, wherein said method includes the following steps of:

calculating predetermined estimation function values based on the received radio signal, calculating difference reactance values of said variable-reactance elements, respectively, based on the calculated estimation function values by using a Marquardt method having a predetermined Marquardt number, perturbing the reactance values of said respective variable-reactance elements by a predetermined difference reactance value sequentially, and iterating said above steps, thereby calculating and setting optimum solutions of reactance values of said variable-reactance elements for directing a main beam of said array antenna toward a desired wave and directing a null(s) thereof toward an interference wave(s), so that the estimation function value becomes either one of the maximum and the minimum.

20. The method for controlling the array antenna as claimed in claim 19, wherein said method includes a step of controlling the Marquardt number so as to be gradually decreased as the Marquardt number approaches an optimum solution.

* * * * *

UNITED STATES PATENT AND TRADEMARK OFFICE

CERTIFICATE OF CORRECTION

PATENT NO. : 6,677,898 B2
DATED : January 13, 2004
INVENTOR(S) : Cheng et al.

It is certified that error appears in the above-identified patent and that said Letters Patent is hereby corrected as shown below:

Title page,
Item [75], Inventors, please change the sixth inventor's residence as follows from "Nogoya" to -- Nagoya --

Signed and Sealed this

Eleventh Day of January, 2005

JON W. DUDAS
*Director of the United States Patent and Trademark Office*